US007503886B2

(12) United States Patent
Sekine et al.

(10) Patent No.: US 7,503,886 B2
(45) Date of Patent: Mar. 17, 2009

(54) PAPER FOLDING DEVICE, FINISHER, AND IMAGE FORMING APPARATUS

(75) Inventors: Noriaki Sekine, Saitama (JP); Toshiaki Tobishima, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/373,256

(22) Filed: Mar. 13, 2006

(65) Prior Publication Data

US 2006/0205580 A1 Sep. 14, 2006

(30) Foreign Application Priority Data

Mar. 14, 2005 (JP) ..... 2005-071704
Jul. 5, 2005 (JP) ..... 2005-196390
Jan. 23, 2006 (JP) ..... 2006-014098

(51) Int. Cl.
*B31F 1/10* (2006.01)

(52) U.S. Cl. ..... 493/434; 493/424; 493/427

(58) Field of Classification Search ..... 493/434, 493/424, 427, 438, 433, 430, 442, 451
See application file for complete search history.

(56) References Cited

U.S. PATENT DOCUMENTS 3,339,916 A * 9/1967 Tregay ..... 271/170
4,449,705 A * 5/1984 Shibuya et al. ..... 271/9.09
4,700,939 A * 10/1987 Hathaway ..... 270/39.02
5,695,182 A 12/1997 Sekine
5,718,313 A 2/1998 Sekine
5,957,447 A 9/1999 Sekine
6,719,680 B2 * 4/2004 Hosoya et al. ..... 493/324
6,746,390 B2 * 6/2004 Tamura et al. ..... 493/445
6,837,840 B2 * 1/2005 Yonekawa et al. ..... 493/444
6,939,283 B2 * 9/2005 Sparano et al. ..... 493/424
2002/0135821 A1 9/2002 Sekine

FOREIGN PATENT DOCUMENTS

JP 3356851 10/2002
JP 2004-67266 3/2004

* cited by examiner

*Primary Examiner*—Sameh H. Tawfik
(74) *Attorney, Agent, or Firm*—Oblon, Spivak, McClelland, Maier & Neustadt, P.C.

(57) ABSTRACT

A paper folding device having a function of alternately switching a bending direction to carry out folding continuously a plurality of times. The paper folding device comprises first and second pairs of folding roller pairs that bend a paper; a carry roller pair that feeds the paper to the first or second folding roller pair; and a biasing device for switching a direction in which the paper is bent by the first or second folding roller pair. The biasing device brings the paper into contact with one (lower side) folding roller of the folding roller pair on a side where the paper folds, and the paper to be folded is carried and folded. When paper is caused to enter a nip of the left folding roller pair by the left shifting device, tension is applied to the paper by a right shifting device. Thus, the angle at which the paper winds onto upper side folding rollers is adjusted.

3 Claims, 49 Drawing Sheets

TA : IDEAL VALUE

Ta : MEASURED VALUE (FLUCTUATION)

PAPER FOLDING DEVICE, FINISHER, AND IMAGE FORMING APPARATUS

BACKGROUND OF THE INVENTION

1. Field of the Invention

The present invention relates to paper folding devices having a function of being capable of folding paper a plurality of times, finishers provided with this paper folding device, and image forming apparatuses such as copying machines, printers, facsimile machines, or digital multifunction devices, provided with this paper folding device or finisher.

2. Description of the Background Art

Paper folding devices such as those disclosed in Japanese Patent Application Laid-open No. 2004-67266 (hereinafter referred to as Prior Art 1) and Japanese Patent No. 3,356,851 (hereinafter referred to as Prior Art 2) are known as examples of devices that have two pairs of folding rollers that bend paper, a pair of carry rollers that feed paper to either of the roller pairs, and a biasing means that switches a direction in which the paper bends to either of the folding rollers, and are capable of alternately switching the bending direction to fold paper continuously a plurality of times. These devices have biasing means that push a central portion of the paper toward a rolling position at a nip of the folding rollers.

However, as is described later, in these conventional paper folding devices, there is large unevenness in folding positions due to thick papers and thin papers, and unevenness in the folding positions for single folds and multiple folds, and therefore there have been problems of having low folding accuracy and unstable folding functions.

SUMMARY OF THE INVENTION

The present invention has been devised in consideration of these problems and it is an object thereof to provide a paper folding device that greatly reduces unevenness in folding positions due to thick papers and thin papers as well as unevenness in the folding positions for single folds and multiple folds, and can achieve folding functions with high folding accuracy and stability.

Another object of the present invention is to provide a finisher provided with this paper folding device.

Another object of the present invention is to provide an image forming apparatus provided with this paper folding device or finisher.

In an aspect of the present invention, a paper folding device has a function of alternately switching a bending direction to carry out folding continuously a plurality of times and comprises first and second pairs of folding roller pairs that bend a paper; a carry roller pair that feeds the paper to the first or second folding roller pair; and a biasing device for switching a direction in which the paper is bent by the first or second folding roller pair. The biasing device brings the paper into contact with one folding roller of the folding roller pair on a side where the paper folds, and the paper to be folded is carried and folded.

In another aspect of the present invention, a paper folding device has a function of alternately switching a bending direction to carry out folding continuously a plurality of times and comprises first and second pairs of folding roller pairs that bend a paper; a carry roller pair that feeds the paper to the first or second folding roller pair; and a biasing device for switching a direction in which the paper is bent by the first or second folding roller pair. The paper is brought into contact with one folding roller of the folding roller pair on a side where paper is folded while the biasing device applies a fixed tension to the paper, and the paper to be folded is carried and folded.

In another aspect of the present invention, a paper folding device has a function of alternately switching a bending direction to carry out folding continuously a plurality of times and comprises first and second pairs of folding roller pairs that bend a paper; a carry roller pair that feeds the paper to the first or second folding roller pair; and a biasing device for switching a direction in which the paper is bent by the first or second folding roller pair. Both ends of the biasing device are driven so that movement amounts of both ends of the biasing device become equivalent, and the paper is brought into contact with one folding roller of the folding roller pair on a side where paper is folded such that the paper to be folded is carried and folded.

In another aspect of the present invention, a paper folding device has a function of alternately switching a bending direction to carry out folding continuously a plurality of times and comprises first and second pairs of folding roller pairs that bend a paper; a carry roller pair that feeds the paper to the first or second folding roller pair; and a biasing device for switching a direction in which the paper is bent by the first or second folding roller pair. The biasing device supports and carries the paper to be folded in a state having a gap equal to or greater than one sheet of paper with respect to one folding roller of the folding roller pair on a side where the paper folds.

In another aspect of the present invention, a finisher provided with a paper folding device has a function of alternately switching a bending direction to carry out folding continuously a plurality of times. The paper folding device comprises first and second pairs of folding roller pairs that bend a paper; a carry roller pair that feeds the paper to the first or second folding roller pair; and a biasing device for switching a direction in which the paper is bent by the first or second folding roller pair. The biasing device brings the paper into contact with one folding roller of the folding roller pair on a side where the paper folds, and the paper to be folded is carried and folded.

In another aspect of the present invention, a finisher provided with a paper folding device has a function of alternately switching a bending direction to carry out folding continuously a plurality of times. The paper folding device comprises first and second pairs of folding roller pairs that bend a paper; a carry roller pair that feeds the paper to the first or second folding roller pair; and a biasing device for switching a direction in which the paper is bent by the first or second folding roller pair. The biasing device brings the paper into contact with one folding roller of the folding roller pair on a side where the paper folds while applying a fixed tension to the paper, and the paper to be folded is carried and folded.

In another aspect of the present invention, a finisher provided with a paper folding device has a function of alternately switching a bending direction to carry out folding continuously a plurality of times. The paper folding device comprises first and second pairs of folding roller pairs that bend a paper; a carry roller pair that feeds the paper to the first or second folding roller pair; and a biasing device for switching a direction in which the paper is bent by the first or second folding roller pair. Both ends of the biasing device are driven so that movement amounts of become equivalent, and the paper is brought into contact with one folding roller of the folding roller pair on a side where paper is folded such that the paper to be folded is carried and folded.

In another aspect of the present invention, a finisher provided with a paper folding device has a function of alternately switching a bending direction to carry out folding continuously a plurality of times. The paper folding device comprises first and second pairs of folding roller pairs that bend a paper; a carry roller pair that feeds the paper to the first or second folding roller pair; and a biasing device for switching a direction in which the paper is bent by the first or second folding roller pair. The biasing device supports and carries the paper to be folded in a state having a gap equal to or greater than one sheet of paper with respect to one folding roller of the folding roller pair on a side where the paper folds.

In another aspect of the present invention, an image forming apparatus provided with a paper folding device has a function of alternately switching a bending direction to carry out folding continuously a plurality of times. The paper folding device comprises first and second pairs of folding roller pairs that bend a paper; a carry roller pair that feeds the paper to the first or second folding roller pair; and a biasing device for switching a direction in which the paper is bent by the first or second folding roller pair. The biasing device brings the paper into contact with one folding roller of the folding roller pair on a side where the paper folds, and the paper to be folded is carried and folded.

In another aspect of the present invention, an image forming apparatus provided with a paper folding device has a function of alternately switching a bending direction to carry out folding continuously a plurality of times. The paper folding device comprises first and second pairs of folding roller pairs that bend a paper; a carry roller pair that feeds the paper to the first or second folding roller pair; and a biasing device for switching a direction in which the paper is bent by the first or second folding roller pair. The biasing device brings the paper into contact with one folding roller of the folding roller pair on a side where the paper folds while applying a fixed tension to the paper, and the paper to be folded is carried and folded.

In another aspect of the present invention, an image forming apparatus provided with a paper folding device has a function of alternately switching a bending direction to carry out folding continuously a plurality of times. The paper folding device comprises first and second pairs of folding roller pairs that bend a paper; a carry roller pair that feeds the paper to the first or second folding roller pair; and a biasing device for switching a direction in which the paper is bent by the first or second folding roller pair. Both ends of the biasing device are driven so that movement amounts of both ends of the biasing device become equivalent, and the paper is brought into contact with one folding roller of the folding roller pair on a side where paper is folded such that the paper to be folded is carried and folded.

In another aspect of the present invention, an image forming apparatus provided with a paper folding device has a function of alternately switching a bending direction to carry out folding continuously a plurality of times. The paper folding device comprises first and second pairs of folding roller pairs that bend a paper; a carry roller pair that feeds the paper to the first or second folding roller pair; and a biasing device for switching a direction in which the paper is bent by the first or second folding roller pair. The biasing device supports and carries the paper to be folded in a state having a gap equal to or greater than one sheet of paper with respect to one folding roller of the folding roller pair on a side where the paper folds.

In another aspect of the present invention, a paper folding device comprises a folding roller pair that folds a paper; a carry roller pair that feeds the paper to the folding roller pair; a biasing device for switching a direction in which the paper is bent by the folding roller pair and folding in the paper; and a tension applying device that applies tension to the paper folded between the folding roller pair and the carry roller pair.

In another aspect of the present invention, a finisher is provided with a paper folding device. The paper folding device comprises a folding roller pair that folds a paper; a carry roller pair that feeds the paper to the folding roller pair; a biasing device for switching a direction in which the paper is bent by the folding roller pair and for folding in the paper; and a tension applying device that applies tension to the paper folded between the folding roller pair and the carry roller pair.

In another aspect of the present invention, an image forming apparatus is provided with a paper folding device. The paper folding device comprises a folding roller pair that folds a paper; a carry roller pair that feeds the paper to the folding roller pair; a biasing device for switching a direction in which the paper is bent by the folding roller pair and for folding in the paper; and a tension applying device that applies tension to the paper folded between the folding roller pair and the carry roller pair.

BRIEF DESCRIPTION OF THE DRAWINGS

The above and other objects, features, and advantages of the present invention will become more apparent from the following detailed description taken with the companying drawings in which.

DESCRIPTION OF THE PREFERRED EMBODIMENTS

Before describing embodiments of the present invention, prior art and problems thereof are described with reference to the accompanying drawings.

As stated above, paper folding devices that have two pairs of folding rollers that bend paper, a pair of carry rollers that feed paper to either of the roller pairs, and a biasing means that switches a direction in which the paper bends to either of the folding rollers, and are capable of alternately switching the bending direction to fold paper continuously a plurality of times are disclosed in the above-mentioned Prior Art 1 and Prior Art 2 for example. These conventional paper folding devices have biasing means that push a central portion of the paper toward a rolling position at a nip of the folding rollers. That is, the biasing means of the paper folding device disclosed in Prior Art 1 is indicated by folding knives 240*x* and 250*x* in FIGS. 1A to 1C, and the biasing means of the paper folding device disclosed in Prior Art 2 is indicated by pushing rollers 330*a* and 330*b* in FIG. 2.

Figure 1A:
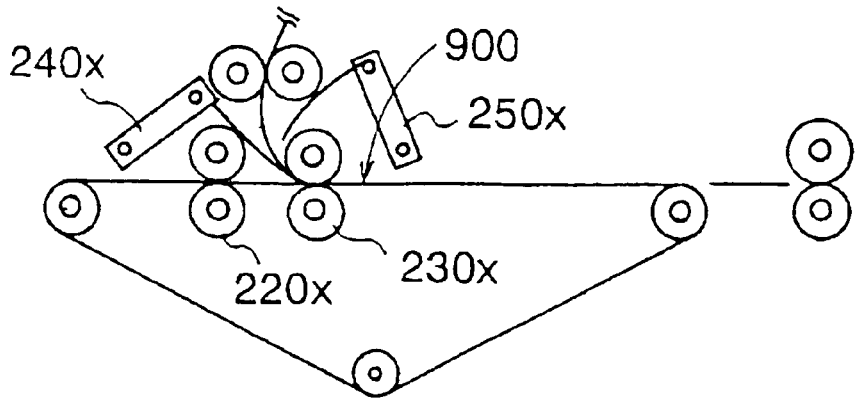
FIG. 1A PRIOR ART
FIGS. 1A to 1C are diagrams for describing one example operation of a conventional technique.
Figure 1B:
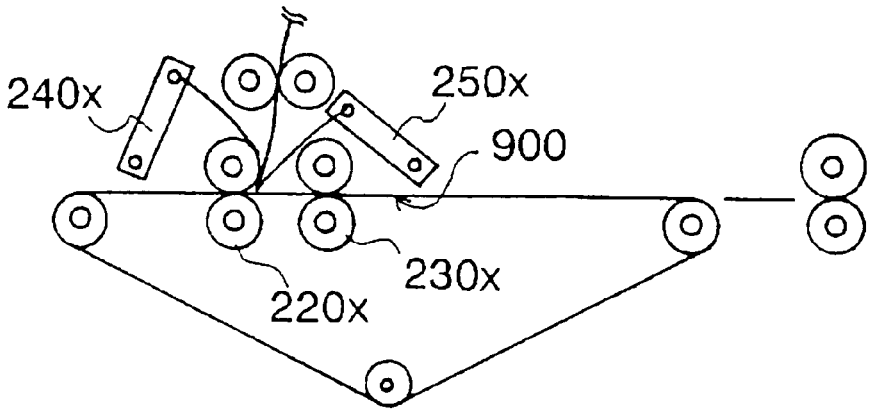
FIG. 1B PRIOR ART
Figure 1C:
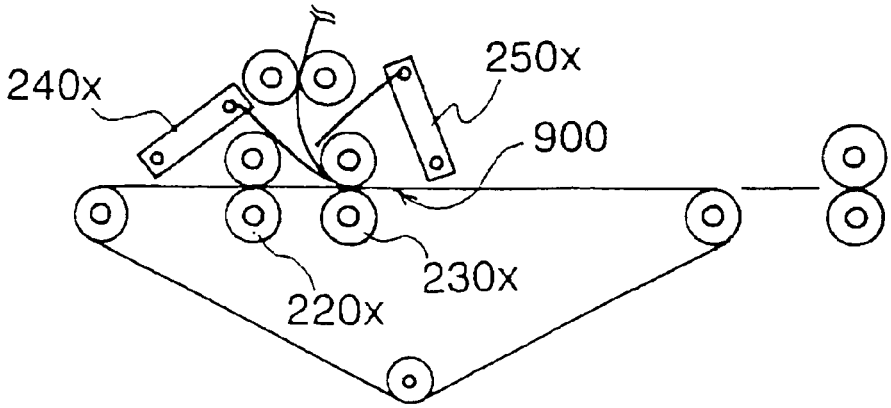
FIG. 1C PRIOR ART

To describe this more specifically, repetition of an operation is described in Prior Art 1 in which, after the leading edge area of a paper 900 that has been fed as shown in FIG. 1A has been gripped between an upper roller and a lower roller of a second folding roller pair 230*x* for example (at this time, the folding knife 240*x* guides the leading edge area of the paper 900), an area that is to become the first fold of a zigzag shape fold of the paper 900 is guided by the folding knife 250*x* and gripped between an upper roller and a lower roller of a first folding roller pair 220*x* as shown in FIG. 1B, and then a portion that is to become the next fold of the zigzag shape fold of the paper 900 is guided by the folding knife 240*x* as shown in FIG. 1C and gripped between an upper roller and a lower roller of a second folding roller pair 230*x*.

Figure 2:
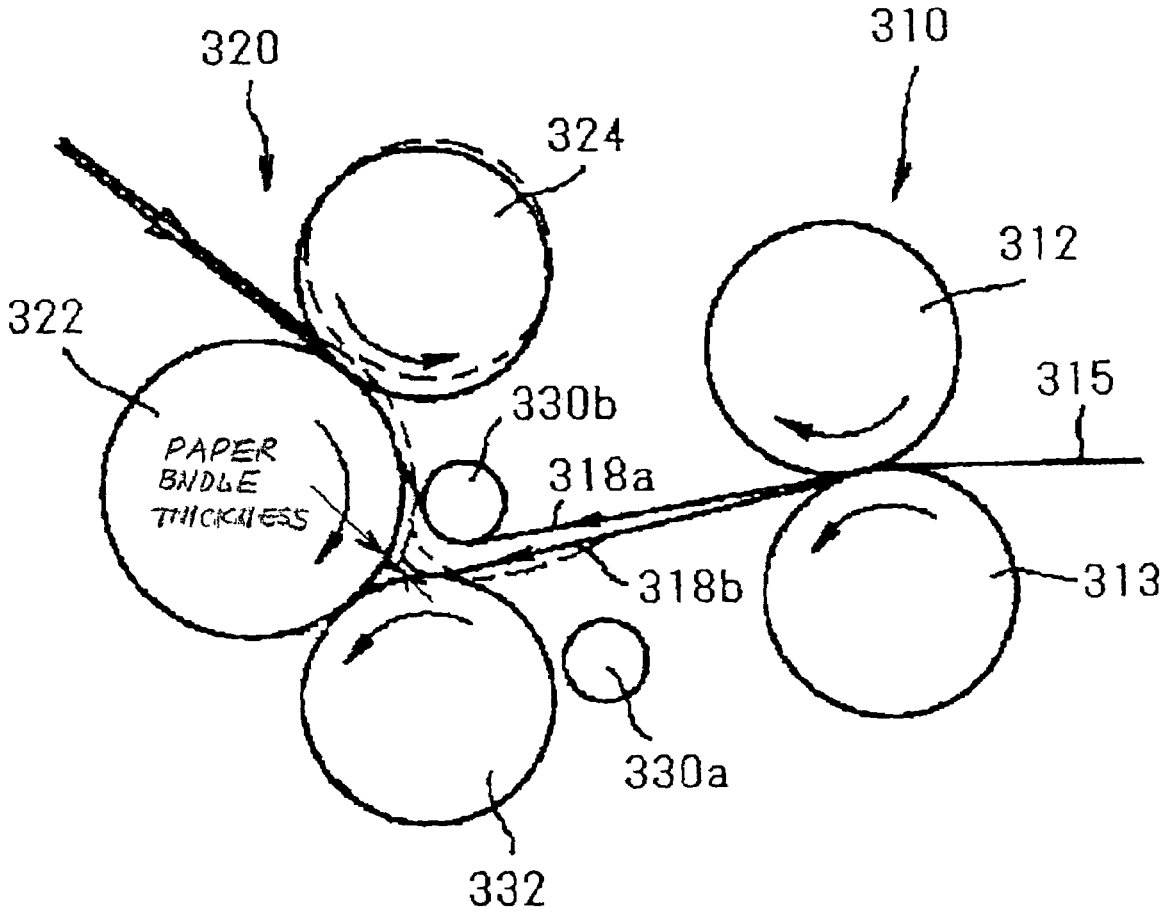
FIG. 2 PRIOR ART
FIG. 2 is a diagram for describing another example operation of a conventional technique.

On the other hand, it is described in Prior Art 2 that, for the case of folding up a sheet, after a sheet 315 passes between the rollers 322 and 324 in FIG. 2 for example by a predetermined length, a half rotation clutch is operated to move a driven roller 313 and push rollers 330*a* and 330*b* to a first position, and the sheet 315 between a carry roller pair 310, which is constituted by a driving roller 312 and the driven roller 313, and a folding roller group 320 (322, 323, and 332) is pushed toward the rollers 322 and 332 by a push roller 330*b* as shown by numeral 318*a*, thereby creating a flexure in the sheet 315, and the folding rollers 322 and 324 are rotated forward so that a flexed portion of the sheet 315 as shown by numeral 318*b* is clenched in the rollers 320 and 323 to form a fold. Then it is disclosed that the sheet 315 can be folded in this manner, after which the half rotation clutch is operated as required in the same manner to carry out multiple folding of the sheet 315.

However, in the case of these conventional paper folding devices, the biasing means is moved close to the two respective pairs of folding rollers, but the folding rollers and the paper do not contact directly. Thus, the paper flexes in a circular arc shape from a position where the central portion of the paper is stopped being pushed toward the rolling position, the folding roller pairs and the paper come in contact, and the paper gripped in the nip of the folding rollers is folded. The paper flexes in a circular arc shape and a force by which the paper contacts the folding rollers when the folding roller pair and the paper come in contact is only a restoring force due to the rigidity of the paper (a force of returning from a flexed state to a flat state). Consequently, a carrying force of the folding rollers when the paper flexes and comes in contact with the folding roller pair varies according to the rigidity of the paper, that is, the thickness of the paper (ordinarily the thicker a paper is, the greater its rigidity).

In fact, a resistant force is produced when the paper changes from a flexed state to a state in which it buckles and folds. When this resistant force is strong, the carrying force of the folding rollers when the paper flexes and comes into contact with the folding roller pair is overcome and slippage occurs such that the paper flexes more between the folding rollers and the carry rollers, finally causing unevenness in the folding positions due to the thickness of the paper.

Further still, when folding is repeated multiple times for multiple folding, a paper bundle (dashed line portion) forms on a lower surface side of the paper flexed in a circular arc shape as in FIG. 2. The form of the paper flexed in a circular arc shape at this time is a form such as that shown by the dashed line in FIG. 2 and naturally is different than a flexed form of a single fold. Since the contact position of the folding roller pair and the paper varies at this time, the amount of slippage between the folding rollers and the paper due to the resistant force when the paper buckles and goes into a folded state further varies. That is, there is further unevenness in the folding positions. Also, as for the thickness of the paper bundle (dashed line portion) when folding at the same width, the fold of the paper, that is, the vicinity of the peak where the paper flexes, bulges the most and tends to vary. This is because the thicknesses of the folds vary greatly since the paper bundles form thickly and the paper bundles form thinly due to thick papers and thin papers.

Due to this, the contact positions of the folding roller pairs and the paper further varies, and therefore the amount of slippage between the folding rollers and the paper due to the resistant force when the paper buckles and goes into a folded state varies even more. That is, there is further unevenness in the folding positions.

The following are detailed descriptions, with reference to the accompanying drawings, of embodiments of the present invention that solve the above-described problems of conventional techniques.

First Embodiment

Figure 3:
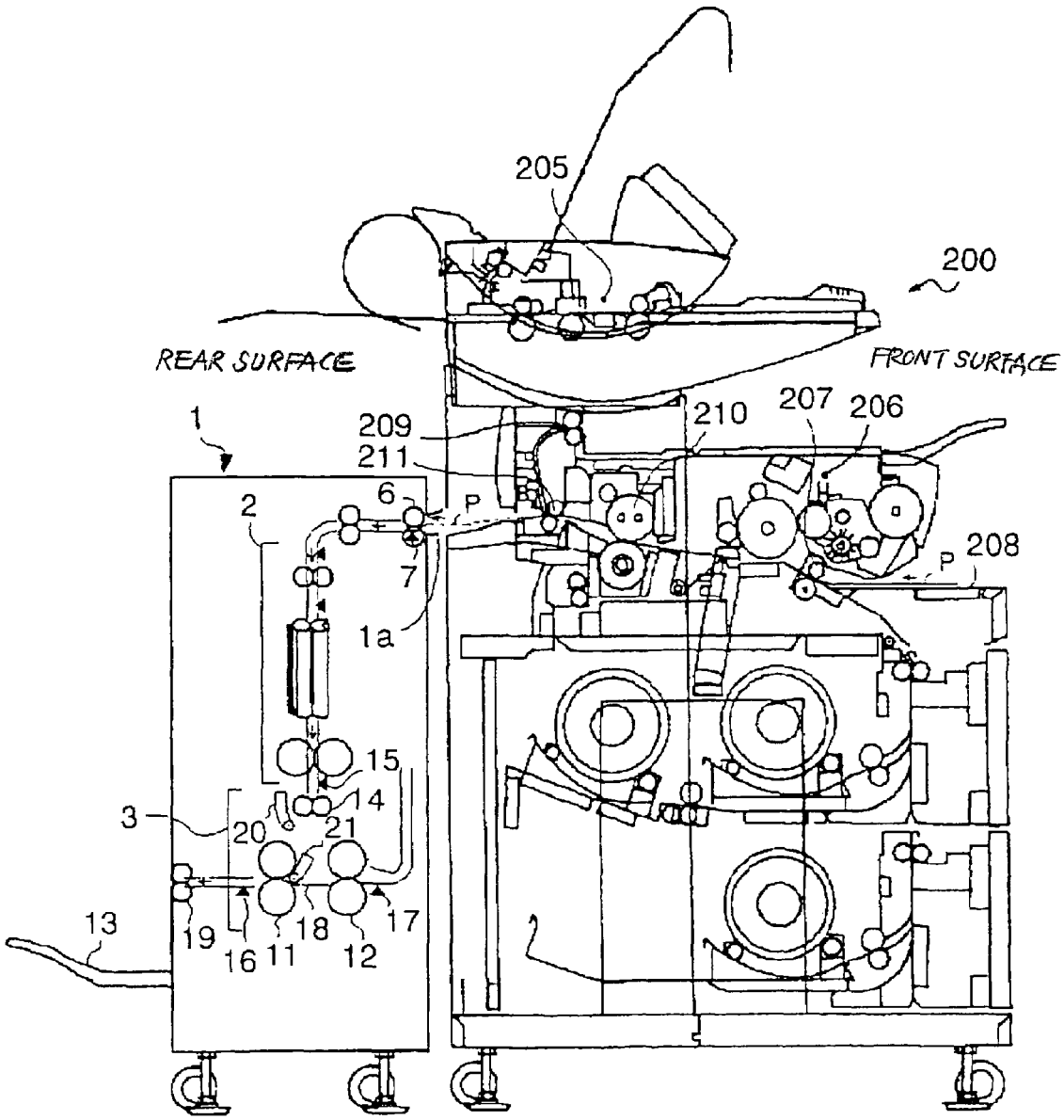
FIG. 3 is a lateral view showing a system structure of a copying machine main unit and a paper folding device according to a first embodiment of the present invention.

FIG. 3 shows an overall outlined structure of a system of an image forming apparatus according to a first embodiment of the present invention. As shown in the diagram, the system is constituted by a copying machine main unit 200 and a paper folding device 1, with the paper folding device 1 linked to a rear surface of the copying machine main unit 200 and being capable of end surface folding and accordion folding of sheets. The paper folding device 1 is constituted by a linking portion la that links with the main unit, an end surface folding portion 2 that folds an end surface of a leading edge of a sheet, a paper folding portion 3 that folds a sheet in an accordion shape in a carrying direction, and a tray 13 into which folded sheets are discharged and stacked.

An image reading apparatus 205 is arranged in the copying machine main unit 200 and a manual feed platform 208 is arranged thereunder. When paper is loaded into the manual feed platform 208, the paper is temporarily stopped at a nip of a register roller 207 then fed into an image forming unit 206 with an appropriate timing. The image forming unit 206 forms a latent image on an unshown photosensitive body corresponding to image data, this latent image is developed using toner, the toner is transferred to the paper and fixed using a fixing apparatus 210. When a recorded sheet on which toner has been fixed by the fixing apparatus 210 is to undergo paper folding, the recorded sheet is discharged to the paper folding device 1 by a recorded sheet discharge roller 211. And when folding is not to be carried out, the paper is discharged to inside a main unit cylinder by an upper discharge roller 209 due to an unshown switching claw.

Next, when the paper is to be folded, the paper is sent to the paper folding device 1 by the recorded sheet discharge roller 211, the paper is sent by entrance carrying roller pairs 6 and 7, and when an end surface of the paper is to be folded, an end surface of the leading edge of the paper is folded by the end surface folding portion 2. After the end surface of the leading edge of the paper has been folded by the end surface folding portion 2, the paper is folded into an accordion shape in the carrying direction by the paper folding portion 3 and the folded paper is stacked in the tray 13.

The paper folding portion 3 has a function of folding paper into an accordion shape with respect to the carrying direction. An enlargement of principle portions of the paper folding portion 3 of FIG. 3 is shown in FIG. 4.

Figure 4:
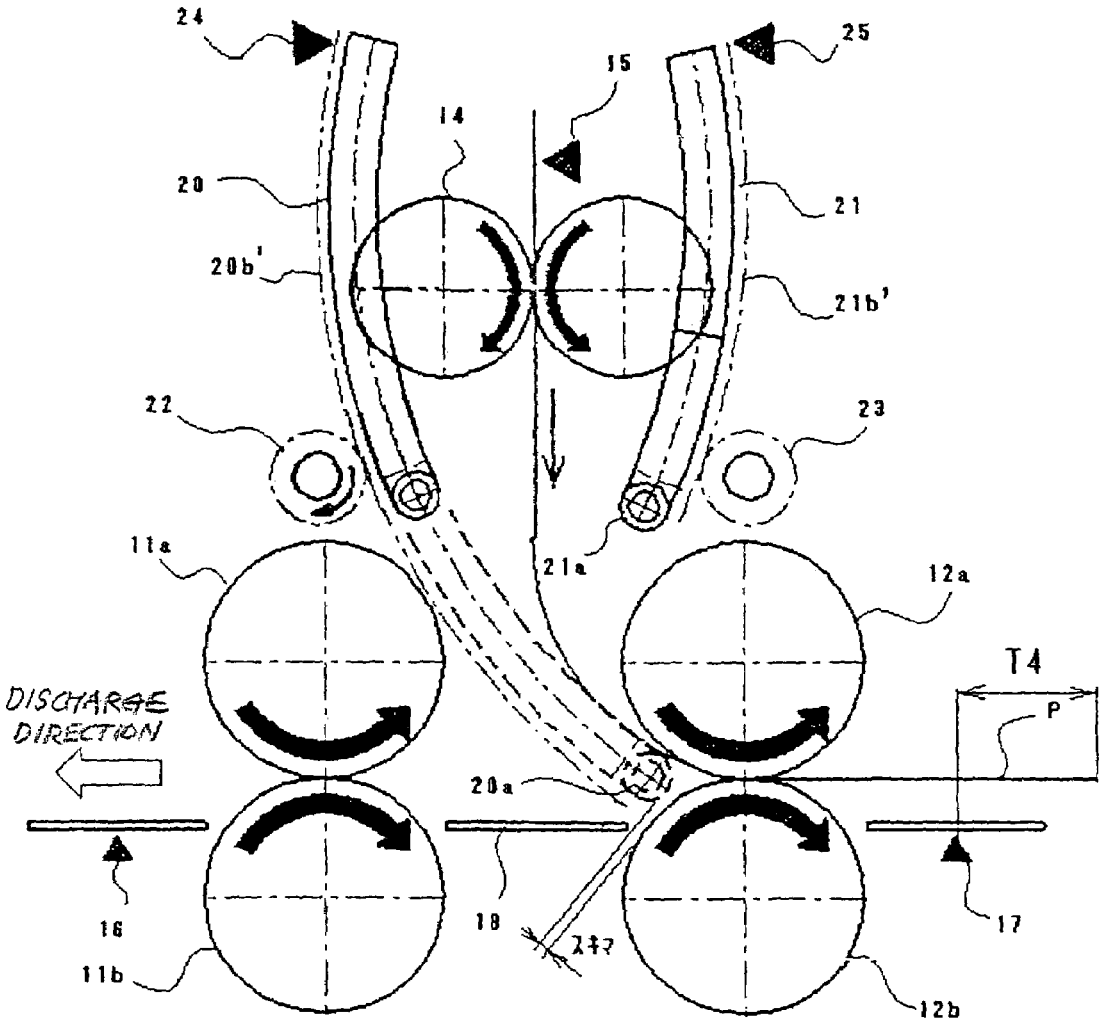
FIGS. 4 to 7 are diagrams for describing an operation of a paper folding device according to the first embodiment.

In FIG. 4, a leading edge detection sensor 15 that detects the leading edge of a paper P is arranged at the entrance of the paper folding portion 3 and a pair of carry rollers 14 are provided on a downstream side thereof. On the downstream side of this, folding roller pairs 11 and 12 that carry paper in a perpendicular direction are arranged opposing the paper carrying direction in which paper is carried by the pair of carry rollers 14. The folding roller pairs 11 and 12 rotate forward or backward in synchronization and fold paper in an accordion shape. A paper width left sensor 16 and a paper width right sensor 17 are provided on outer sides of the folding roller pairs 11 (11*a* and 11*b*) and 12 (12*a* and 12*b*) and detect the leading edge of the paper and the folded end surface of a folded sheet. A lower guide plate 18 is arranged between the folding roller pairs 11 and 12 and guides the end surface of folded sheets to the roller pairs 11 and 12.

Figure 6:
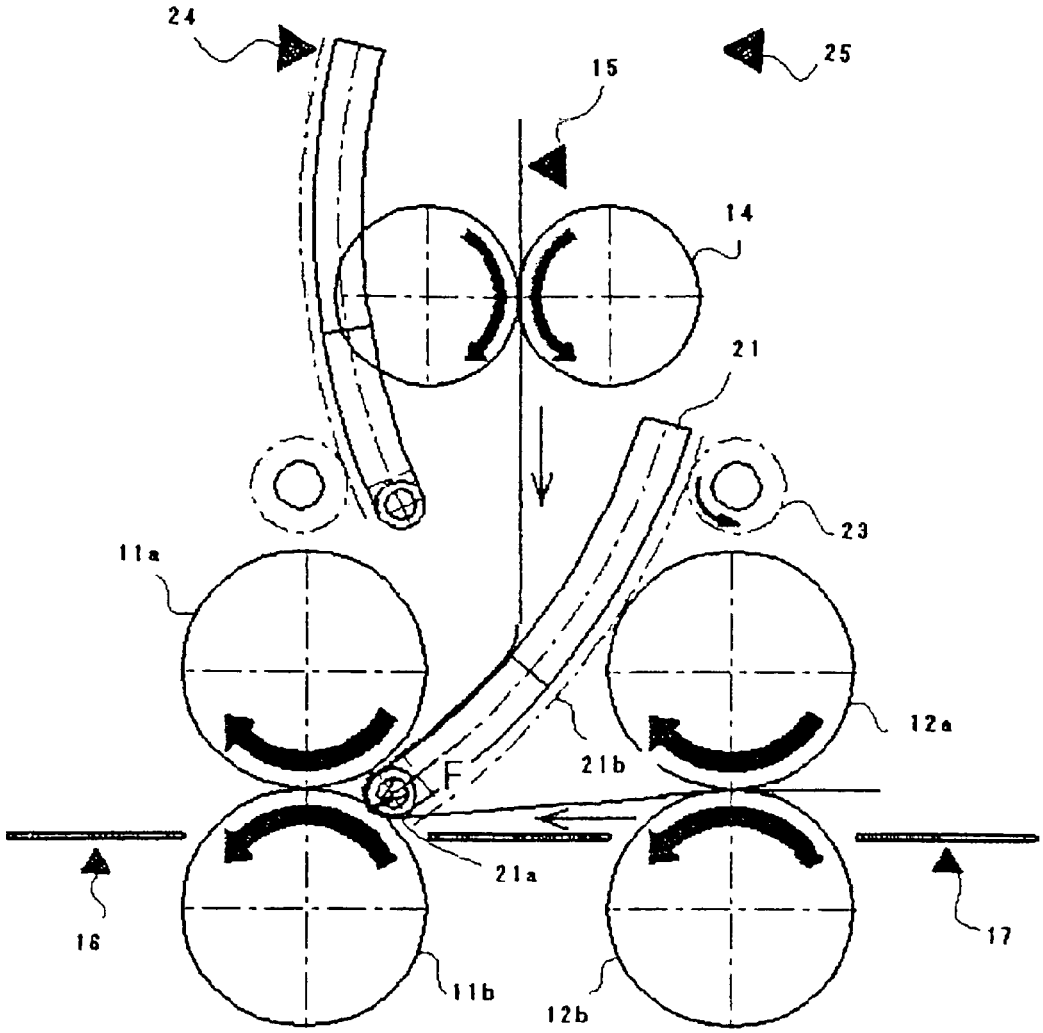

Biasing means 20 and 21 are provided on outer sides of the carry roller pair 14 and switch the guiding of the leading edge of the paper to either the folding roller pair 11 or 12. The biasing means 20 and 21 are each set having a circular arc trajectory so as to contact the lower folding rollers 11*b* and 12*b* and made to carry out an advance-retreat movement along the circular arc trajectory by driving gears 22 and 23. The leading edge of the paper is guided by the biasing means 20 and 21 to approach the folding roller pairs 11 and 12 and enter the nips of the folding roller pairs 11 and 12. At this time, whether the leading edge of the paper enters the nip of the folding roller pair 11 or 12 is selected by which of the biasing means 20 and 21 is moved. In the drawing here, the biasing means 20 that guides to the folding roller pair 12 on the right side is the right biasing means and the biasing means 21 that guides to the folding roller pair 11 on the left side is the left biasing means. Further still, as shown in FIG. 6, at the time of folding paper, the biasing means 20 and 21 are structures that guide the inner side of the paper to the nip of either of the folding roller pairs 11 and 12. At this time, rollers 20*a* and 21*a* constructed at the leading ends of biasing means 20 and 21 come into contact with the lower folding rollers 11*b* and 12*b* respectively. It should be noted that this operation is described separately with reference to the flowcharts of FIGS. 13A to 13E and 14A to 14D.

Figure 9:
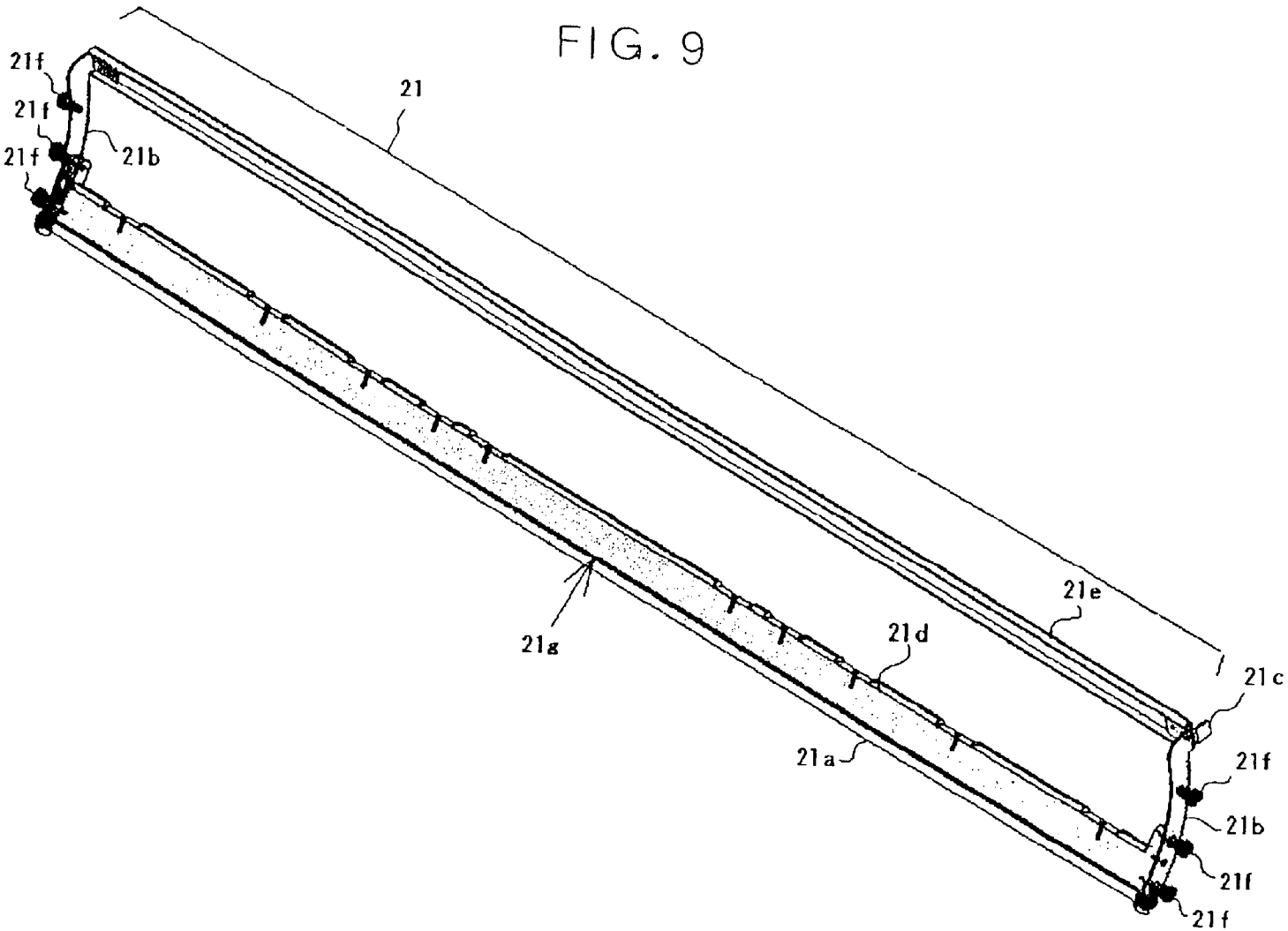
FIG. 9 shows a biasing means configuration according to the first embodiment.

A configuration of the biasing means 20 and 21 is shown in the exploded perspective view of FIG. 9. The biasing means shown in FIG. 9 is the left biasing means 21, but the right biasing means 20 has the same configuration with lateral symmetry. A side plate 21*b* having a gear portion 21*b*' is arranged on both ends of the left biasing means 21, and a guiding plate 21*d* that guides the leading edge of the paper is provided between the side plates 21*b* connecting both side plates 21*b*. Moreover, a stay 21*e* is also provided between the side plates 21*b* supporting the side plates 21*b*. On the stay 21*e*, a light shielding plate 21*c* is provided that shields light of the biasing means home position sensor (hereinafter referred to biasing means HP sensor) 24, 25 of FIG. 4. Furthermore, a roller 21*a* having a width greater than the maximum paper width is provided between the ends of both the side plates 21*b*, and the roller 21*a* is provided with a plurality of bearings not just at both side plates but at a leading edge portion 21*g* of the guiding plate 21*d*, with the roller 21*a* being supported such that the rotation and load of the roller 21*a* is borne and no bending occurs in the roller 21*a*. Here, the leading edge portion 21*g* of the guiding plate 21*d* supports the entire width of the roller 21*a*, but partial support is also possible. Furthermore, the leading edge portion 21*g* is coated with Teflon (registered trademark), but it is also possible to use a resin material having a low coefficient of friction for the guiding plate 21*d* itself. Also, the roller 21*a* may be a pipe material. It should be noted that the right biasing means 20 similarly has a side plate 20*b* and a gear portion 20*b*' is provided in this side plate.

Figure 10:
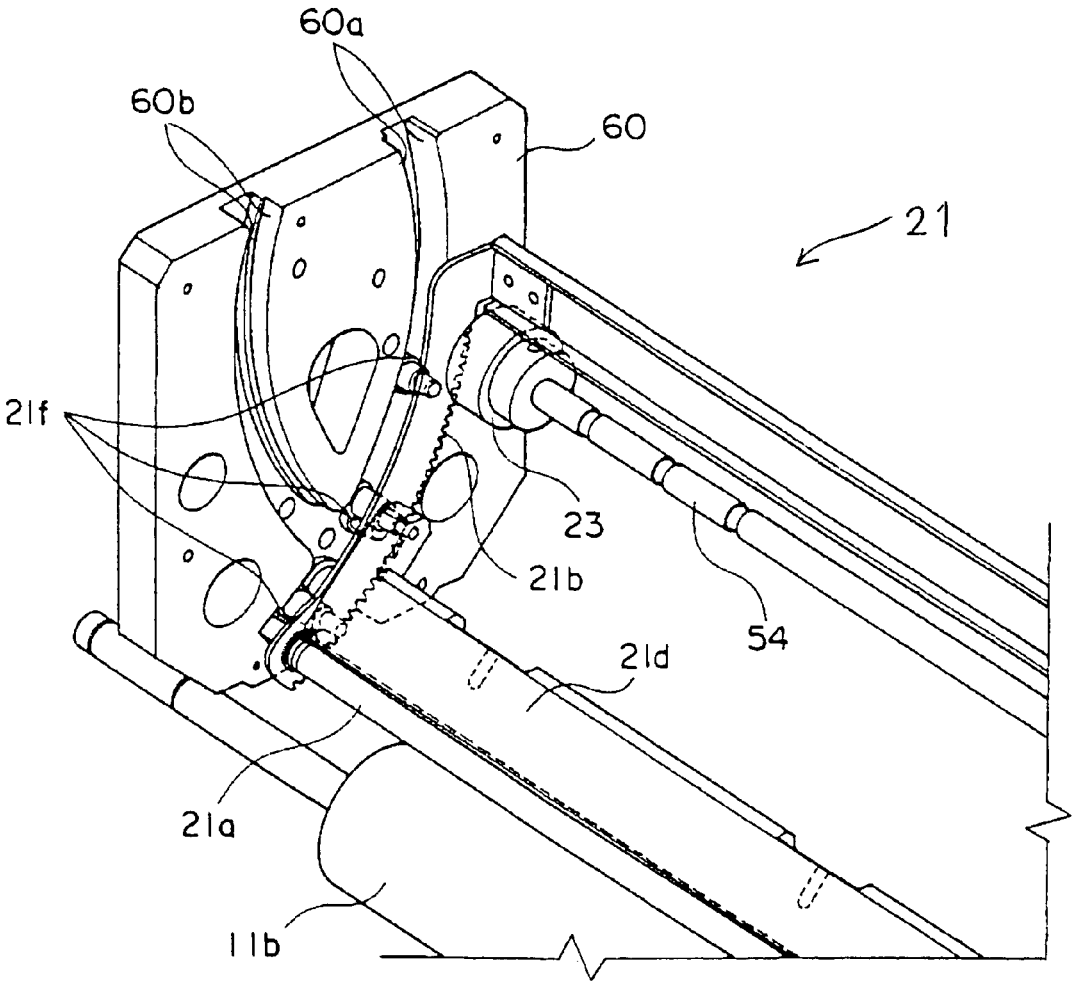
FIG. 10 shows a rail groove structure of the biasing means.

Further still, a plurality of rollers 21*f* are provided protruding at an outer side of both side plates 21*b*. As shown in FIG. 10, a pair of rails 60 is provided on both outer sides of the biasing means 20 and 21 and rail grooves 60*a* and 60*b* are notched into the rails 60 in a circular arc shape so that the biasing means 20 and 21 come in contact with the respective lower folding rollers 11*b* and 12*b*, and rollers 21*f* are movably provided in the rail grooves 60 such that the biasing means 20 and 21 move up and down along a circular trajectory. That is, the rollers 21*f* make contact inside the rail grooves 60*a* and 60*b* and gear portions 20*b*' and 21*b*' of the biasing means 20 and 21 mesh with drive gears 22 and 23, and the biasing means 20 and 21 contact the respective rollers 11*b* and 12*b* and rotate along a circular trajectory so as to separate due to the rollers 21*f* rotating inside the rail grooves 60*a* and 60*b*.

Figure 8:
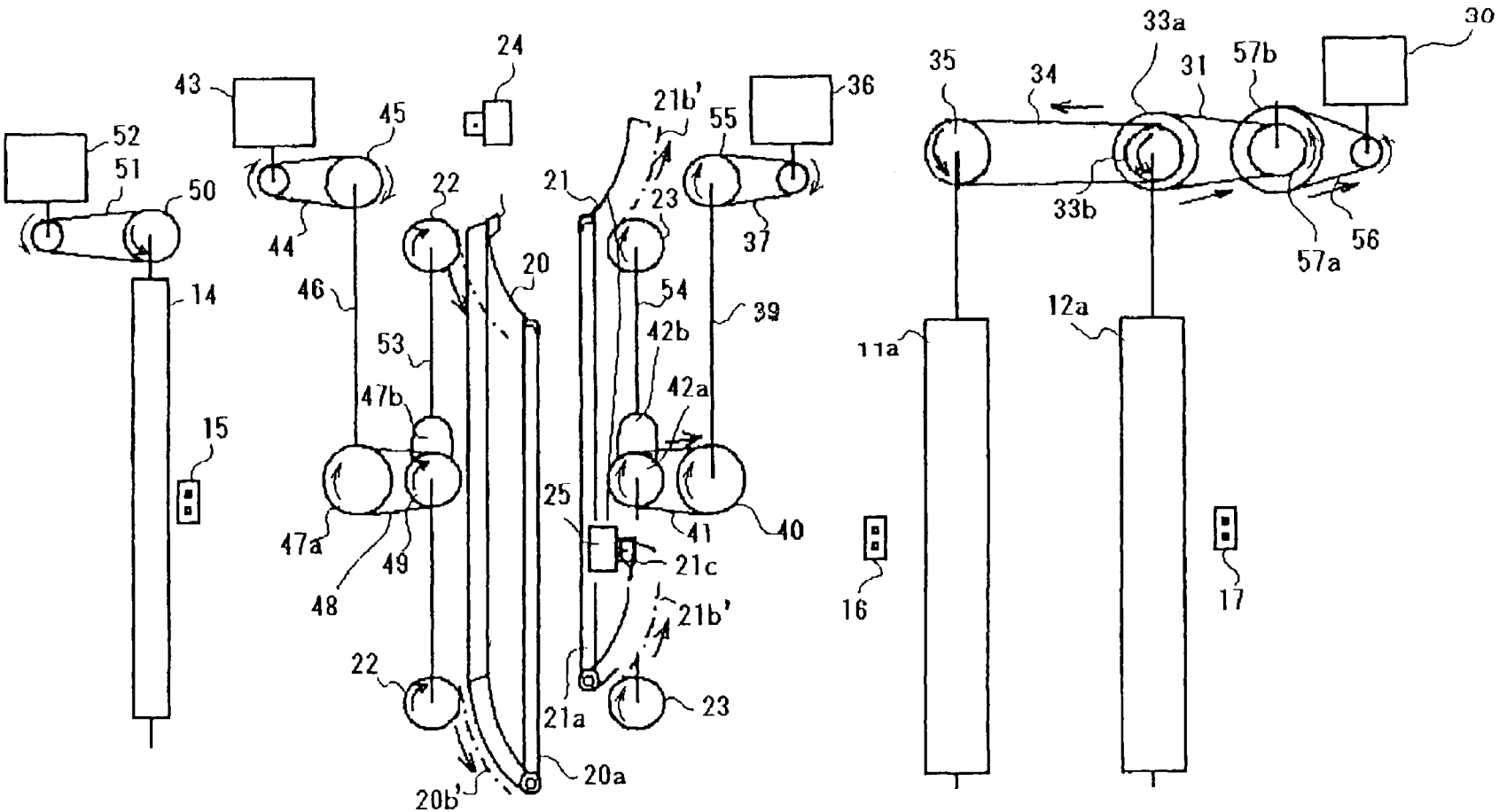
FIG. 8 shows a drive means configuration according to the first embodiment.

The paper folding device 1 according to the present embodiment is provided with a drive means shown in FIG. 8. With this drive means, drive side rollers of a pair of carry rollers 14 transmit the rotation of a carrying motor 52 via a drive belt 51 by a pulley 50 linked to an end portion and rotates in a carrying direction (the arrow direction shown in FIG. 8). Furthermore, a leading edge detection sensor 15 is provided in a central vicinity of the pair of carry rollers 14.

The drive of the biasing means 20 and 21 has the same configuration in lateral symmetry and therefore the left biasing means 21 is used here for description. First, the drive gear 23 meshes with the gear portions 21*b*' at both ends of the left biasing means 21. Both ends of the drive gear 23 are driven fastened onto a same single drive shaft 54, and therefore the left biasing means 21 moves parallel to the same drive shaft 54 by the amount by which the drive shaft 54 rotates. The drive shaft 54 is linked with a driven pulley 42*a* via a torque limiter 42*b*, and the driven pulley 42*a* and the drive pulley 40 are linked and driven by the drive belt 41. Further still, the drive pulley 40 and the drive pulley 55 on a same shaft 39 are linked to a biasing means left motor 36 via the drive belt 37. Accordingly, when the biasing means left motor 36 rotates in the arrow direction, the left biasing means 21 moves in the arrow direction. At that time, if a load greater than the rotation load torque of the torque limiter 42*b* is applied to the left biasing means 21, sliding occurs while torque is produced between the torque limiter 42*b* and the driven pulley 42*a*. Further still, the light shielding plate 21*c* is arranged at an end portion of the biasing means 21, and the biasing means left HP sensor 25 blocks the light at a position where the biasing means 21 is at standby to rise, and the standby position is detected in this manner. It should be noted that the right biasing means 20 has the same configuration and the rotation direction of when the right biasing means 20 is descending is shown in FIG. 8. However, with the right biasing means 20, the numeral 43 is a biasing means right motor, the numeral 44 is a drive belt, the numeral 45 is a drive pulley, the numeral 46 is a shaft, the numeral 47*a* is a drive pulley, the numeral 49 is a driven pulley, the numeral 48 is a drive belt, the numeral 47*b* is a torque limiter, and the numeral 53 is a drive shaft, and the right biasing means 20 is driven in the same manner as the left biasing means 21 via the drive gear 22.

The folding roller pairs 11 and 12 are driven as follows. Namely, a folding roller drive pulley 35 is linked to an end portion of the upper folding roller 11*a* and a folding roller drive pulley 33*b* is linked to an end portion of the upper roller 12*a*, and the folding roller drive pulley 35 and the folding roller drive pulley 33*b* are linked by a drive belt 34. Further still, a pulley 33*a* that is integrated with the folding roller drive pulley 33*b* is linked to a driven pulley 57*a* via the drive belt 31 and, moreover, a driven pulley 57*b* that is integrated with the driven pulley 57*a* is linked with a drive pulley on the folding motor 30 side via the drive belt 56. Accordingly, when the folding motor 30 rotates in the arrow direction of the diagram, the upper folding rollers 11*a* and 12*a* rotate in synchronization in the arrow direction. Further still, due to an unshown drive belt linking the upper folding rollers 11*a* and 12*a* and the lower folding rollers 11*b* and 12*b*, when the folding motor 30 rotates the folding roller pairs 11 and 12 rotate in the carrying direction with the upper and lower folding rollers 11*a*, 12*a*, 11*b*, and 12*b* in synchronization. Further still, a folding width right sensor 17 and a folding width left sensor 16 are arranged respectively in outer side central vicinities of the folding roller pairs 11 and 12.

Figure 11:
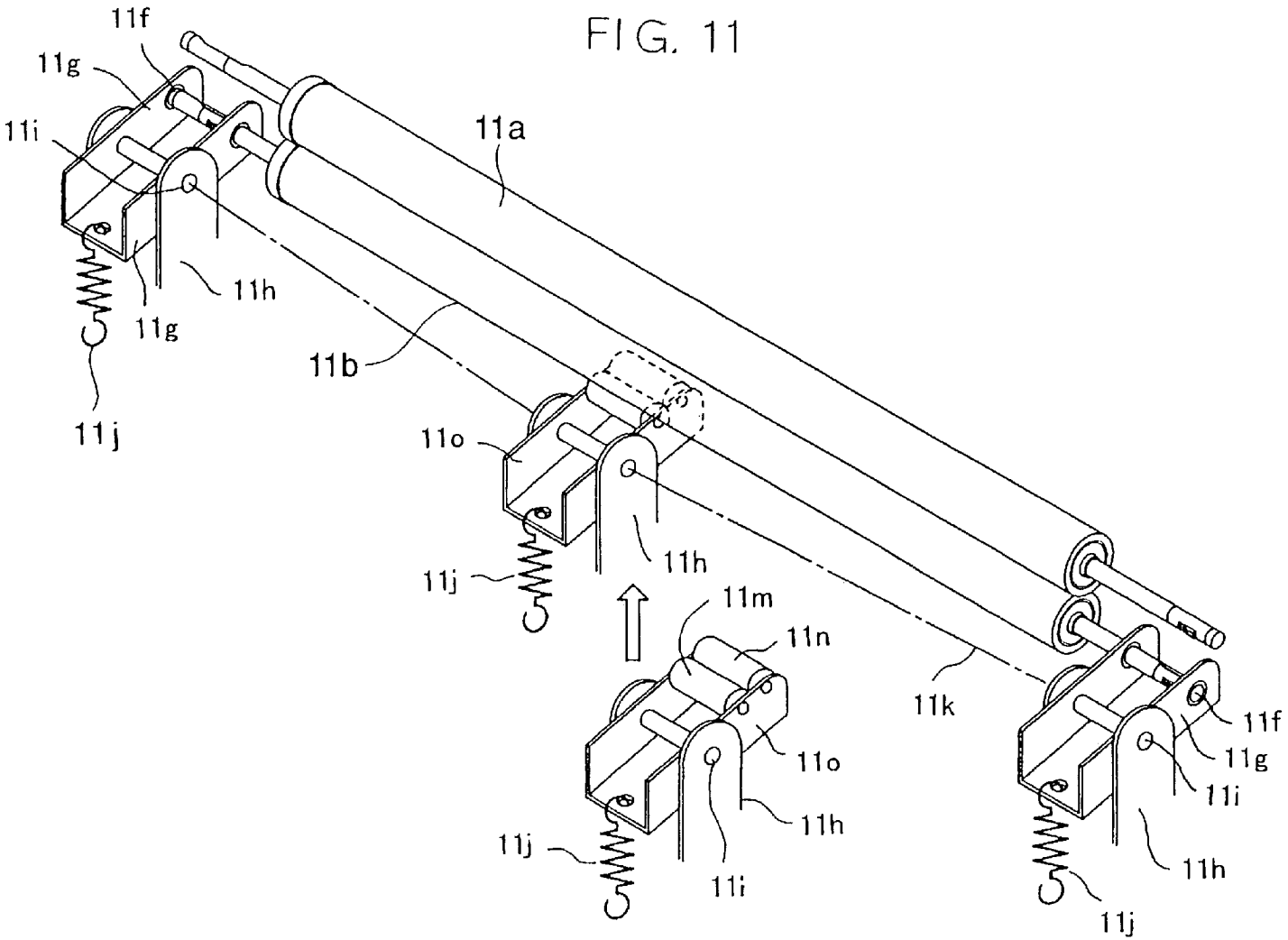
FIG. 11 is a perspective view showing a pressure applying mechanism of a central portion of the folding rollers.

FIG. 11 is a perspective view showing a pressurized structure of a central portion of the folding rollers 11 and 12. As shown in this diagram, with the folding roller pair 11*a* and 11*b*, the upper side folding roller 11*a* is fixed and the lower side folding roller 11*b* is supported by end levers 11*g* through bearings 11*f* at either end. The end levers 11*g* are oscillatably supported centered on a fulcrum shaft 11*i* of a pair of support plates 11*h* and tension springs 11*j* are latched to end portions positioned on opposite sides from the bearings 11*f* with respect to the fulcrum shaft 11*i* such that the end portions of the end levers 11*g* are elastically biased downward. Due to an effect of the end levers 11*g* and the tension springs, the lower side folding roller 11*b* is elastically biased to the upper side folding roller 11*a*. In this way, the lower side folding roller 11*b* is subjected to pressure at both end portions with respect to the upper side folding roller 11*a*.

Applying an elastic bias in this manner is sufficient, but when the folding rollers 11*a* and 11*b* are thin, and in particular when the shaft member is thin, it is conceivable that the suppressive force at the central area is insufficient due to flexing. When this is a concern, a central lever 11*o*, which is constructed on a fulcrum shaft center on a same axis line as a fulcrum shaft center 11*k* of the support plates 11*h* and that has a pair of rollers 11*m* and 11*n* parallel to the fulcrum shaft center 11*k*, is provided below a central vicinity of the roller 11*b*. In this case, the roller 11*b* is rotatably supported by the pair of rollers 11*m* and 11*n*, and the roller 11*b* applies pressure to a center of the roller 11*a* due to a spring 11*j* in the same manner as the end levers 11*g*. The same property is provided to three springs 11*j*. In this way, the flexure of the folding roller pair 11*a* and 11*b* can be made uniform and the evenness of the nip between these two members can be improved. As a result, occurrences of wrinkling on the paper due to folding can be kept to a minimum.

Furthermore, in FIG. 11, description was given regarding the left side folding roller pair 11*a* and 11*b*, but it should be emphasized that the same is true regarding the right side folding roller pair 12*a* and 12*b*.

Figure 12:
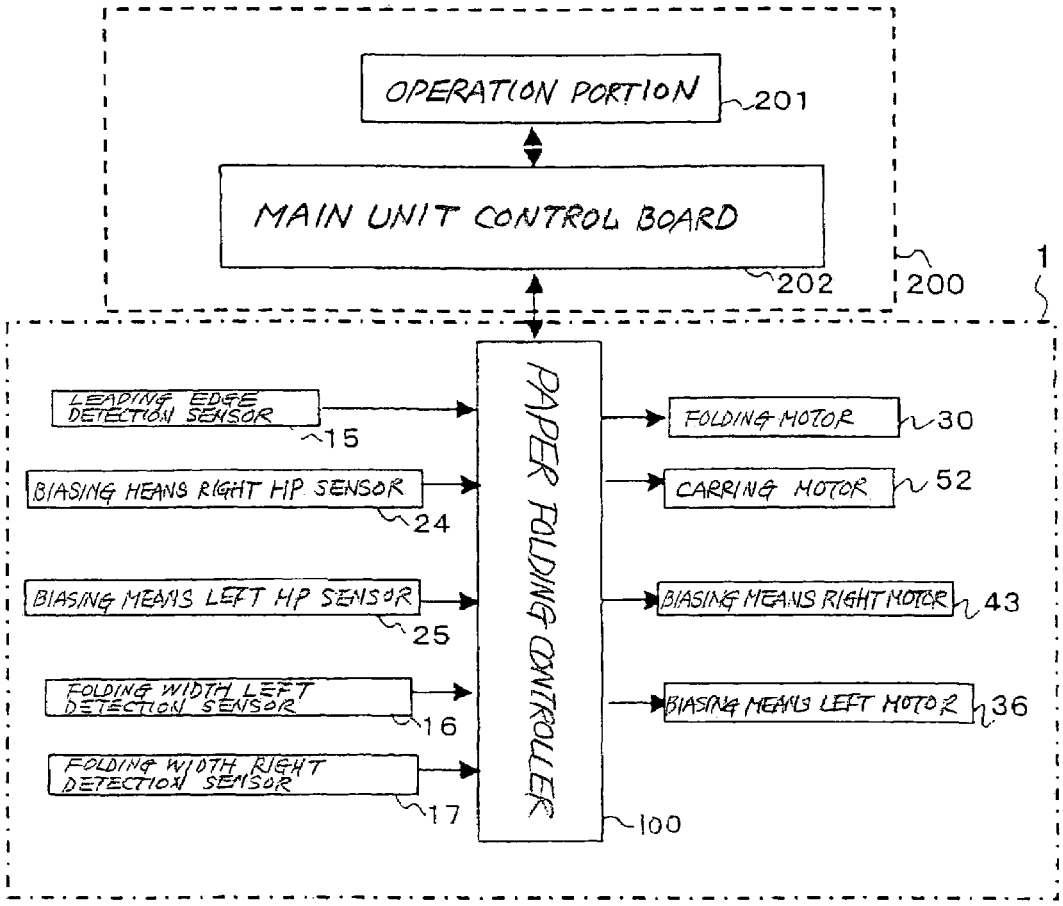
FIG. 12 is a block diagram showing a configuration of a control system according to the first embodiment.
Figure 13A:
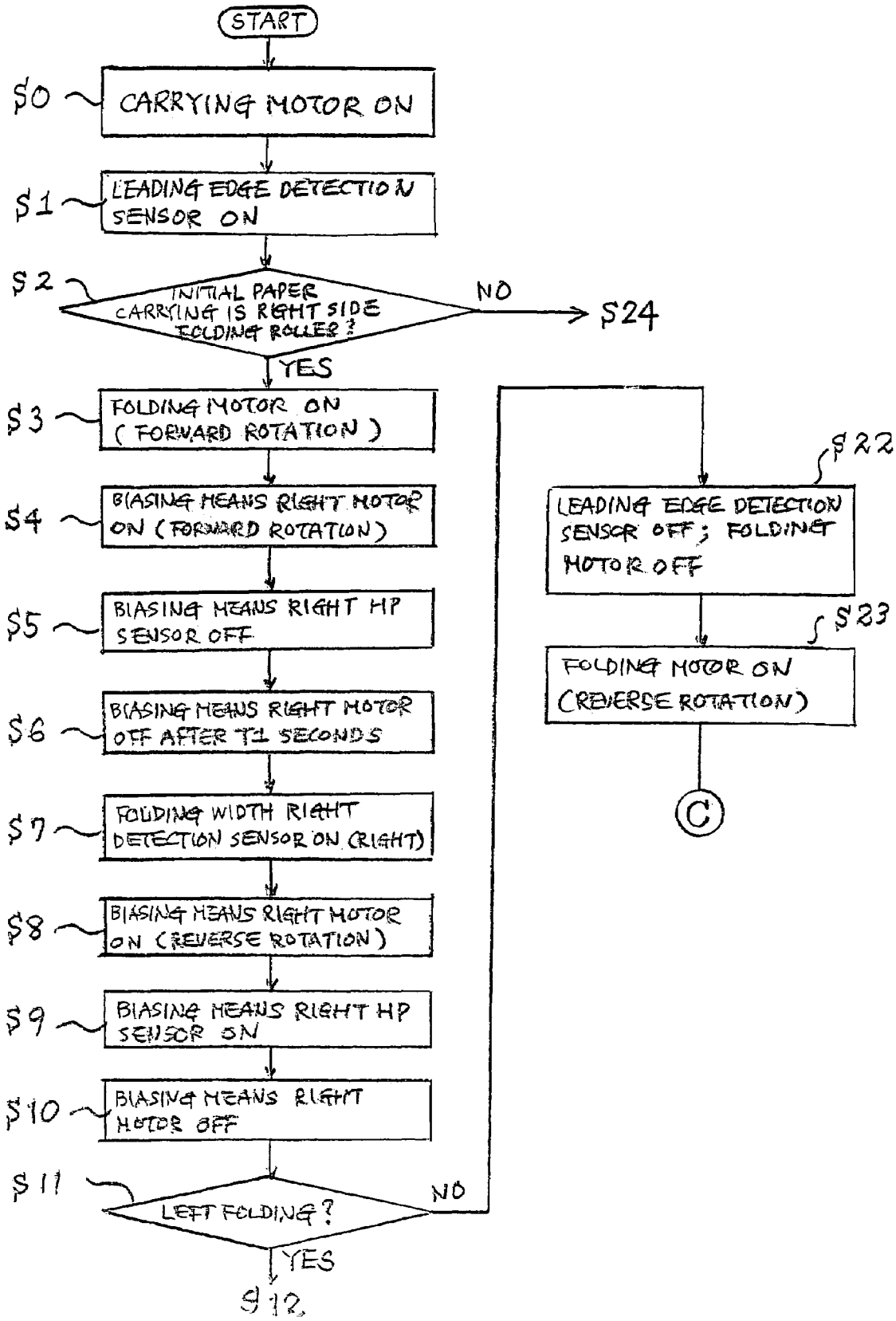
FIGS. 13A to 13D and 14A to 14D are flowcharts showing a processing procedure according to the first embodiment.
Figure 13B:
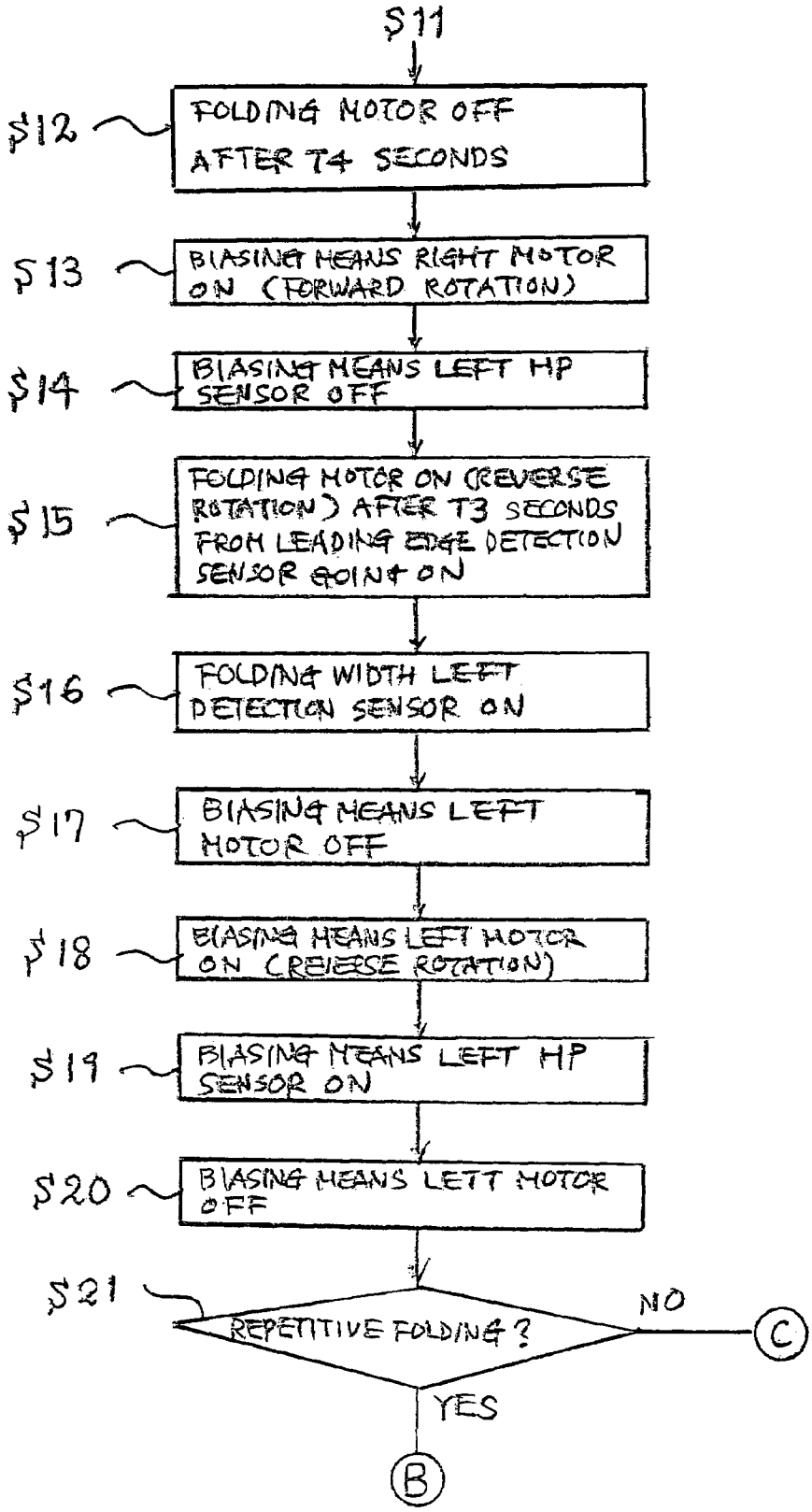
Figure 13C:
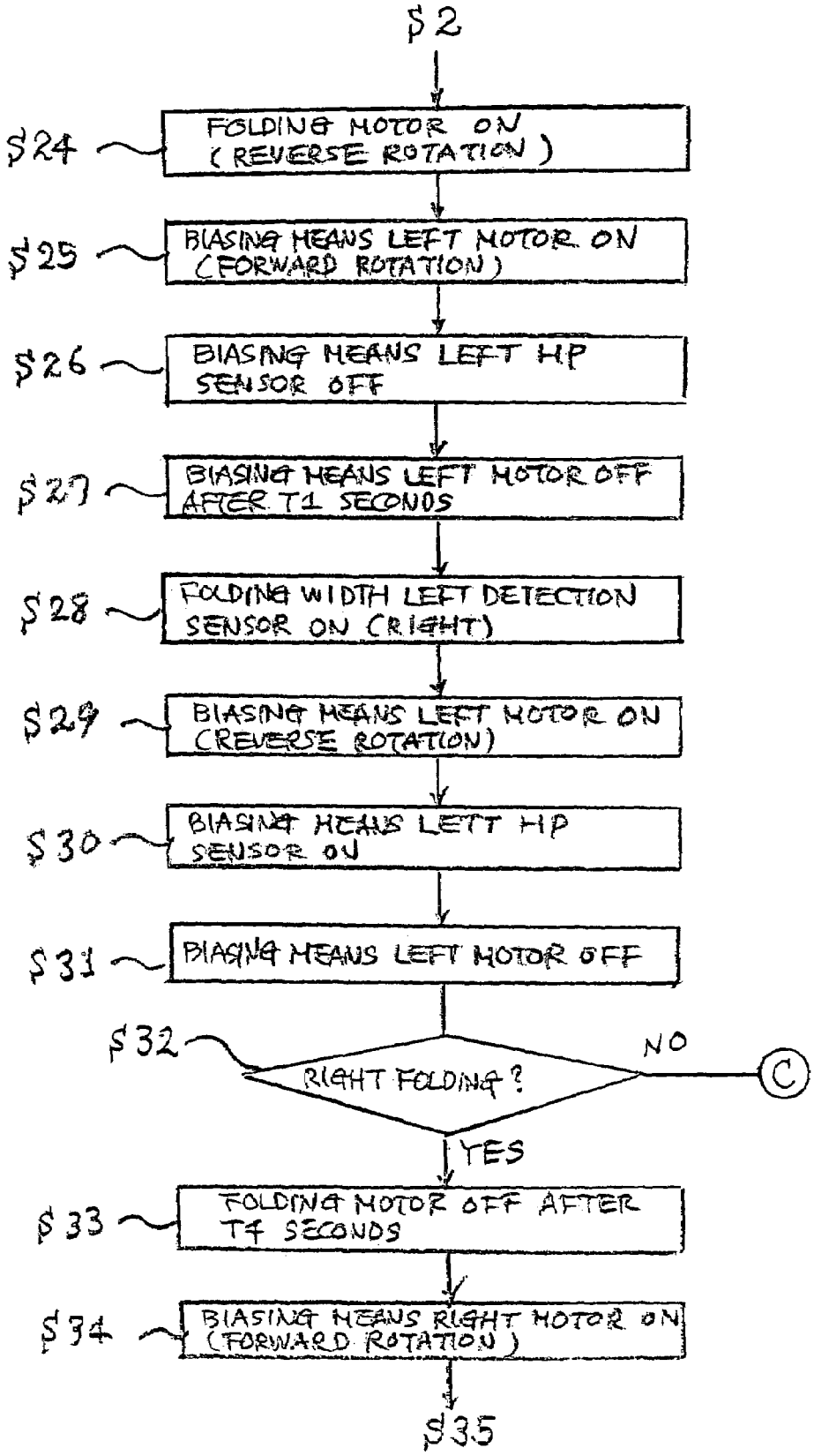
Figure 13D:
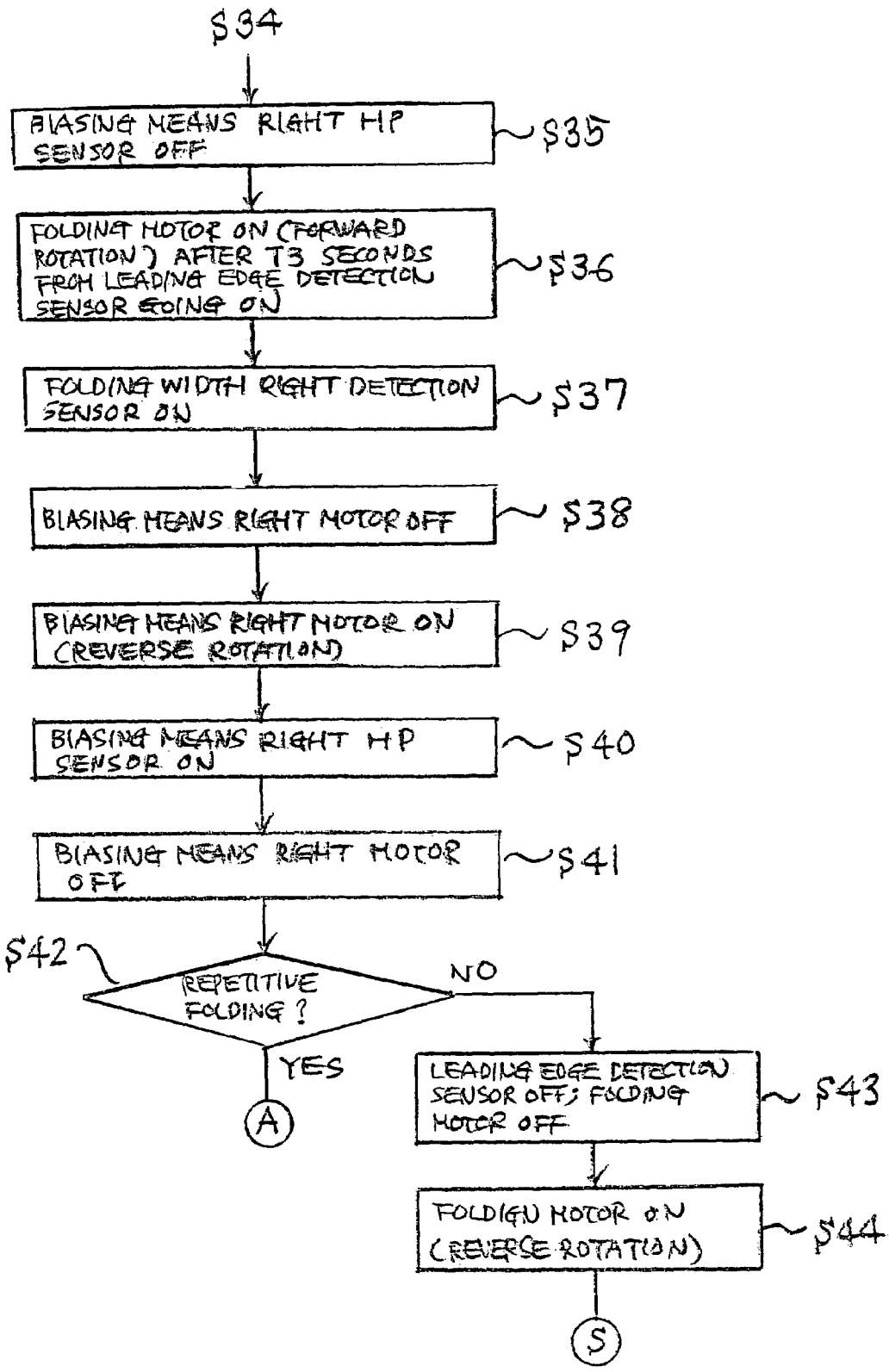
Figure 14A:
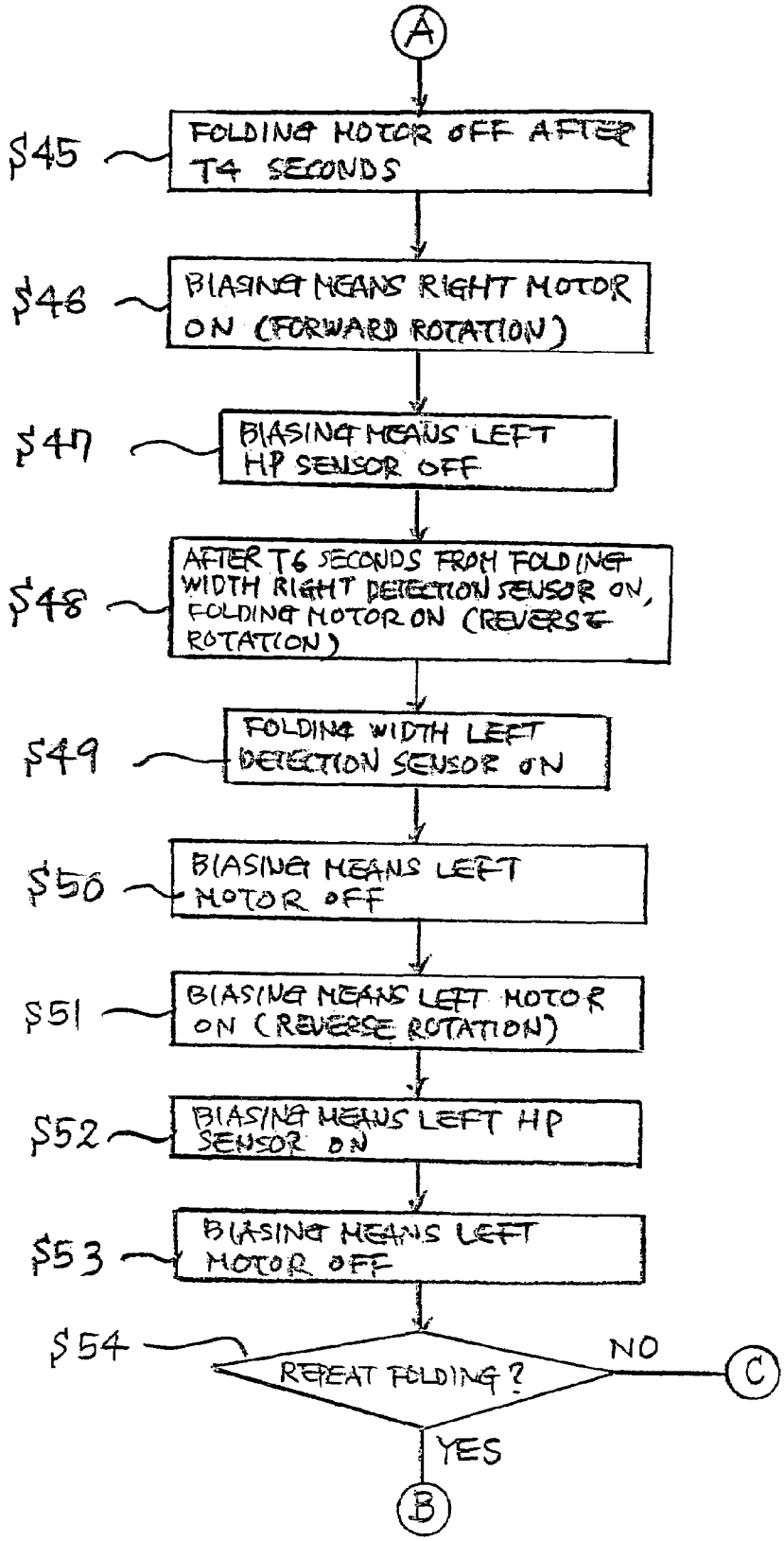
Figure 14B:
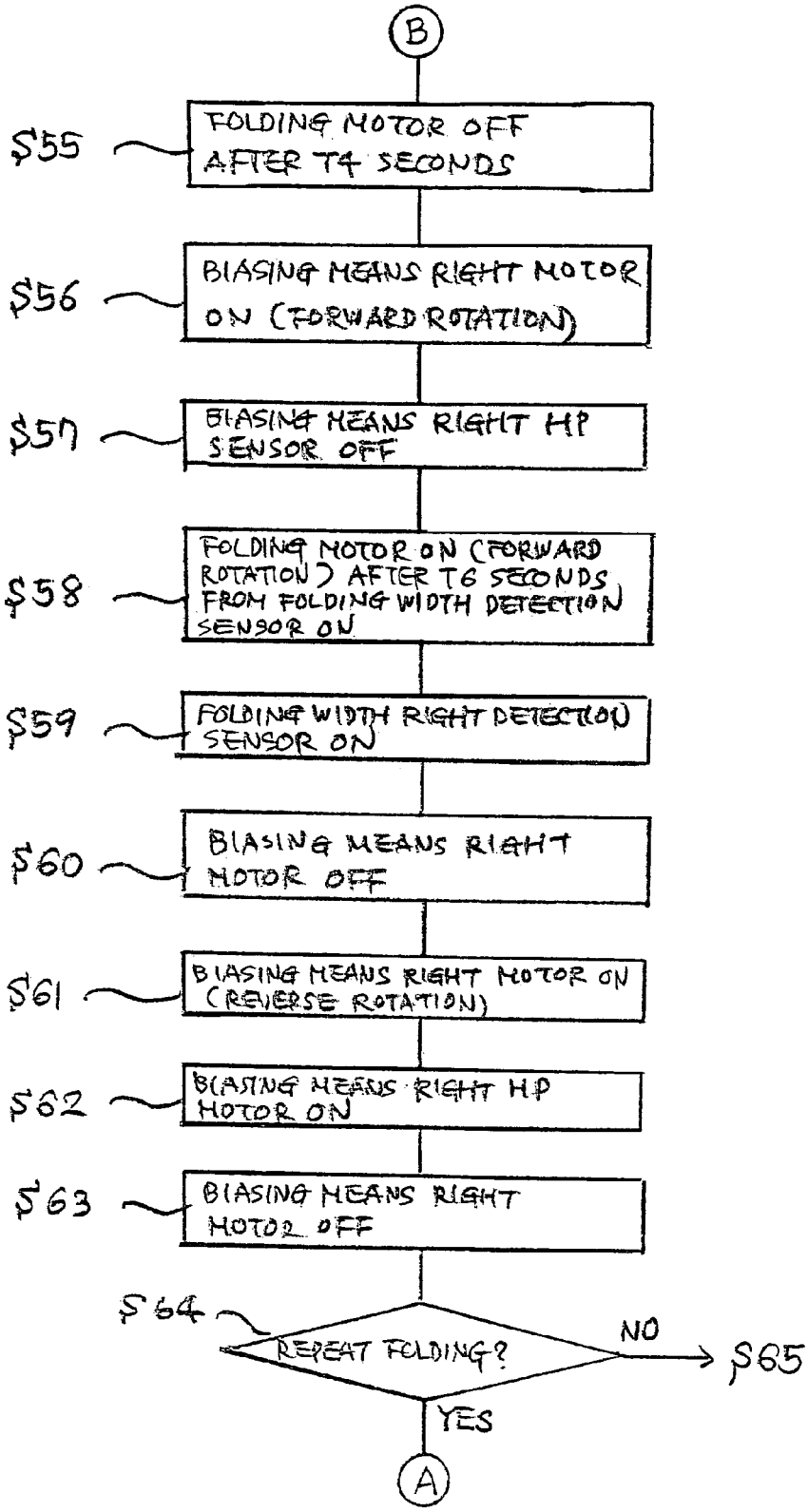
Figure 14C:
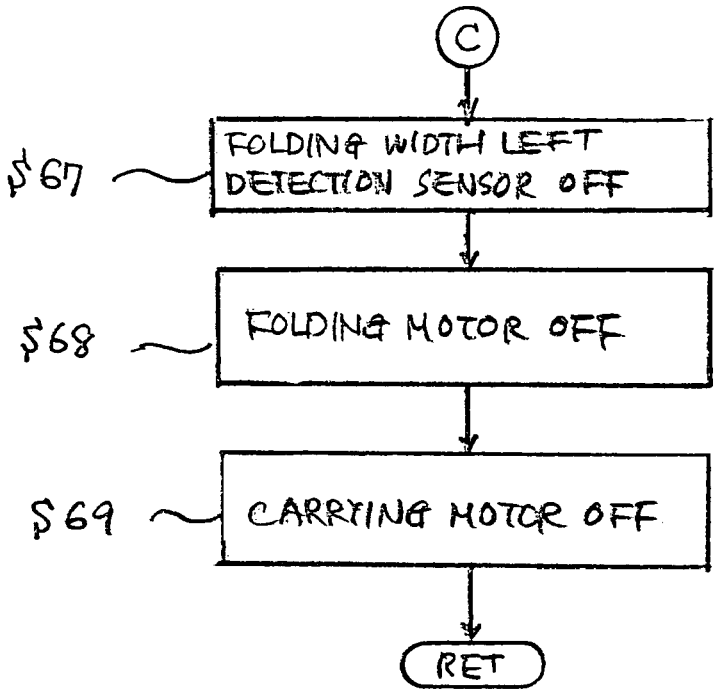
Figure 14D:
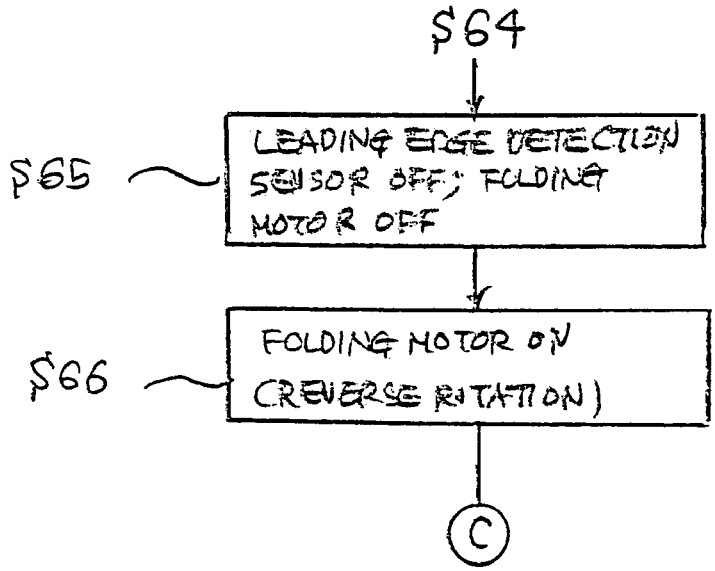

FIG. 12 is a block diagram showing an outline of a control circuit. A control portion of the copying machine main unit 200 is constituted by an operation portion 201 and a main unit control board 202, and the control portion of the paper folding device 1 is constituted by a paper folding controller 100, sensors such as a leading edge detection sensor 15, a biasing means right HP sensor 24, a biasing means left HP sensor 25, a folding width left detection sensor 16, and a folding width right detection sensor 17, and various drive portions such as a folding motor 30, a carrying motor 52, a biasing means right motor 43, and a biasing means left motor 36. The paper folding controller 100 drive controls the motors 30, 52, 43, and 36, and the main unit control board 202 receives input signals such as the folding type and size from operation portion 201 of the main unit, and the paper folding controller 100 controls the folding motor 30, the carrying motor 52, the biasing means right motor 43, and the biasing means left motor 36 based on the information received from the main unit control board and sensor information from sensors such as the leading edge detection sensor 15, a biasing means right HP sensor 24, a biasing means Left HP sensor 25, a folding width left detection sensor 16, and a folding width right detection sensor 17 so that predetermined folding is executed on the paper.

A chain folding operations of the paper folding device is described with reference to the flowcharts of FIGS. 13A to 13D and 14A to 14D. The processes shown in these flowcharts are executed by an unshown CPU of the paper folding controller 100 using an unshown RAM as a work area to run a program stored in an unshown ROM. Detailed description follows.

First, when a signal is inputted from the main unit control portion 201 shown in FIG. 12, the signal is sent to the paper folding controller 100 via the main unit control board 202. In this way, the flowchart of FIGS. 13A to 13D starts at the paper folding device 1 side, the carrying motor 52 of FIG. 8 goes ON, and the carry roller pair 14 of FIG. 4 begins to rotate in the arrow direction (step S0). Next, paper is sent from the copying machine main unit 200, the leading edge of the paper passes the leading edge detection sensor 15, and an ON signal of the leading edge detection sensor 15 is inputted to the controller 100 (step S1). Following this, a determination is made as to whether or not the initial paper carrying according to the paper folding type signal inputted from the main unit control portion 201 of FIG. 12 is a paper folding type in which the paper enters the right side folding rollers 12 (step S2). Description here concerns when the paper folding type signal is a paper folding type in which the initial paper carrying involves entering the right side folding rollers 12. Following this, the folding motor 30 of FIG. 8 turns ON and commences to rotate (here this is forward rotation) (step S3), the biasing means right motor 43 of FIG. 8 turns ON, and right biasing means 20 of FIG. 4 commences to move from the solid line position toward the dashed line position (the rotation direction is forward at this time) (step S4).

At this time, the biasing means right HP sensor 24 goes OFF (step S5) and, after a drive time T1 in which the right biasing means 20 reaches the dashed line position from the solid line position, the biasing means right motor 43 goes OFF (step S6). At this time, as shown in FIG. 4, the roller 20*a* of the leading edge of the right biasing means 20 and the lower folding roller 12*b* do not contact and the right biasing means 20 is made to stop in a state with a slight gap therebetween. In this state, the leading edge of the paper P enters the nip of the right side folding roller pair 12 as shown in FIG. 4 and the folding width right detection sensor 17 goes on (step S7). After this, in order to return the right biasing means 20 to the standby position, the biasing means right motor 43 goes ON in the reverse rotation direction (step S8), the biasing means right HP sensor 24 goes ON (step S9), the biasing means right motor 43 goes OFF (step S10), and the right biasing means 20 returns to a standby state at the solid line position.

Figure 5:
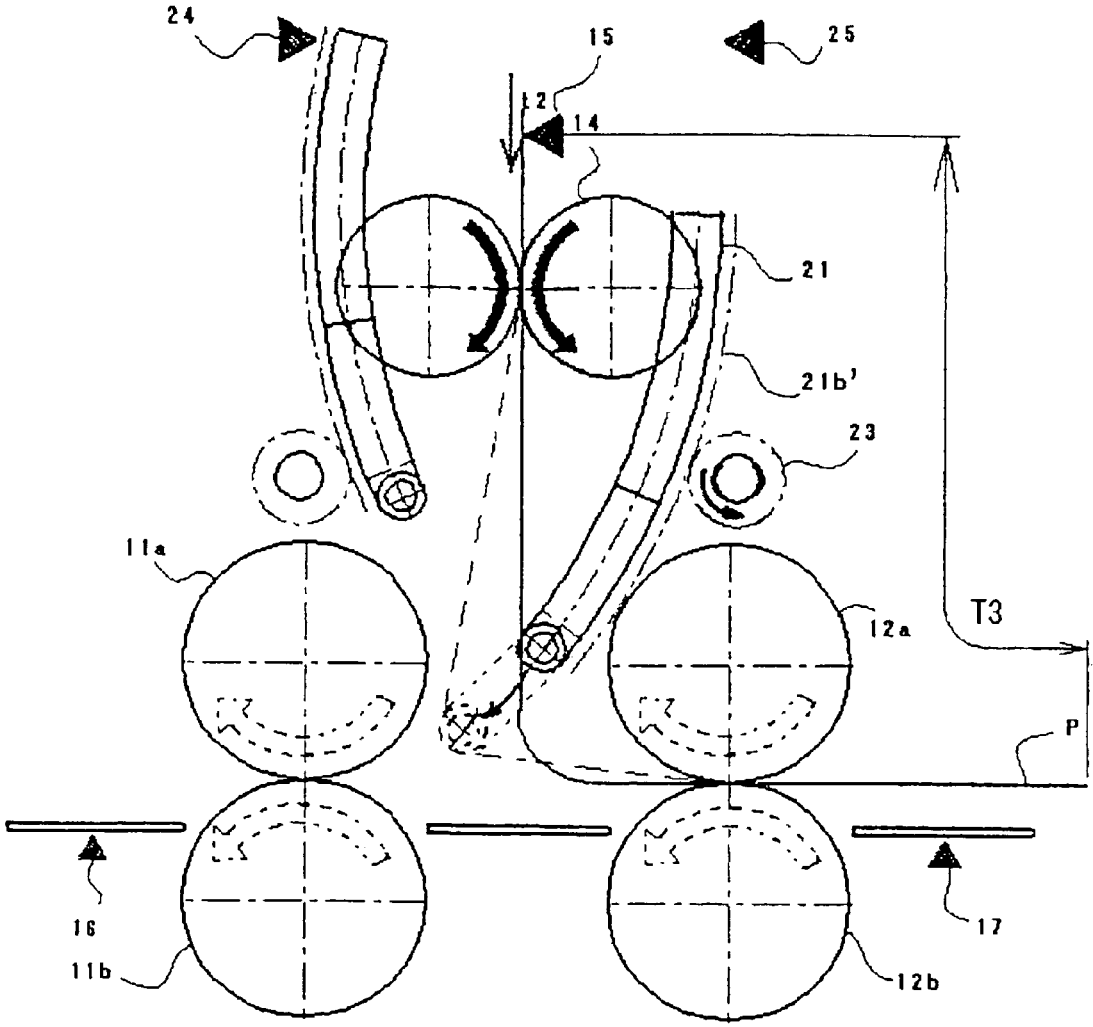

Next, after the leading edge of the paper enters the right side folding roller pair 12, a determination is carried out as to whether or not there is a next folding (step S11), and if there is a next folding, after T4 seconds from the folding width right detection sensor 17 going ON, the folding motor 30 goes OFF and stops (step S12), and this time, in order to guide the inner side of the paper to the nip of the left folding roller pair 11, the biasing means right motor 36 of FIG. 8 goes ON, and the left biasing means 21 of FIG. 5 commences moving in the arrow direction (the rotation direction at this time is forward) (step S13). At this time the biasing means left HP sensor 25 goes OFF (step S14).

At the same time as the operation of the left biasing means 21 and after T3 seconds from the leading edge detection sensor 15 going ON as shown in FIG. 5, the folding motor 30 goes ON in the reverse rotation direction (step S15). At this time, the movement speed of the left biasing means 21 is set faster than the speed at which the paper slackens, and therefore the paper loses slackness as shown by the dashed line in FIG. 5, and the paper and the roller 21*a* of the leading edge of the left biasing means 21 come in contact. At this time, the movement speed of the left biasing means 21 becomes unable to move faster than the speed at which the paper slackens, and therefore a load is applied to the torque limiter 42*b* of FIG. 8, and sliding commences while torque is produced between the torque limiter 42*b* and the drive pulley 42*a*. Consequently, the roller 21*a* of the leading edge of the left biasing means 21 apples tension to the paper proportional to the idle torque of the torque limiter 42*b*, the paper moves while maintaining a tensioned state, and the roller 21*a* of the leading edge of the left biasing means 21 is brought in contact with the left side lower folding roller 11*b* as shown in FIG. 6.

Figure 15:
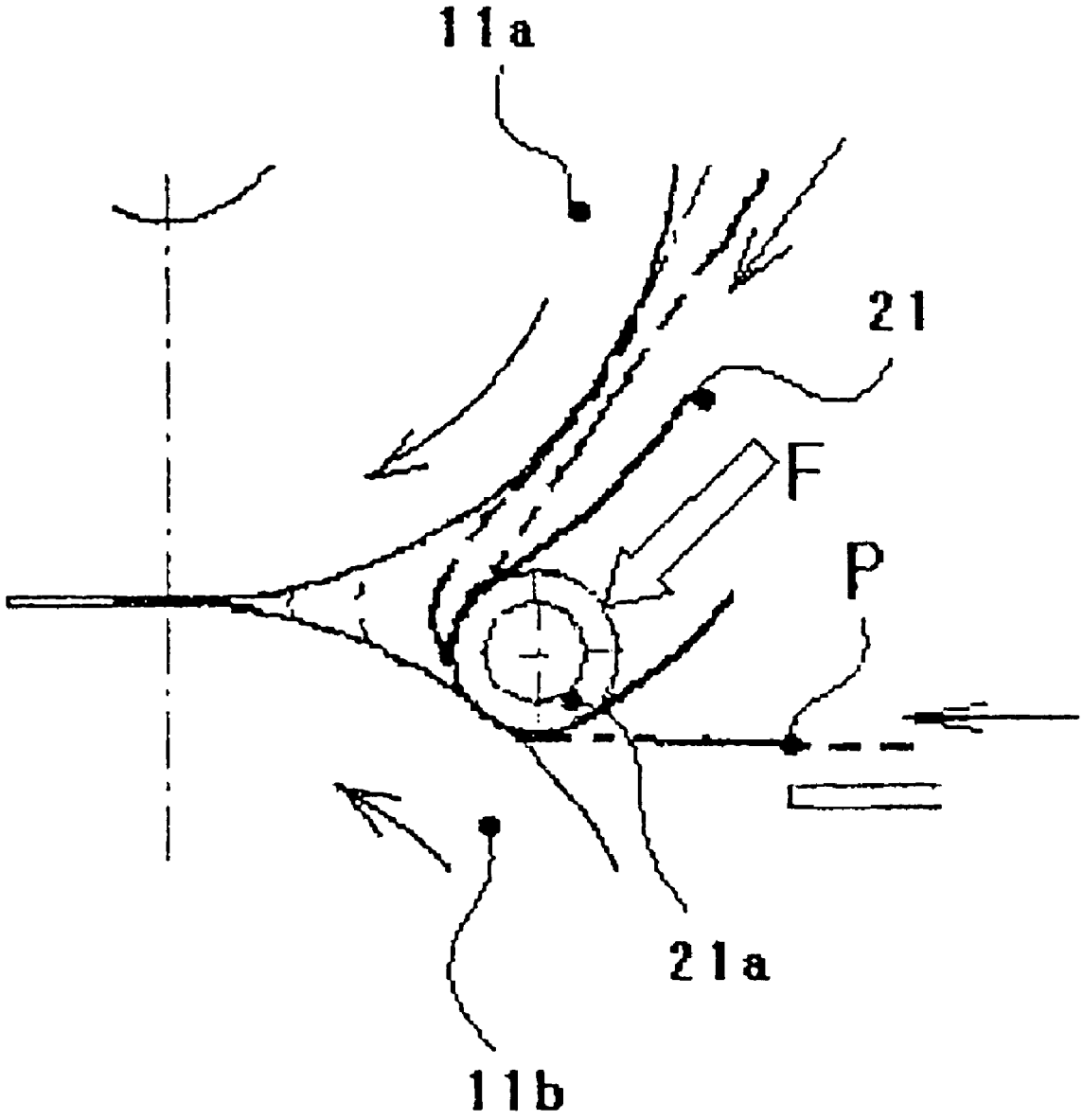
FIGS. 15 to 17 are diagrams for describing operations of the folding rollers according to the first embodiment.

Further still, a pressure F of the idle torque of the torque limiter 42*b* is applied to the leading edge roller 21*a* and the lower folding roller 11*b* as shown in FIG. 15, the paper P is made to further slacken as shown by the dashed line to create a loop, the peak of the loop is gripped in the nip of the left folding roller pair 11 rotating in the arrow direction as shown in FIG. 15, and the paper is folded on the left side. The paper continues to be fed further such that the leading edge of the folded paper reaches the folding width left sensor 16 and the folding width left sensor 16 goes ON (step S16). After this, in order to return the left biasing means 21 to a standby state, the biasing means right motor 36 is stopped (step S17) and then turned ON in the reverse rotation direction (step S18), the biasing means left HP sensor 25 goes ON (step S19) the biasing means left motor 43 goes OFF (S20) to return the left biasing means 21 to the standby state of the solid line position of FIG. 4, thereby completing the first fold.

On the other hand, when there is no fold at the determination of whether or not there is a next fold at step S11, the paper discharge direction is on the left folding roller pair side, and therefore discharge occurs after performing a switchback once, and when the paper trailing edge passes the leading edge detection sensor 15 in a state in which the right folding roller pair 12 carries the paper and the leading edge detection sensor 15 goes OFF, the folding motor 30 stops (step S22), and this time a discharge operation flow C commences in which the folding motor 30 performs reverse rotation (step S23) and the paper trailing edge is carried toward the right folding roller pair 11.

Furthermore, when the determination of whether or not there is a paper folding type in which the initial paper carrying of step S2 involves entering the right side folding rollers 12 is that the paper folding type involves entering the left side folding rollers 11, steps S24 through S42 are carried out in the same manner as steps S3 through S21 with a laterally reverse difference from the case in which the paper enters the right side folding rollers 12. However, when the determination as to whether or not there is a next fold at step S32 is that there is no fold, the paper discharge direction is on the side of the left folding roller pair 11 such that there is no need to perform a switchback before discharging, and therefore the procedure commences the discharge operation flow C at that point.

Here, a determination is carried out as to whether or not there is a repeat fold (steps S21 and S42), and when there is a repeat fold when the first fold is on the left side, a flow B commences involving a right side repeat fold, and when there is no repeat fold, there is no need to perform a switchback before discharging, and therefore the procedure commences the discharge operation flow C at that point.

Furthermore, when there is a repeat fold when the first fold is on the right side, a flow A commences involving a right side repeat fold, and when there is no repeat fold it is necessary to perform a switchback once before discharging, and therefore when the paper trailing edge passes the leading edge detection sensor 15 in a state in which the right folding roller pair 12 carries the paper and the sensor goes OFF, the folding motor 30 goes OFF and stops (step S43), and this time the discharge operation flow C commences in which the folding motor 30 performs reverse rotation (step S44) and the paper trailing edge is carried toward the right folding roller pair 11.

Figure 7:
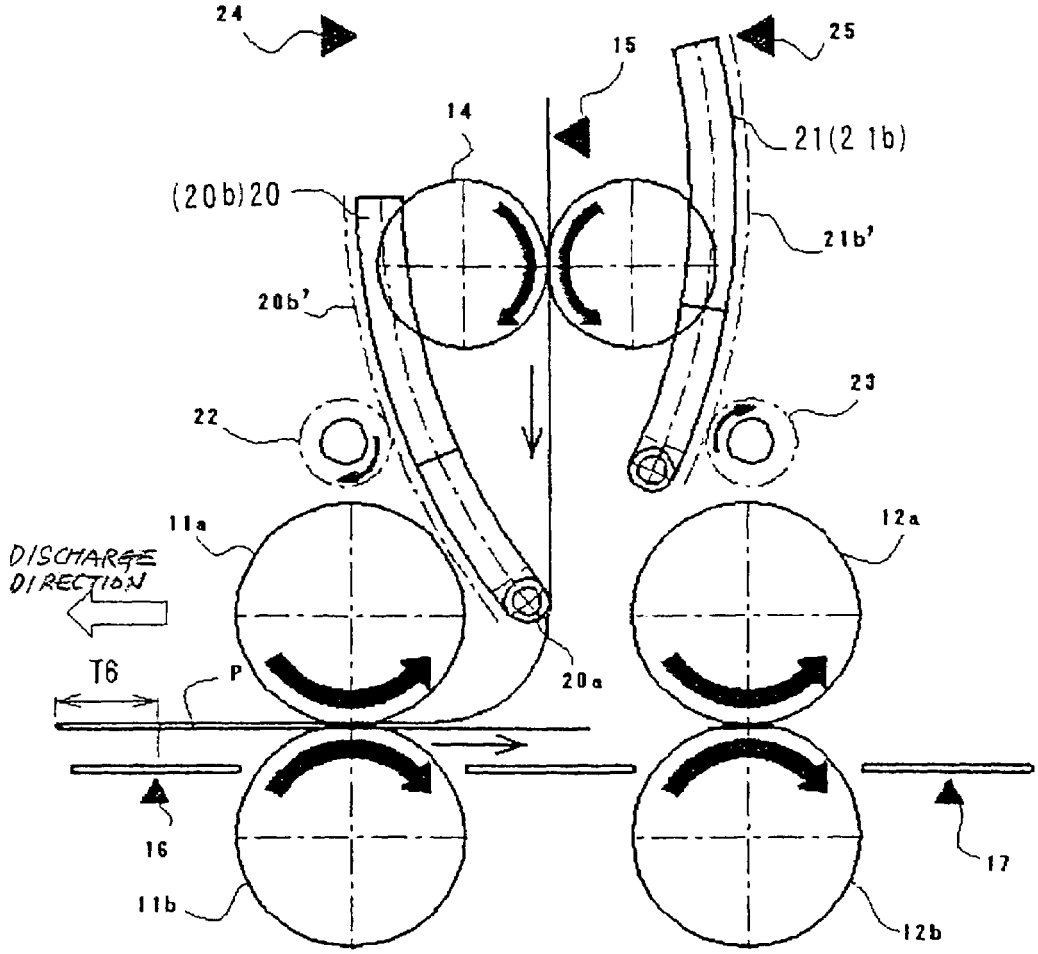

Next, in the case of repeat fold flows A and B, the left fold flow A is almost identical to the first fold steps S12 to S21, and the timing for causing reverse rotation of the folding motor 30 at step S48 in the case of repeat folding is T6 seconds after the folding width right detection sensor 17 goes ON (see FIG. 7).

Similarly, the right folding flow B is almost identical to the first fold steps S33 to S42, and the timing for causing forward rotation of the folding motor 30 at step S58 in the case of repeat folding is T6 seconds after the folding width right detection sensor 16 goes ON. After this, when there is further repeat folds, the flows A and B are repeated, and when the final fold is on the right side, the paper discharge direction is on the side of the left folding roller pair, and therefore a switchback is performed once before discharging, and when the paper trailing edge passes the leading edge detection sensor 15 in a state in which the right folding roller pair 12 carries the paper and the leading edge detection sensor 15 goes OFF, the folding motor 30 stops (step S65). Then this time a discharge operation flow C commences in which the folding motor 30 performs reverse rotation (step S66) and the paper trailing edge is carried toward the left folding roller pair 11. When the final fold is on the left side, the procedure commences the discharge operation flow C at that point.

Finally, in the discharge operation flow C, after the paper trailing edge passes the folding width detection sensor 16 and the folding width detection sensor 16 goes OFF (step S67), the folding motor 30 is stopped (step S68), the carrying motor 52 is stopped (step S69) and discharge is completed.

Figure 16:
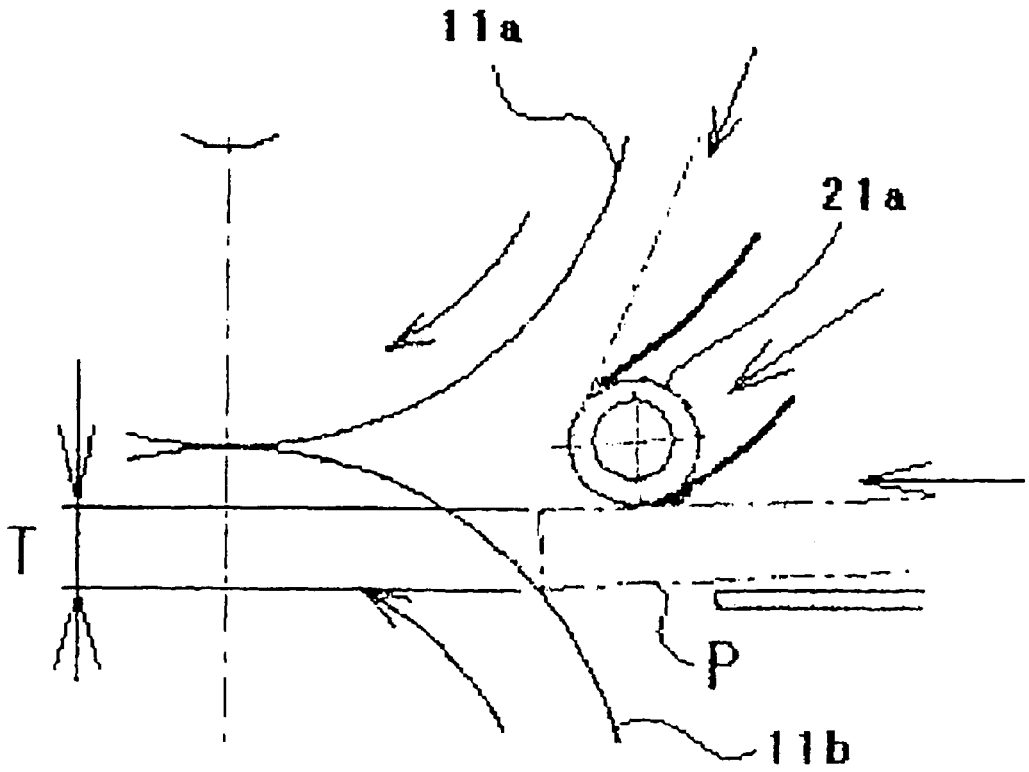
Figure 17:
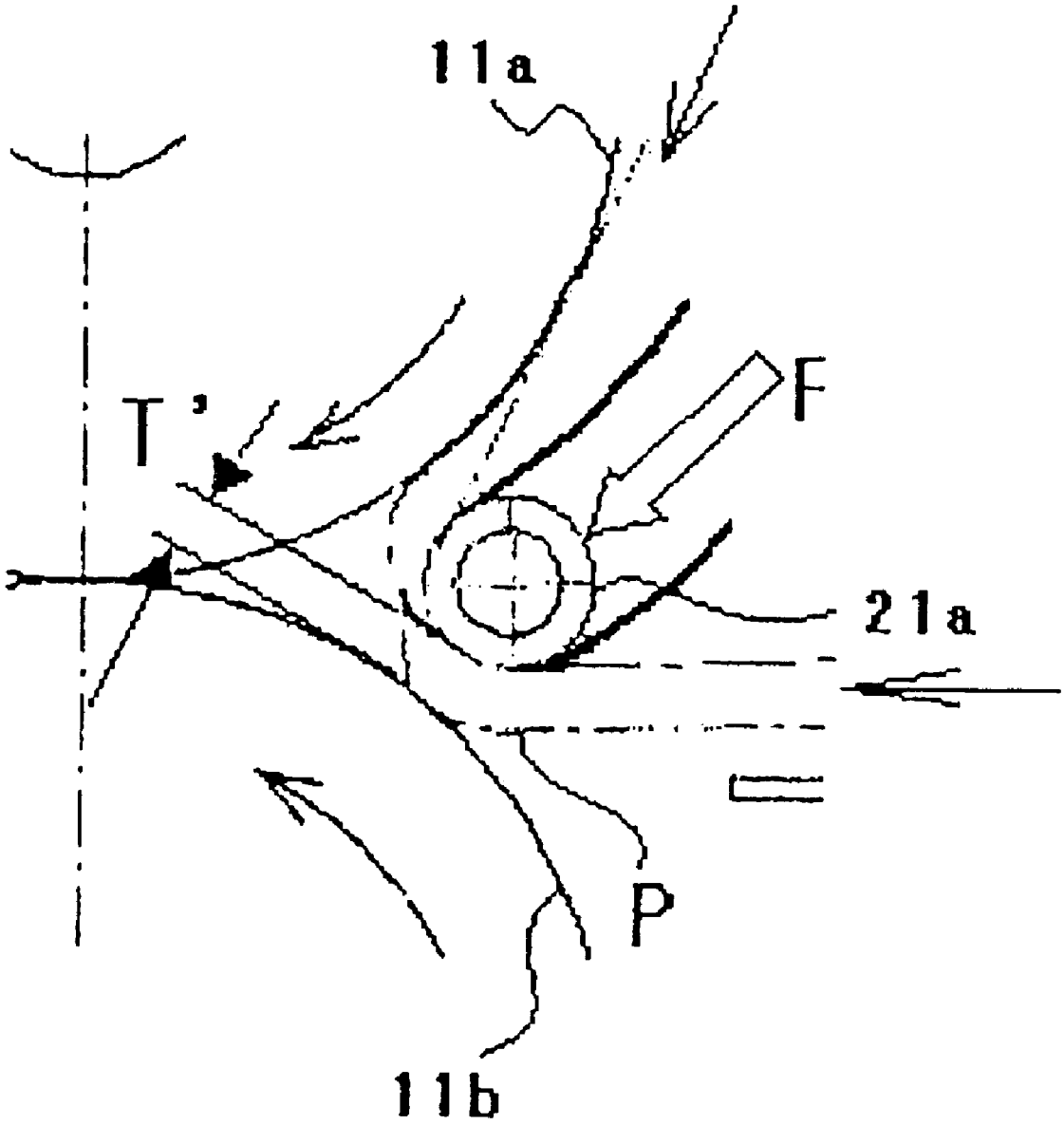

When the paper repetitively undergoes left folding and right folding and piles up, the paper becomes a folded bundle, which is nipped in the folding roller pairs 11 and 12 and carried. In a paper bundle state such as this, the paper forms a loop as shown in FIGS. 16 and 17 (a state where the paper is gripped in the left folding roller pair 11 in this case), and enters the nip of the folding roller pairs 11 and 12. When the paper is repeatedly folded, the paper bundle bulges according to the extent of folding of the folded paper, and a thickness of the paper bundle is shown as T in FIG. 16. When this paper bundle enters the left folding roller pair 11, the paper bundle is brought into contact with the lower folding roller 11*b* while the leading edge roller 21*a* of the biasing means 21 applies a pressure F proportional to the idle torque of the torque limiter 42*b* as shown in FIG. 17, and therefore the bulging of the thickness of the paper bundle is squeezed and becomes a thickness T' approaching a thickness of the paper itself when stacked. From this state the paper P forms a loop as shown by the dashed line, enters and is gripped at the nip at the left folding roller pair 11 rotating in the arrow direction such that the paper folds on the left side.

In the present embodiment, paper folded repetitively in an accordion shape as shown in FIG. 3 is stacked in the tray 13 by the discharge roller 19, but the same is true when paper folded in an accordion shape is further folded in a cross shape (see the fourth embodiment discussed below) using a folder that folds lengthwise and breadthwise to a particular size and it is possible to use a cross-folding folder mechanism in the present embodiment.

Figure 18:
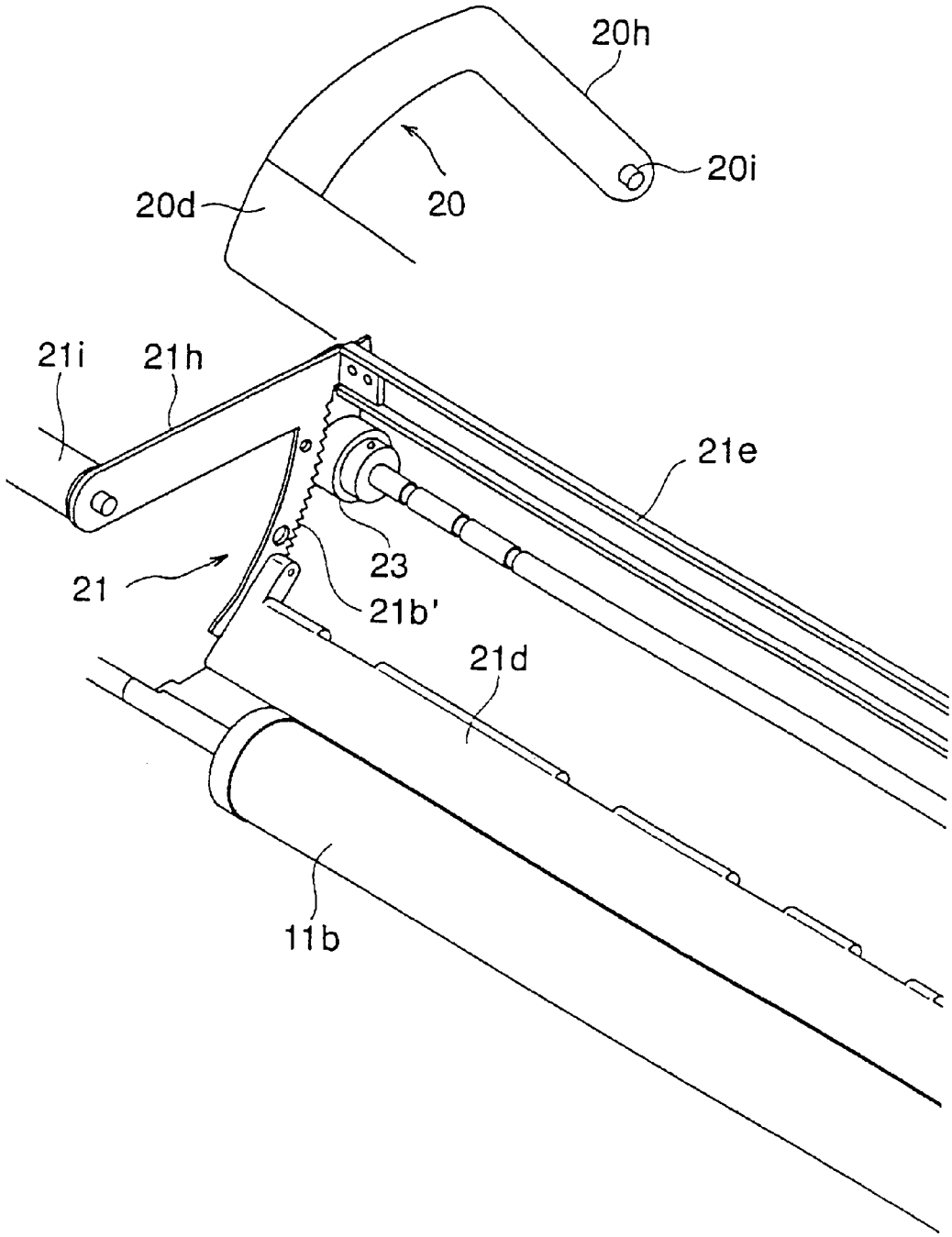
FIG. 18 is a perspective view showing an embodiment of a drive mechanism of the biasing means according to the first embodiment.

It should be noted that in the present embodiment the rollers 21*f* move along the pair of rails 60 as shown in FIG. 10 constructed at the outer sides of the biasing means 20 and 21. In this regard, the biasing means 20 and 21 move up and down along a circular arc trajectory so as to contact with the lower folding rollers 11*b* and 12*b* respectively. In this case, portions of the grooves where the rail grooves 60*a* and 60*b* intersect cannot guide the rollers 21*f*, and therefore it is conceivable that the carrying speed of the paper may be influenced by the biasing means 20 and 21 not being able to move up and down in a smooth circular arc trajectory. FIG. 18 shows a modification of a drive mechanism of the biasing means shown in FIG. 10. With this modification, biasing means levers 20*h* and 21*h* are provided oscillatably supported by rotational fulcrum shafts 20*i* and 21*i* such that the biasing means 20 and 21 make contact with the lower folding rollers 11*b* and 12*b* respectively as shown in FIG. 18, and the biasing means 20 and 21 are configured so as to move up and down along a circular arc trajectory. At peripheral portions of the circular arc portions of the levers 20*h* and 21*h* are formed the drive gears 22 and 23 and gear portions 20*b*' and 21*b*' that mesh therewith, and the biasing means 20 and 21 move up and down along a circular arc trajectory so as to contact and separate from the respective folding rollers 11*b* and 12*b* by a rotational operation of the biasing means levers 20*h* and 21*h* centered on the rotational fulcrum shafts 20*i* and 21*i* with a driving force obtained from the drive gears 22 and 23. By configuring this in this way, the biasing means levers 20*h* and 21*h* perform a rotational (oscillating) movement centered on the rotational fulcrum shafts 20*i* and 21*i*, and therefore a smooth movement becomes possible and there is no effect on the carry speed of the paper.

Figure 19:
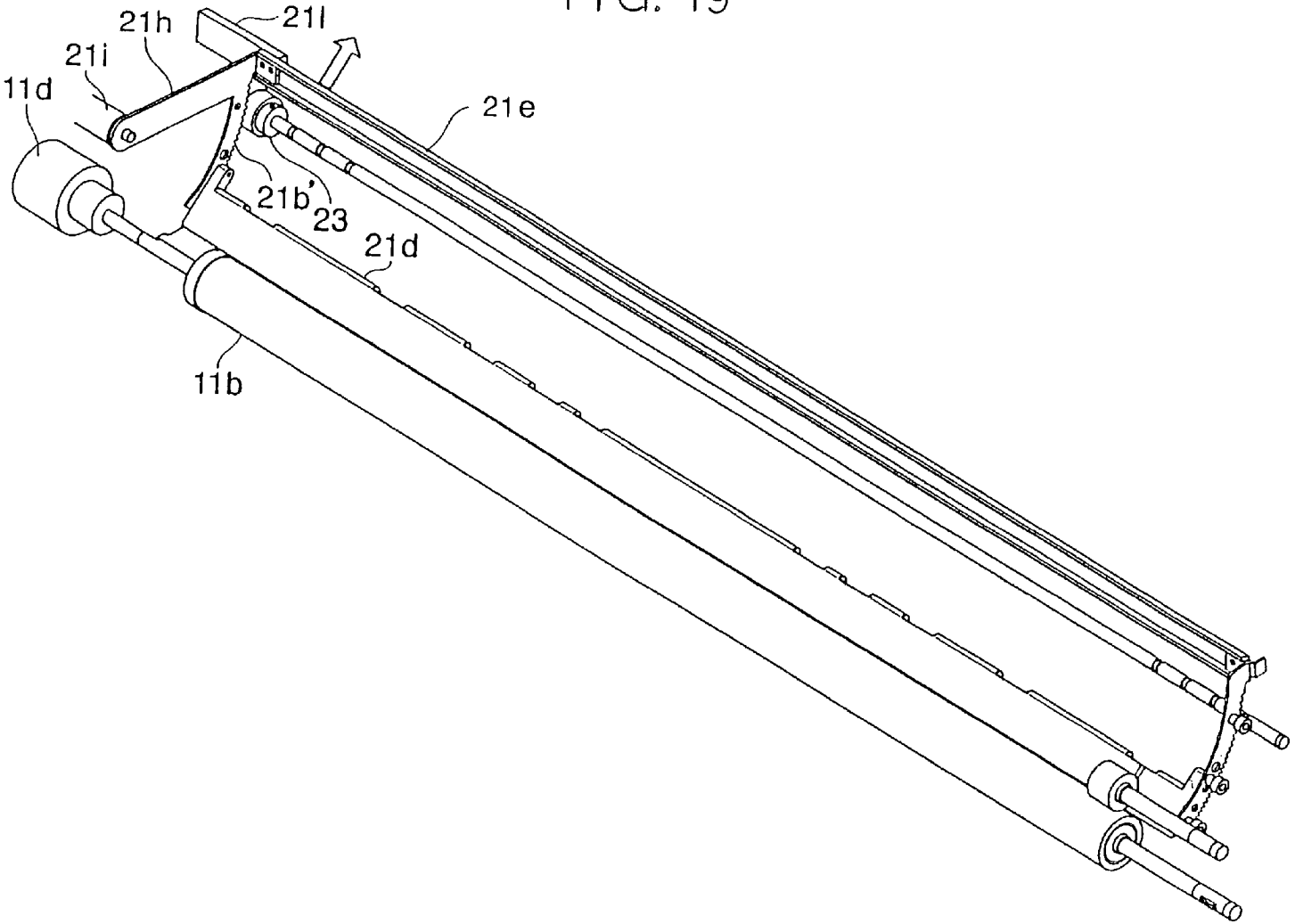
FIG. 19 is a perspective view showing a configuration of a jam processing mechanism of the biasing means according to the first embodiment.

Furthermore, when the levers 20*h* and 21*h* are used, jam processing can be carried out easily using the levers 20*h* and 21*h*. That is, as shown in FIG. 19, a handle 21*l* is provided at an end portion of the biasing means 21 (the same for 20) and a jam clearing dial 11*d* is provided at an end portion of the roller shaft of the lower folding roller 11*b*. It should be noted that in this embodiment the handle 21*l* is provided at the lever 21*h* on the front side of the device or on the stay 21*e* that connects to both ends of the lever 21*h*. Furthermore, the jam clearing dial 11*d* may be provided on the upper folding roller 11*a* side. When a jam occurs and the biasing means 21 cannot return to the home position, a message is displayed on a display portion of the operation portion 201 and the user is prompted to release the handle 21*l* in the arrow direction of the diagram.

With this configuration, drive is transmitted by the gear portions 20*b*' and 21*b*' of the biasing means 20 and 21 meshing with the drive gears 22 and 23, but since the drive gears 22 and 23 transmit drive via the torque limiter, sometimes the biasing means 20 and 21 are caught by jammed paper due to an occurrence of a jam and slippage occurs at the torque limiter and return cannot be achieved even when a driving force is applied to return the biasing means 21 to the home position. In this case, a repair call (breakdown) is carried out, but in order to avoid a repair call, the user may be prompted to use the handle 21 and move the biasing means 20 and 21 in the arrow direction in the drawing to remove the jam. Then, when the user carries out jam processing and the jammed paper is removed, the biasing means 20 and 21 are returned. Thus a repair call is prevented and improved operability can be achieved.

As described above, with the present embodiment, the biasing means 20 and 21 contact the paper at the lower side folding rollers 11*b* and 12*b* of the folding roller pairs 11 and 12 on the paper folding side and the paper to be folded is carried and folded, thereby enabling a loop of paper to be formed close to the folding rollers as shown in FIG. 15, and the diameter of the thus-formed loop can be reduced, and therefore the resistance is reduced when the loop enters the folding roller nip, slippage between the paper and the lower side folding rollers is greatly reduced, and accurate folding can be achieved at the targeted positions. Also, even when repeated folding is carried out, bulging of the paper bundle can be reduced greatly as shown in FIGS. 16 and 17, and when the number of times of folding has increased, unevenness in the paper loop formation can be reduced, and accurate folding can be achieved at the targeted positions.

Furthermore, by providing freely rotatable rollers 20*a* and 21*a* at leading edges of the biasing means 20 and 21 and having the rollers 20*a* and 21*a* make contact with the paper at the lower side folding rollers 11*b* and 12*b* of the folding roller pairs 11 and 12, slippage between the paper P and the folding rollers 11*b* and 12*b* is eliminated and the carrying precision can be improved.

Furthermore, by arranging freely rotatable rollers at leading edges of the biasing means 20 and 21, the load of when the rollers 20*a* and 21*a* come in contact with the folding rollers 11*b* and 12*b* is reduced, the feeding precision of the folding rollers 11*b* and 12*b* is stabilized, and accurate folding can be achieved at the targeted positions.

Furthermore, when configuring the rollers 20*a* and 21*a* from a single roller having a length greater than the paper width of the paper to be folded, the pressure of the paper P when the rollers 20*a* and 21*a* and the folding rollers 11*b* and 12*b* come in contact can be made uniform in the width direction, and when the loop shaped paper enters the folding roller nip, rippling in the width direction of the paper is eliminated and wrinkling can be prevented.

Furthermore, when the rollers 20*a* and 21*a* are made from pipe shaped rollers, the weight of the biasing means 20 and 21 is reduced, the idle torque of the torque limiters 42*b* and 47*b* can be reduced, unevenness in the pressure F of the roller 21*a* such as that shown in FIGS. 15 and 17 is reduced, and accurate folding can be achieved at the targeted positions. Furthermore, since the idle torque of the torque limiters 42*b* and 47*b* can be reduced, the drive motor of the biasing means 20 and 21 can be made smaller, thereby enabling reduced costs.

Furthermore, by having the rollers 20*a* and 21*a* supported in the width direction by the biasing means, flexure of the rollers 20*a* and 21*a* when the rollers 20*a* and 21*a* and the folding rollers 11*b* and 12*b* come in contact can be prevented, and the pressure on the paper P can be set evenly across the width direction, and when the loop shaped paper enters the folding roller nip, rippling in the width direction of the paper is eliminated and wrinkling can be prevented.

Furthermore, by coating with Teflon (registered trademark) locations where the rollers 20*a* and 21*a* are borne, the rotational load of the rollers 20*a* and 21*a* when the rollers 20*a* and 21*a* contact the folding rollers 11*b* and 12*b* is reduced, the feeding precision of the folding rollers 11*b* and 12*b* is stabilized, and accurate folding can be achieved at the targeted positions.

Furthermore, by forming the biasing means 20 and 21 using a resin material having a low coefficient of friction, the rotational load of the rollers 20*a* and 21*a* when the rollers 20*a* and 21*a* contact the folding rollers 11*b* and 12*b* is reduced, the feeding precision of the folding rollers 11*b* and 12*b* is stabilized, and accurate folding can be achieved at the targeted positions. Moreover, the resistance when the paper leading edge of FIG. 4 is guided to the folding rollers 11*b* and 12*b* by the biasing means 20 and 21 is reduced, unevenness in the timing by which the paper leading edge enters the folding rollers 11*b* and 12*b* is reduced, and unevenness in the first fold position can be reduced.

Furthermore, by receiving the rollers 20*a* and 21*a* at leading edge portions of the guiding plates 21*d* or at a plurality of shaft bearing members, partial contact of the rollers 20*a* and 21*a* and the shaft bearing portion with respect to the curvature of the biasing means 20 and 21 is prevented, warping of the rollers 20*a* and 21*a* over time due to uneven wear of the shaft bearing portion is prevented, and accurate folding can be achieved at the targeted positions.

Furthermore, by ensuring that the rollers 20*a* and 21*a* do not contact the first or second lower side folding rollers 11*b* and 12*b* when the carry roller pair 14 feeds the paper leading edge to the first or second folding roller pairs 11 and 12, the rollers 20*a* and 21*a* do not rotate in a reverse direction to the carrying direction when the leading edge of the paper in FIG. 4 is guided to the folding rollers 11*b* and 12*b* by the biasing means 20 and 21, and therefore the resistance of the rollers 20*a* and 21*a* is reduced, unevenness in the timing by which the paper leading edge enters the folding rollers 11*b* and 12*b* is reduced, and unevenness in the first fold position can be reduced.

Furthermore, since the movement trajectory of the biasing means 20 and 21 is a circular arc shape, the biasing means 20 and 21 can make contact close to the nip of the folding rollers, thereby enabling a loop of paper to be formed close to the folding rollers 11 and 12 as shown in FIG. 15, such that the diameter of the thus-formed loop can be reduced. In this way, the resistance is reduced when the loop enters the folding roller nip, slippage between the paper and the lower side folding rollers 11*b* and 12*b* is greatly reduced, and accurate folding can be achieved at the targeted positions.

Furthermore, by bringing the biasing means 20 and 21 in contact with the lower side folding rollers 11*b* and 12*b* of the folding roller pair on the side where the paper P folds while applying a constant tension to the paper to carry and fold the paper, a loop of paper can be formed close to the folding rollers 11 and 12 as shown in FIG. 15, such that the diameter of the thus-formed loop can be reduced. In this way, the resistance is reduced when the loop enters the folding roller nip, slippage between the paper and the lower side folding rollers is greatly reduced, and accurate folding can be achieved at the targeted positions.

Furthermore, when repeat folding has been performed, bulging of the paper bundle can be reduced as much as possible as shown in FIGS. 16 and 17 and when the number of times of folding increases, unevenness in the paper loop formation is reduced and accurate folding can be achieved at the targeted positions. Moreover, accurate folding can be achieved at the targeted positions by applying a constant tension to the paper to eliminate paper slackness and accurately bringing a targeted position into contact with the lower side folding roller of the folding roller pair.

Furthermore, since the mechanism of the biasing means 20 and 21 applying a constant tension to the paper is the biasing means drive portion and an operational force of the biasing means is always maintained constantly, the roller pressure F in FIGS. 15 and 17 is stable, and accurate folding can be achieved at the targeted positions.

Furthermore, since the movement speed of the biasing means 20 and 21 is greater than the movement speed by which the paper slackens, the leading edge of the biasing means 20 and 21 is brought into contact with the paper P and paper slackness is eliminated by applying a constant tension without carrying out accurate operational timing or positional control of the biasing means 20 and 21 such that the targeted position can be folded accurately and brought into contact with the lower side folding rollers 11*b* and 12*b* of the roller pairs. Thus, it is possible to accurately fold the targeted positions and operational timing or positional control of the biasing means 20 and 21 can become unnecessary or simplified.

Further still, there is no gap between biasing means leading edge and the paper prior to operation of the biasing means 20 and 21, and therefore there is no impact-applying contact between the biasing means leading edge and the paper at the time of biasing means operation. In this way, it is possible to achieve accurate folding without applying any damage such as tearing to the paper.

Second Embodiment

The following is a description of this embodiment. It should be noted in regard to description of the first embodiment that is substantially applied in the present embodiment that duplicate description thereof is omitted and only portions and characteristics of the present embodiment that are different are described below.

Figure 20:
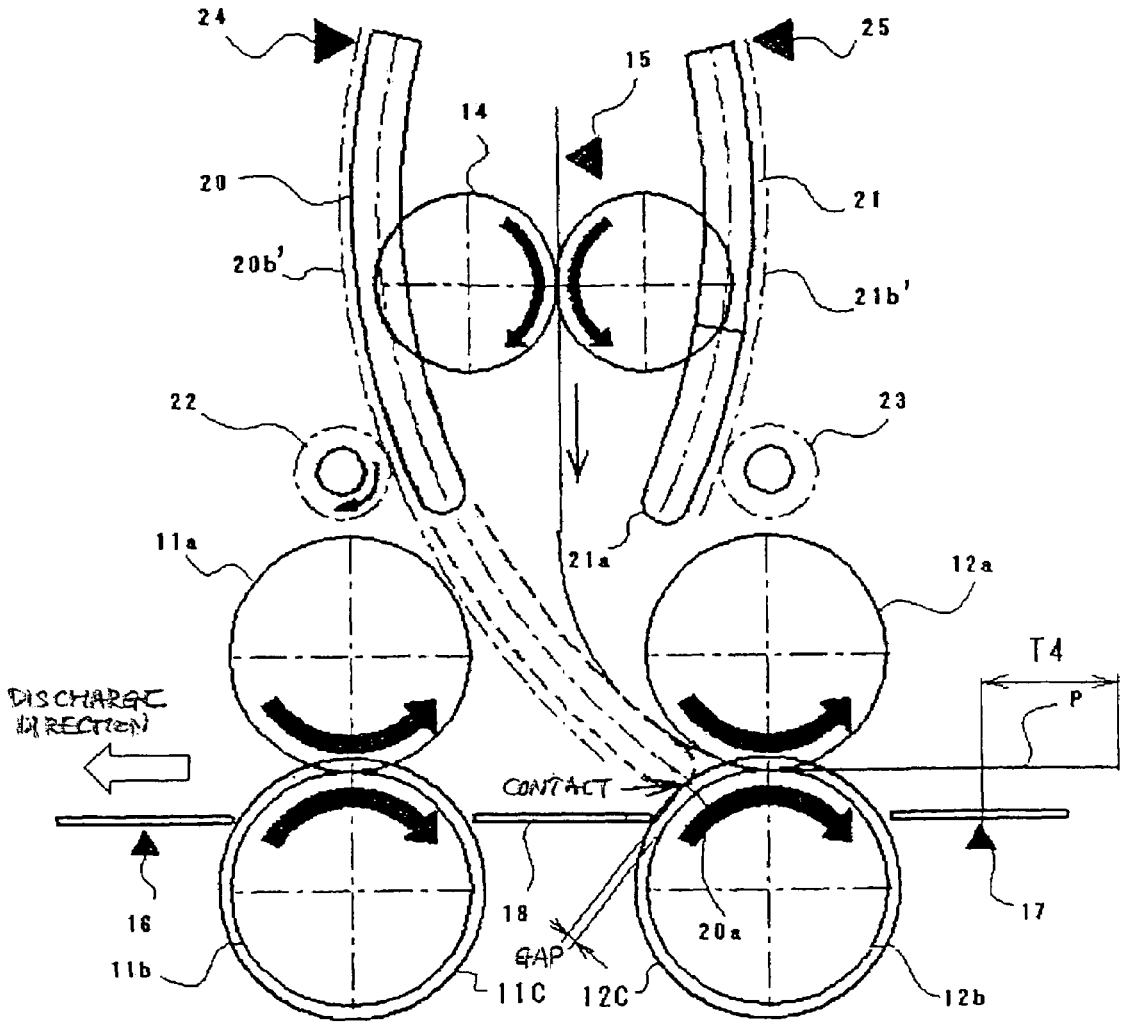
FIGS. 20 to 23 are diagrams for describing operations of a paper folding device according to a second embodiment of the present invention.
Figure 22:
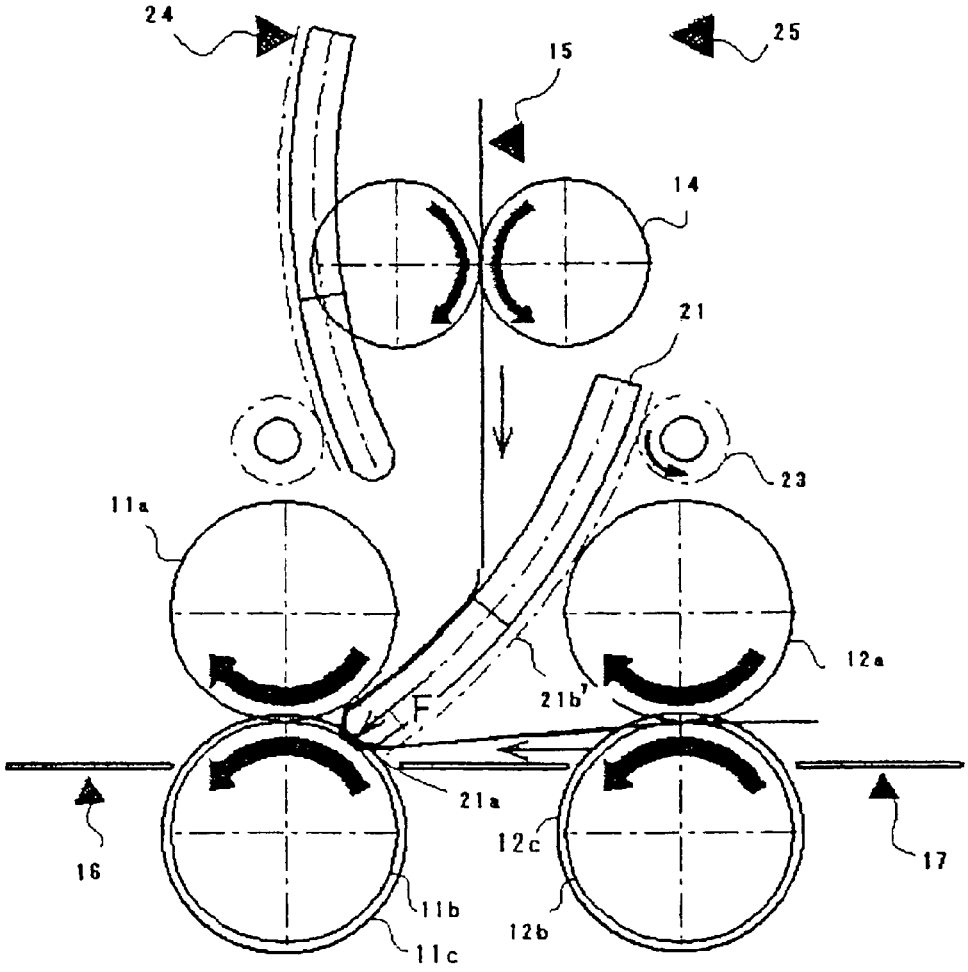
Figure 24:
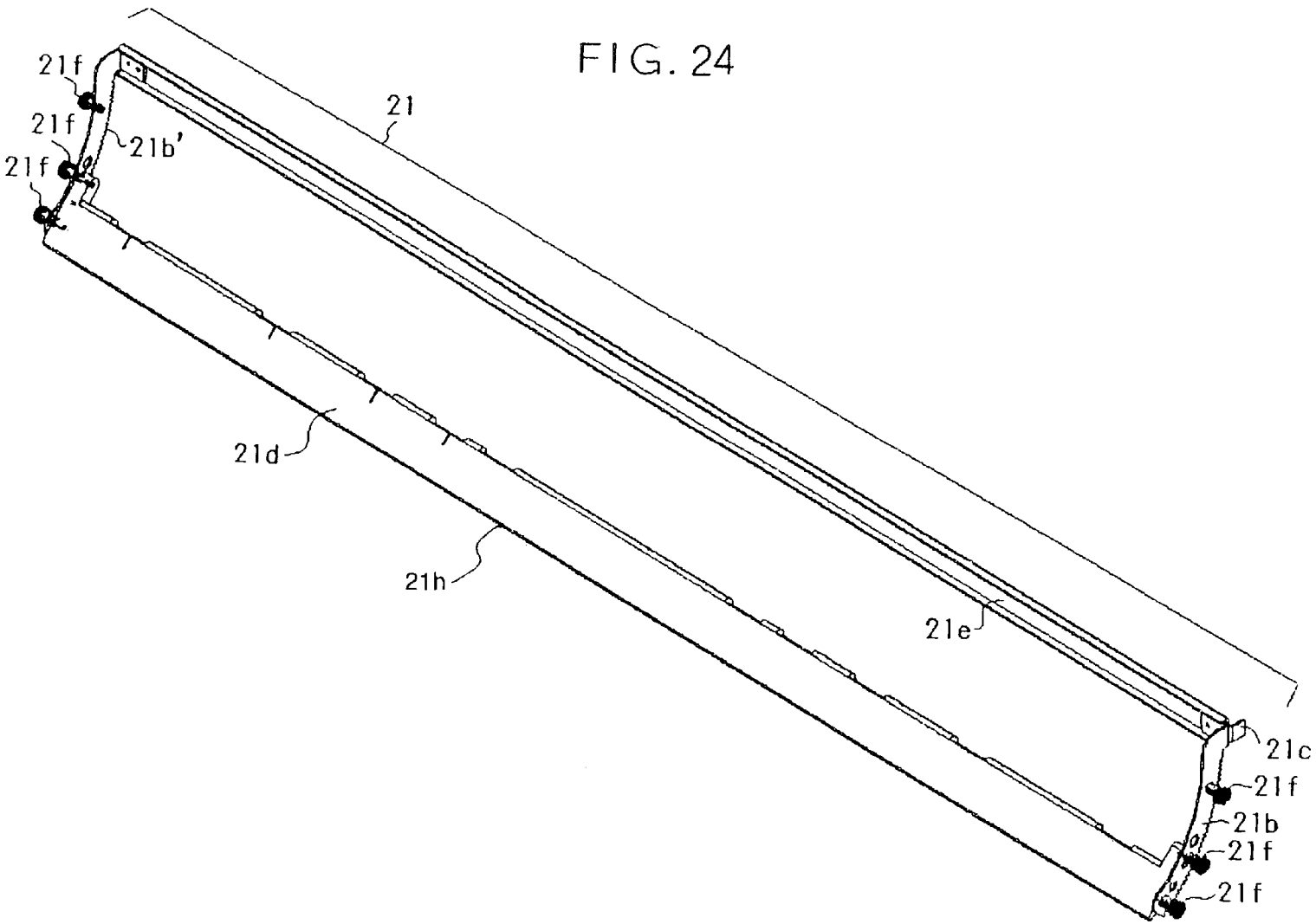
FIG. 24 shows a configuration of a biasing means according to the second embodiment.
Figure 25:
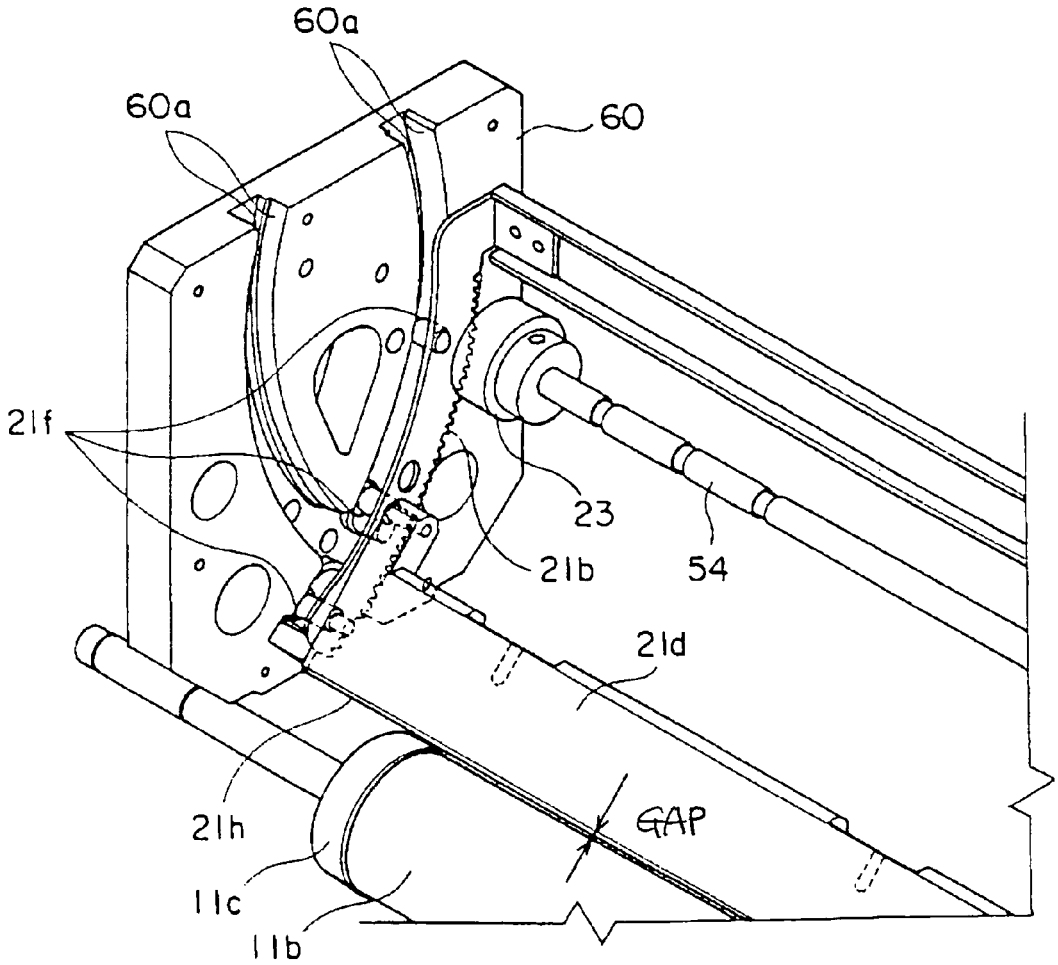
FIG. 25 shows a configuration of rail grooves of the biasing means according to the second embodiment.

The biasing means 20 and 21 have a circular arc shaped trajectory so as to contact the lower folding rollers 11*b* and 12*b* respectively, and the biasing means 20 and 21 are rotationally driven by the drive gears 22 and 23. The leading edge of the paper is guided by the biasing means 20 and 21 to approach the folding roller pairs 11 and 12 and enter the nips of the folding roller pairs 11 and 12. At this time, whether the leading edge of the paper enters the nip of the folding roller pair 11 or 12 is selected by which of the biasing means 20 and 21 is moved. Here, the biasing means 20 that guides to the folding roller pair 12 on the right side is the right biasing means and the biasing means 21 that guides to the folding roller pair 11 on the left side is the left biasing means. Further still, as shown in FIG. 22, the biasing means 20 and 21 are structures that guide the inner side of the paper to the nip of either of the folding roller pairs 11 and 12 at the time of folding paper. At this time, as shown in FIGS. 20, 24, and 25, circular arc shape portions 20*h* and 21*h* constructed at the leading ends of biasing means 20 and 21 come into contact with cylindrical collars 11*c* and 12*c* constructed on the same shaft as stoppers on the ends of the lower folding rollers 11*b* and 12*b*. At this time, the diameter of the collars 11*c* and 12*c* is set greater than the diameter of the lower folding rollers 11*b* and 12*b* by a thickness of at least one sheet of paper. Consequently, a gap of at least one sheet of paper is made when the circular arc shape portions 20*h* and 21*h* come in contact with the respective collars 11*c* and 12*c*. Furthermore, in the present embodiment, the material of the lower folding rollers 11*b* and 12*b* and the collars 11*c* and 12*c* is metal and the lower folding rollers 11*b* and 12*b* have undergone urethane coating.

Figures 26A, 26B:
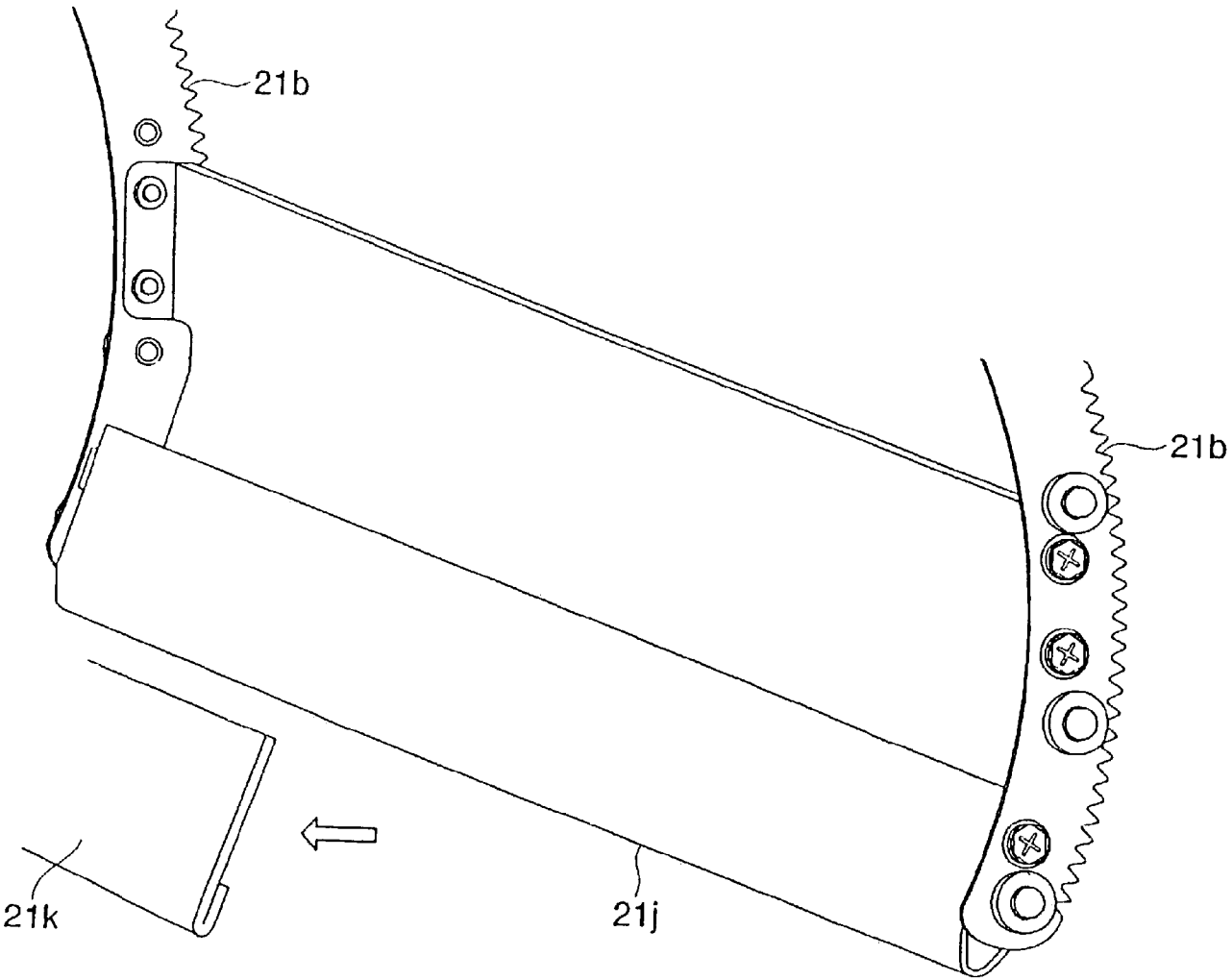
FIGS. 26A and 26B are perspective views showing a form of a leading edge portion of the biasing means according to the second embodiment.

The biasing means 20 and 21 are the same as in the first embodiment in FIG. 9, but the circular arc shape portions 20*h* and 21*h* having a width greater than the maximum paper width are provided at the leading edge between the side boards, and the circular arc shape portions 20*h* and 21*h* have undergone a fluorine resin coating to be set such that the coefficient of abrasion between the circular arc shape portions 20*h* and 21*h* and the paper is lower than the coefficient of abrasion between sheets of paper. That is, in the present embodiment, instead of the rollers 21*a* in the first embodiment, the metal leading edges are simplified as an "R" shape. In this regard, a sheet metal integrated component shape 21*j* as shown in FIG. 26A can be used, further still, in order to reduce a diameter R of the leading edge, a component shape 21*k* can be used in which the leading edge portion is bent over so that the leading edge diameter R is 1 mm in the case of a metal sheet of a sheet thickness of 1 mm for example as shown in FIG. 26B. Reduced costs can be achieved by integrating the leading edge R and the guiding plate 21*d* in this way using a metal sheet, moreover, by bending over the leading edge portion, the leading edge diameter R can be reduced to the sheet thickness. This enables the paper to be guided very close to the nip of either of the folding roller pair 11 or 12 and makes it possible to reduce folding position unevenness.

The series of paper folding operations of the paper folding device 1 of the present embodiment is similar to the procedure of the flowcharts in FIGS. 13A to 13D and 14A to 14D in the first embodiment, but since the cylindrical collars 11*c* and 12*c* are provided in the present embodiment, there are slight differences in the details. Accordingly, description will be given mainly concerning the points of difference.

First, when a signal indicating paper folding is inputted from the main unit operation portion 201 shown in FIG. 12, the signal is sent to the paper folding controller 100 via the main unit control board 202. In this case, the flowchart of FIGS. 13A to 13D starts at the paper folding device 1 side, the carrying motor 52 of FIG. 8 goes ON, and the carry roller pair 14 of FIG. 20 begins to rotate in the arrow direction (step S0). Next, paper is sent from the main unit, the leading edge of the paper passes the leading edge detection sensor 15, and an ON signal of the leading edge detection sensor 15 is inputted to the paper folding controller 100 (step S1). Next, a determination is made as to whether or not the initial paper carrying according to the paper folding type signal inputted from the main unit control portion 201 is a paper folding type in which the paper enters the right side folding rollers 12 (step S2). The folding motor 30 of FIG. 8 turns ON and rotates (here this is forward rotation) in the arrow direction of of FIG. 20 (step S3). Next, the biasing means right motor 43 of FIG. 8 turns ON, and the right biasing means 20 of FIG. 20 commences to move from the solid line position toward the dashed line position (the rotation direction is forward at this time) (step S4).

At this time, the biasing means right HP sensor 24 goes OFF (step S5) and, after a drive time T1 in which the right biasing means 20 reaches the dashed line position from the solid line position, the biasing means right motor 43 goes OFF (step S6). At this time, as shown in FIG. 20, the circular arc shape portion 20*h* of the leading edge of the right biasing means 20 and the collars 12*c* at the ends of the lower folding roller 12*b* come in contact and the right biasing means 20 is caused to stop in a state in which there is a gap greater than the thickness of one sheet of paper. In this state, the leading edge of the paper P enters the nip of the right side folding roller pair 12 as shown in FIG. 20 and the folding width right detection sensor 17 goes on (step S7). After this, in order to return the right biasing means 20 to the standby position, the biasing means right motor 43 goes ON in the reverse rotation direction (step S8), the biasing means right HP sensor 24 goes ON (step S9), the biasing means right motor 43 goes OFF (step S10), and the right biasing means 20 returns to a standby state at the solid line position of FIG. 4.

Next, after the leading edge of the paper enters the right side folding roller pair 12, a determination is carried out as to whether or not there is a next folding (step S11), and the following description concerns the case where there is a next folding. After T4 seconds from the folding width right detection sensor 17 going ON, the folding motor 30 goes OFF and stops (step S12), and this time, in order to guide the inner side of the paper to the nip of the left folding roller pair 11, the biasing means right motor 36 of FIG. 8 goes ON, and the left biasing means 21 of FIG. 21 commences moving in the arrow direction (the rotation direction at this time is forward) (step S13). At this time the biasing means left HP sensor 25 goes OFF (step S14).

Figure 21:
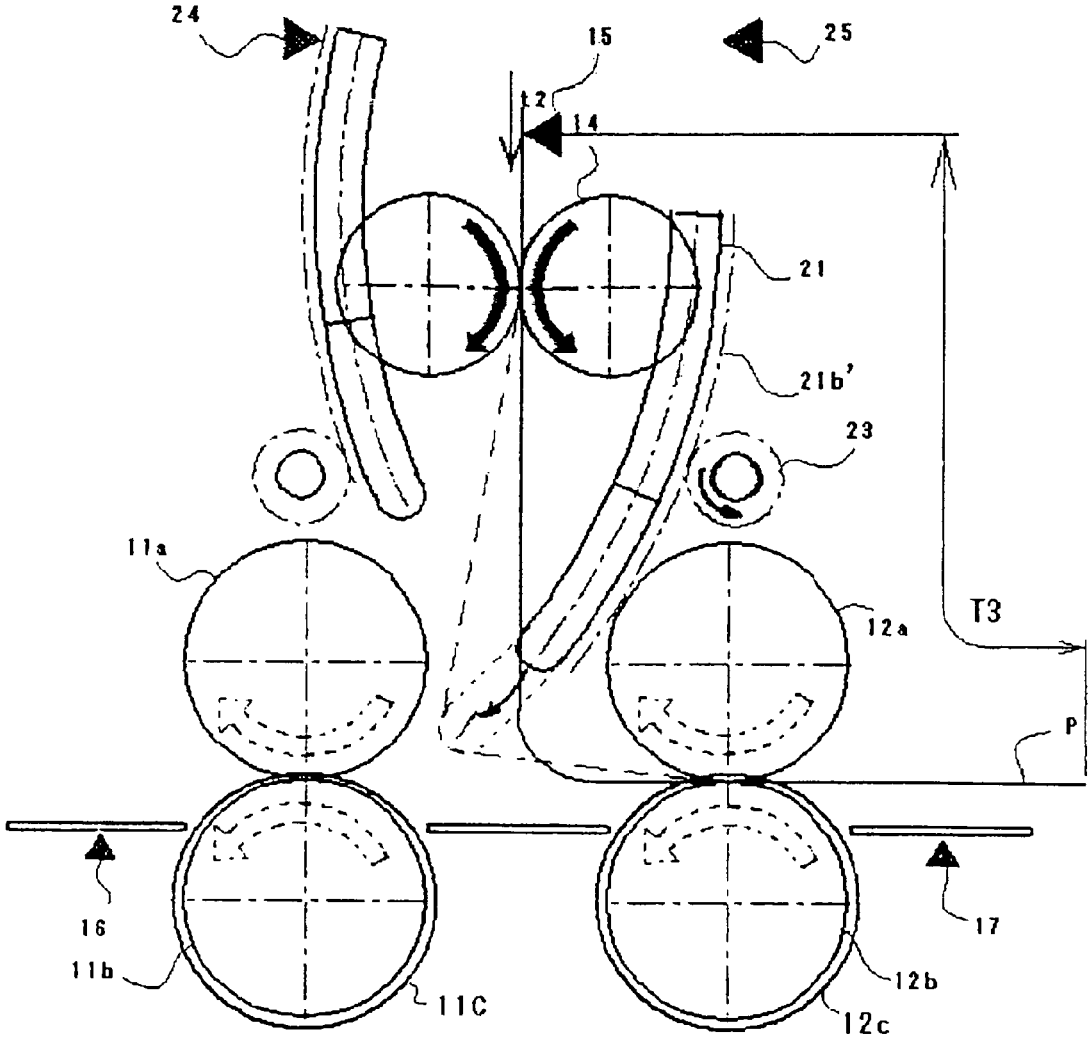
Figure 27:
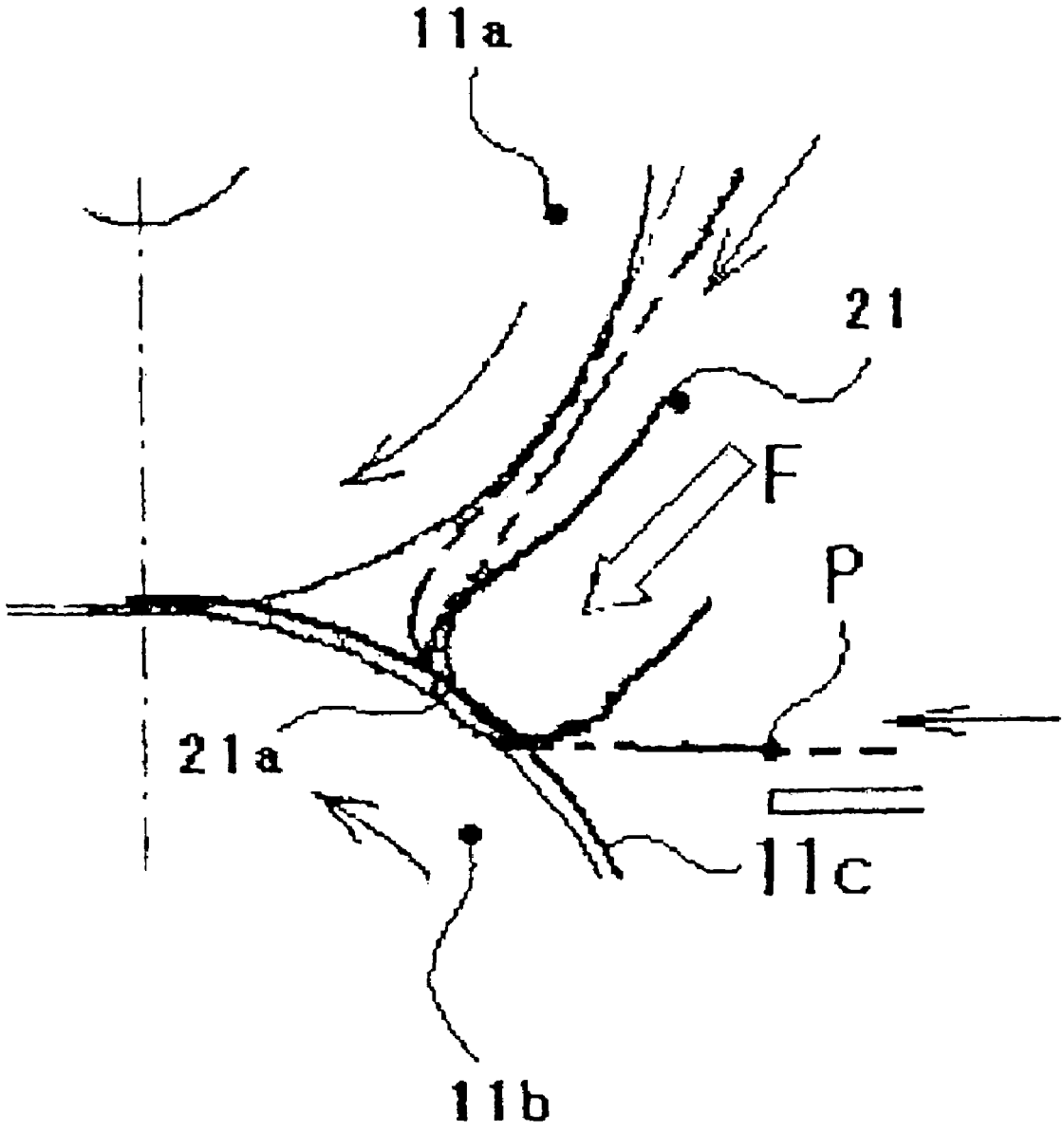
FIGS. 27 to 29 are diagrams for describing an operation of folding rollers according to the second embodiment.

At the same time as the operation of the left biasing means 21 and after T3 seconds from the leading edge detection sensor 15 going ON as shown in FIG. 21, the folding motor 30 goes ON in the reverse rotation direction (step S15). At this time, the movement speed of the left biasing means 21 is set faster than the speed at which the paper slackens, and therefore the paper loses slackness as shown by the dashed line in FIG. 21, and the paper and the circular arc shape portion 20*h* of the leading edge of the left biasing means 21 come in contact. At this time, the movement speed of the left biasing means 21 cannot become faster than the speed at which the paper slackens, and therefore the left biasing means 21 becomes unable to move at a speed above the speed at which the paper slackens. As a result, a load is applied to the torque limiter 42*b* of FIG. 8, and sliding commences while torque is produced between the torque limiter 42*b* and the drive pulley 42*a*. Consequently, the circular arc shape portion 21*h* of the leading edge of the left biasing means 21 apples tension to the paper proportional to the idle torque of the torque limiter 42*b*, the paper moves while maintaining a tensioned state, and the circular arc shape portion 21*h* of the leading edge of the left biasing means 21 as shown in FIG. 22 is brought in contact with the collars 11*c* at the ends of the lower folding roller 11*b* while guiding the paper to the lower folding roller 11*b*. Further still, as shown in FIG. 27, the paper P further slackens as shown by the dashed line to form a loop, the peak of the loop is gripped in the nip of the left folding roller pair 11 rotating in the arrow direction as shown in FIG. 27, and the paper is folded on the left side. The paper P continues to be fed further such that the leading edge of the folded paper P reaches the folding width left sensor 16, which then goes ON (step S16). After this, in order to return the left biasing means 21 to a standby state, the biasing means right motor 36 is stopped (step S17) and then turned ON in the reverse rotation direction (step S18), the biasing means left HP sensor 25 goes ON (step S9), the biasing means left motor 43 goes OFF (S20) to return the left biasing means 21 to the standby state of the solid line position of FIG. 20, thereby completing the first fold.

If there is no fold at the determination of whether or not there is a next fold at step S11, the paper discharge direction is on the left folding roller pair side, and therefore discharge occurs after performing a switch back once, and when the paper trailing edge passes the leading edge detection sensor 15 in a state in which the right folding roller pair 12 carries the paper and the leading edge detection sensor 15 goes OFF, the folding motor 30 goes OFF and stops (step S22), and this time a discharge operation flow C commences in which the folding motor 30 performs reverse rotation (step S23) and the paper trailing edge is carried toward the right folding roller pair 11.

Furthermore, when the determination of whether or not there is a paper folding type in which the initial paper carrying of step S2 involves entering the right side folding rollers 12 is that the paper folding type involves entering the left side folding rollers 11, steps S24 through S42 are carried out in the same manner as when the paper enters the right side folding rollers 12 with a laterally reverse difference. However, when the determination as to whether or not there is a next fold at step S32 is that there is no fold, the paper discharge direction is on the side of the left folding roller pair 11 such that there is no need to perform a switchback before discharging, and therefore the procedure commences the discharge operation flow C at that point.

Here, a determination is carried out as to whether or not there is repeat folding (steps S21 and S42), and when there is repeat folding when the first fold is on the left side, a flow B commences involving a right side repeat fold, and when there is no repeat fold, there is no need to perform a switchback before discharging, and therefore the procedure commences the discharge operation flow C at that point.

Furthermore, when there is a repeat fold when the first fold is on the right side, a flow A commences involving a right side repeat fold, and when there is no repeat fold it is necessary to perform a switchback once before discharging, and therefore when the paper trailing edge passes the leading edge detection sensor 15 in a state in which the right folding roller pair 12 carries the paper and the sensor goes OFF, the folding motor 30 goes OFF and stops (step S43), and this time the discharge operation flow C commences in which the folding motor 30 performs reverse rotation (step S44) and the paper trailing edge is carried toward the right folding roller pair 11.

Figure 23:
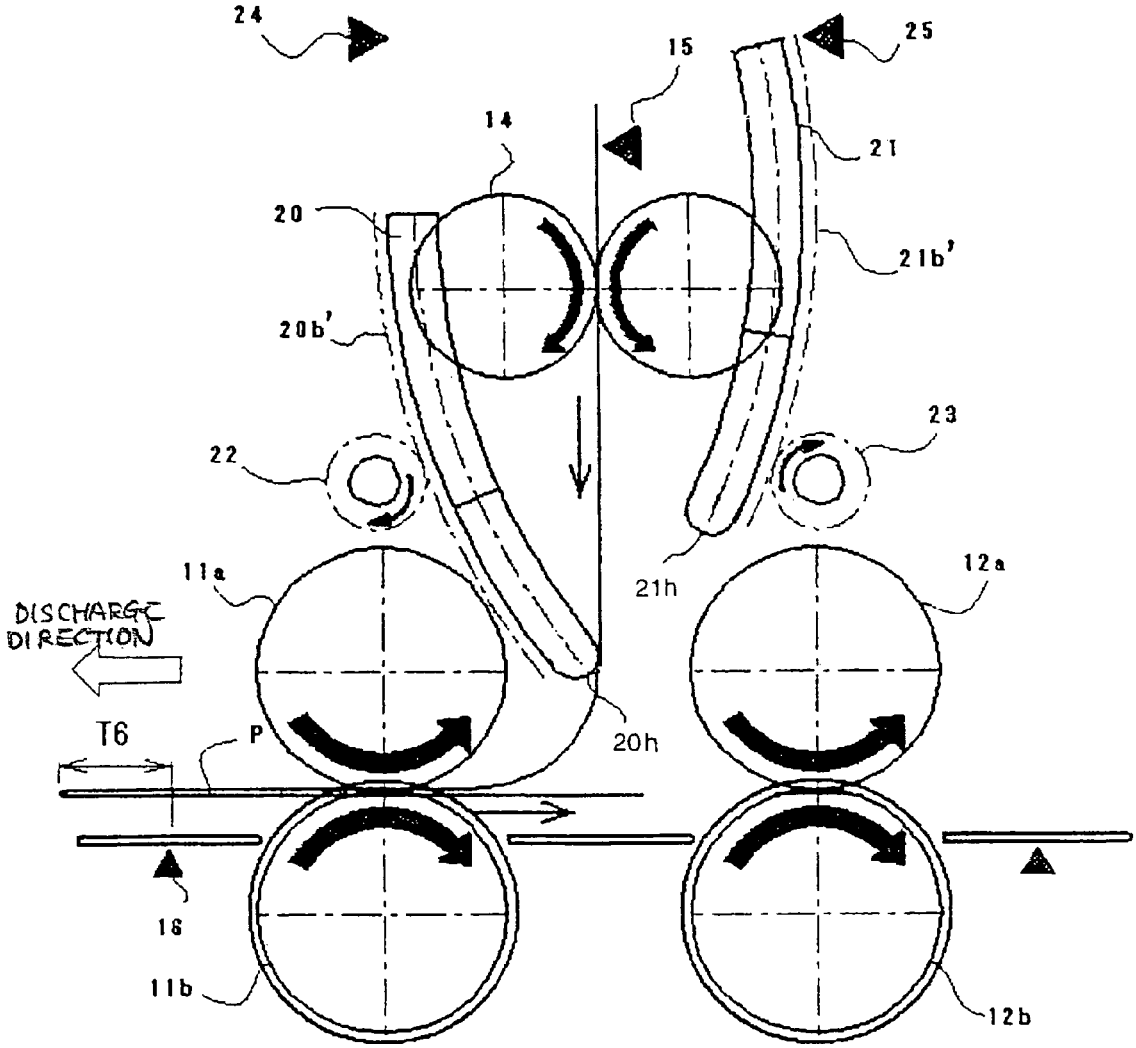

In the case of repeat fold flows A and B, the left fold flow A is almost identical to the first fold steps S12 to S21, and the timing for causing reverse rotation of the folding motor 30 at step S48 in the case of repeat folding is T6 seconds after the folding width right detection sensor 17 goes ON. Similarly, the right folding flow B is almost identical to the first fold steps S33 to S42, and when the timing for causing forward rotation of the folding motor 30 at step S58 is repeated, reverse rotation is caused T6 seconds after the folding width right detection sensor 16 goes ON (see FIG. 23). After this, when there is further repeat folds, the flows A and B are repeated, and when the final fold is on the right side, the paper discharge direction is on the side of the left folding roller pair, and therefore a switchback is performed once before discharging, and when the paper trailing edge passes the leading edge detection sensor 15 in a state in which the right folding roller pair 12 carries the paper and the leading edge detection sensor 15 goes OFF, the folding motor 30 goes OFF and stops (step S65). Then this time a discharge operation flow C commences in which the folding motor 30 performs reverse rotation (step S66) and the paper trailing edge is carried toward the left folding roller pair 11. When the final fold is on the left side, the procedure commences the discharge operation flow C at that point.

Finally, in the discharge operation flow C, after the paper trailing edge passes the folding width detection sensor 16 and the folding width detection sensor 16 goes OFF (step S67), the folding motor 30 is stopped (step S68), the carrying motor 52 is stopped (step S69) and discharge is completed.

Figure 28:
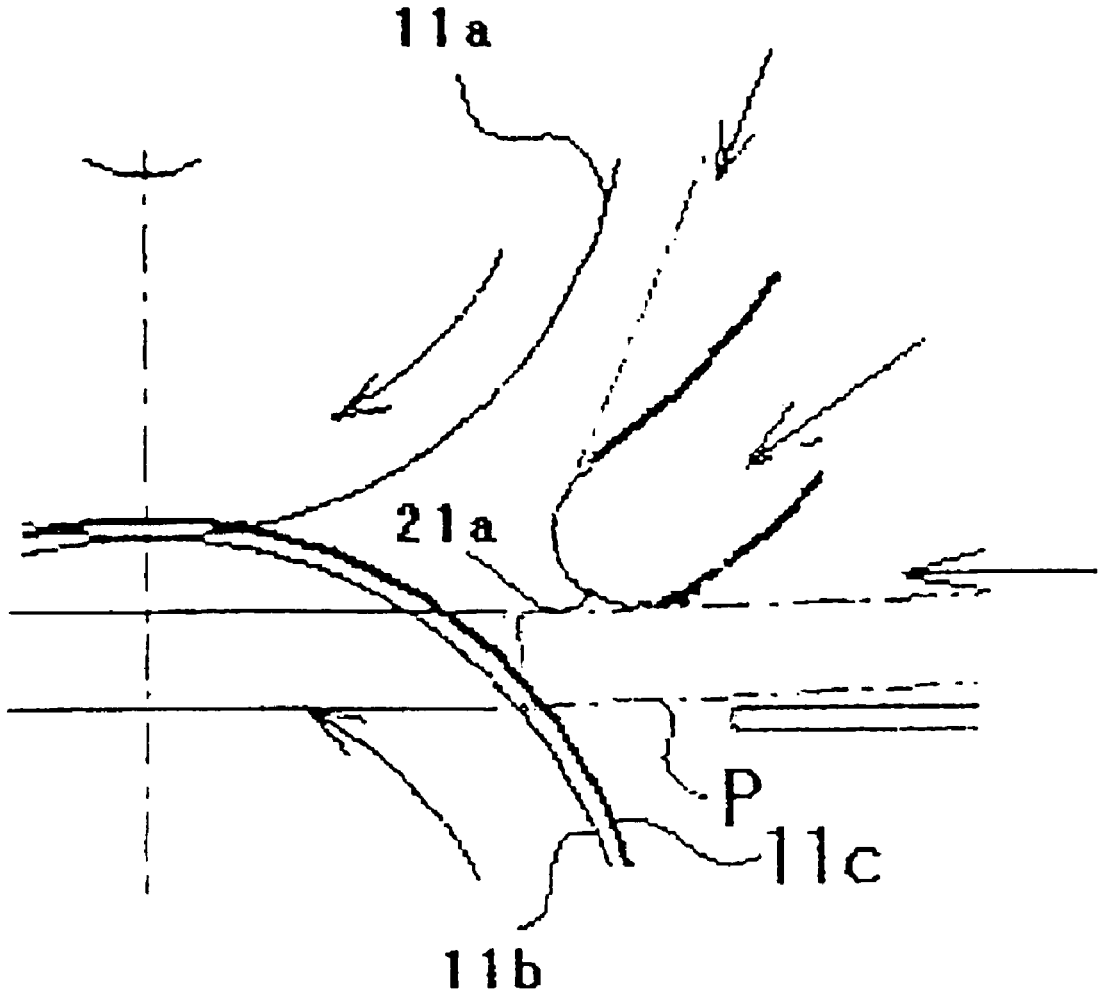
Figure 29:
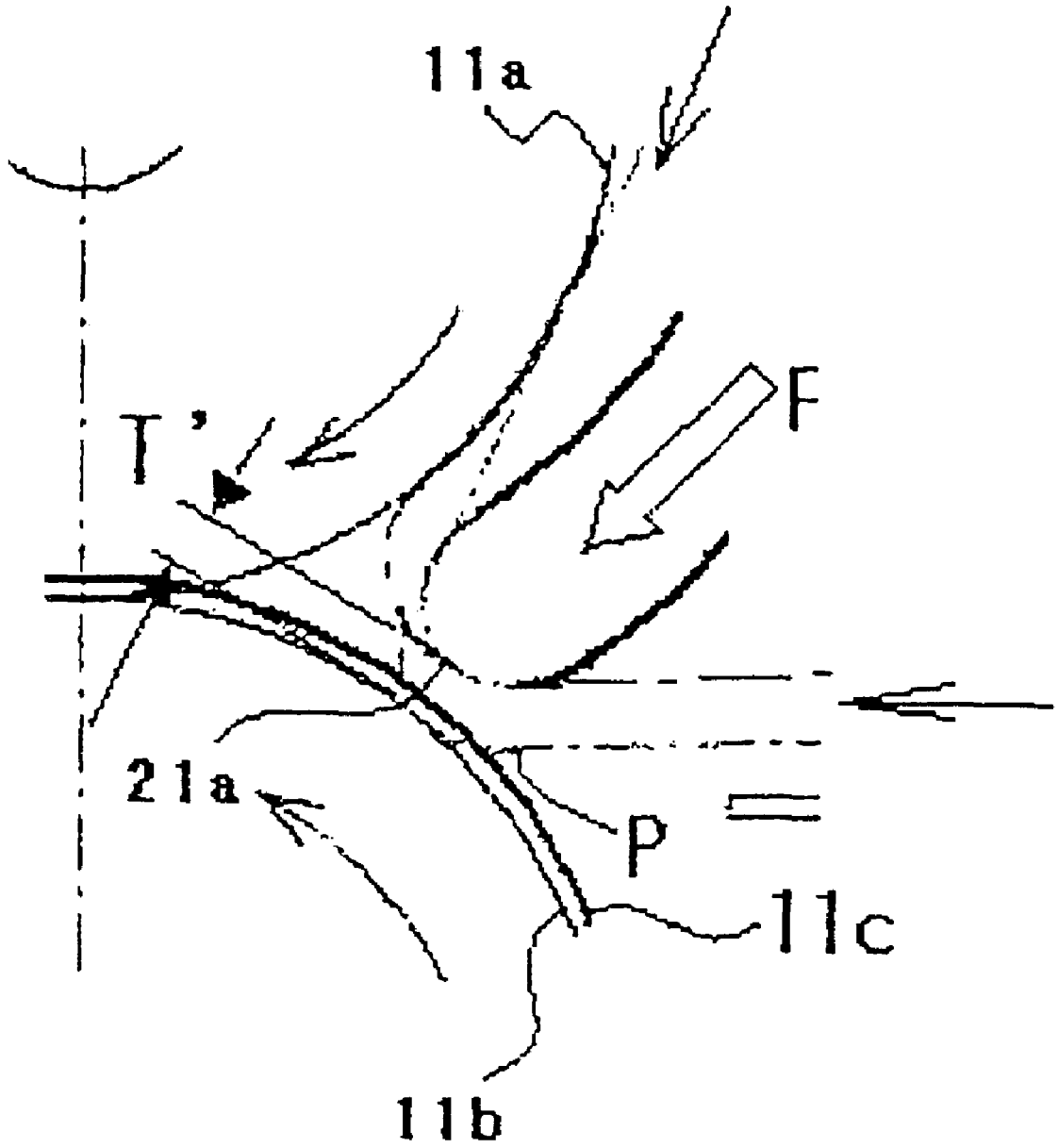

When the paper repetitively undergoes left folding and right folding and piles up, the paper becomes a folded bundle, which is nipped in the folding roller pairs 11 and 12 and carried. In a paper bundle state such as this, the paper forms a loop as shown in FIGS. 27 and 28 (when the paper is gripped in the left folding roller pair 11 in the case of this diagram), and enters the nip of the folding roller pairs 11 and 12. When the paper is repeatedly folded, the paper bundle bulges according to the extent of folding of the folded paper, and a thickness of the paper bundle is shown as T in FIG. 28. A thickness T of the paper bundle has a thickness greater than two sheets of paper due to folding, and therefore there is no contact between the circular arc shape portions 20*h* and 21*h* and the collars 11*c* and 12*c* at the ends of the lower folding rollers 11*b* and 12*b*. Consequently, when the paper bundle enters the left folding roller pair 11, the paper bundle is brought into contact with the lower folding roller 11*b* while the leading edge circular arc shape portion 21*h* of the biasing means 21 applies a pressure F proportional to the idle torque of the torque limiter 42 as shown in FIG. 29, and therefore the bulging of the thickness of the paper bundle is squeezed and becomes a thickness T' approaching a thickness of the paper itself when stacked. From this state the paper P forms a loop as shown by the dashed line, enters and is gripped at the nip at the left folding roller pair 11 rotating in the arrow direction such that the paper folds on the left side.

Figure 30:
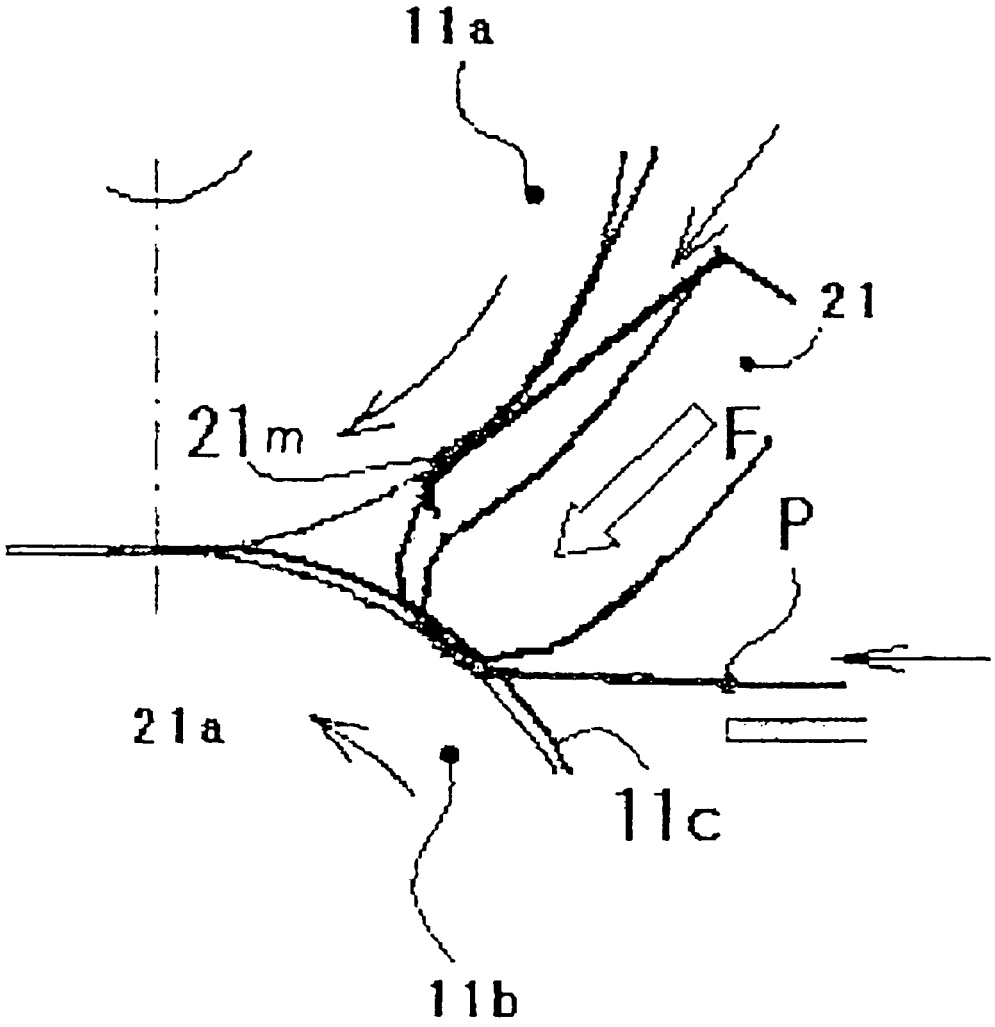
FIG. 30 is a diagram for describing an operation of a paper folding device according to a modification of the second embodiment.

Next, a modification of the second embodiment is described. In this modification, a plate spring 21*m* as shown in FIG. 30 (FIG. 30 shows a state of gripping with left folding roller pair 11, and therefore a plate spring 20*m* on the right folding roller pair 12 side is not shown) is provided at the biasing means 20 and 21 of the second embodiment. Further still, when the circular arc shape portions 20*h* and 21*h* respectively contact the collars 11*c* and 12*c* on the ends of the lower folding rollers 11*b* and 12*b* or the paper, the plate springs 20*m* and 21*m* are configured so that the paper contacts the upper side folding rollers 11*a* and 12*a* of the folding roller pairs 11 and 12 respectively. Other portions are the same as the present second embodiment.

It should be noted that in the present embodiment, paper folded repetitively in an accordion shape as shown in FIG. 3 is stacked in the tray 13 by the discharge roller 19, but the same is true when paper folded in an accordion shape is further folded in a cross shape using a folder that folds lengthwise and breadthwise to a particular size and it is possible to use a cross-folding folder mechanism in the present embodiment.

Other portions not particular described are similarly structured and function similarly as the first embodiment.

With the present embodiment, since the biasing means 20 and 21 have a gap of at least one sheet of paper with respect to the lower side folding rollers 11*b* and 12*b* of the folding roller pairs 11 and 12 on the paper folding side, the paper to be folded is supported, and the biasing means 20 and 21 contacts the paper P at the lower side folding rollers 11*b* and 12*b* of the folding roller pairs when the number of times of folding increases to guide the paper to the folding roller pairs 11 and 12, a loop of the paper P can be formed close to the folding rollers as shown in FIG. 27, such that the diameter of the thus-formed loop can be reduced, and therefore the resistance is reduced when the loop enters the folding roller nip, slippage between the paper P and the folding rollers 11*b* and 12*b* is greatly reduced, and accurate folding can be achieved at the targeted positions. Furthermore, even when repeated folding is carried out, bulging of the paper bundle can be reduced greatly as shown in FIGS. 28 and 29, and when the number of times of folding has increased, unevenness in the paper loop formation can be reduced, and accurate folding can be achieved at the targeted positions.

Furthermore, stoppers (cylindrical collars 11*c* and 12*c*) are provided for creating a gap of at least one sheet of paper between the biasing means 20 and 21 and the lower side folding rollers 11*b* and 12*b* of the folding roller pairs 11 and 12, and therefore the stoppers and the biasing means come in contact as shown in FIG. 27 when the paper has a thickness of one sheet such that there is no direct contact between the folding rollers 11 and 12 and the biasing means 20 and 21, and the machine does not suffer damage by the biasing means 20 and 21 making contact with folding rollers 11 and 12 with the biasing means 20 and 21 displacing the folding rollers 11 and 12. Thus, a stable paper folding device can be provided.

Furthermore, for a single folding of paper as shown in FIGS. 28 and 29, since the gap between the stoppers and the biasing means is at least one sheet of paper, bulging of the paper bundle that makes contact can be kept as small as possible, and when the number of times of folding has increased, unevenness in the paper loop formation can be reduced, and accurate folding can be achieved at the targeted positions.

Furthermore, since the leading edge of the biasing means 20 and 21 is given a fixed circular arc shape, a paper loop can be formed close to the folding rollers as shown in FIG. 27 and accurate folding can be achieved at the targeted positions. Furthermore, in terms of strength, the strength of the entire biasing means comes in contact with the lower side folding rollers, and therefore warping of the biasing means can be reduced and it is possible to bring the lower side folding rollers into contact with the paper with a uniform pressure, thereby enabling prevention of wrinkling.

Furthermore, by setting the coefficient of abrasion of the circular arc shape surface of the leading edge of the biasing means 20 and 21 lower than the coefficient of abrasion between sheets of paper, when the paper bundle is brought into contact with the lower side folding rollers 11*b* and 12*b* by the biasing means 20 and 21 with multiple folding as shown in FIG. 29, there is slippage between the paper and the biasing means rather than slippage between sheets in the paper bundle, and therefore paper bundle misalignment is prevented and accurate folding can be achieved at the targeted positions.

Furthermore, by providing a fluorine resin coating for the circular arc shape surface of the leading edge of the biasing means 20 and 21, the coefficient of abrasion of the circular arc shape surface can be further reduced and accurate folding can be achieved at the targeted positions. In this regard, costs can be reduced by integrating the leading edge R and the guiding plate 21*d* using sheet metal, and the leading edge diameter R can be reduced to the thickness of the sheet by bending back the leading edge portion. In this way it is possible to bring the paper very close to the nip of either of the folding roller pair 11 and 12 and unevenness in the folding positions can be reduced.

Furthermore, since the first and second folding rollers 11 and 12 and the collars 11*c* and 12*c* are made from the same material or the same type of material, even if the rollers 11 and 12 and the collars 11*c* and 12*c* expand or contract due to temperature fluctuation in the operating environment, the amount of change is the same, and therefore the gap of at least one sheet of paper does not change and a stable paper folding device can be provided without the machine suffering damage.

Furthermore, since the first and second folding rollers 11 and 12 are metal rollers coated in urethane and the collars 11*c* and 12*c* are metal rollers, the coefficient of abrasion of the folding rollers 11 and 12 can be maintained and accurate folding can be achieved at the targeted positions, and also since the gap of at least one sheet of paper does not change, and a stable paper folding device can be provided without the machine suffering damage.

Furthermore, since the pressure applying means is provided at the biasing means 20 and 21 where the upper side folding rollers 11*a* and 12*a* of the first or second folding rollers 11 and 12 contacts the paper, a carrying force of the paper and the upper side folding rollers 11*a* and 12*a* can be secured, which enables slippage to be prevented. Thus, accurate folding can be achieved at the targeted positions.

Furthermore, since the pressure applying means that brings into contact the upper side folding rollers 11*a* and 12*a* of the first or second folding rollers 11 and 12 and the paper is the plate spring 20*m*, a guiding function is achieved at the time of entrance of the leading edge of the paper and a carrying force of the paper and the upper side folding rollers can be secured, and therefore a stable carrying performance can be achieved.

Third Embodiment

The following is a description of this embodiment. It should be noted in regard to description of the aforementioned embodiments being substantially applied in the present embodiment that duplicate description thereof is omitted and only portions and characteristics of the present embodiment that are different are described below.

Figure 31:
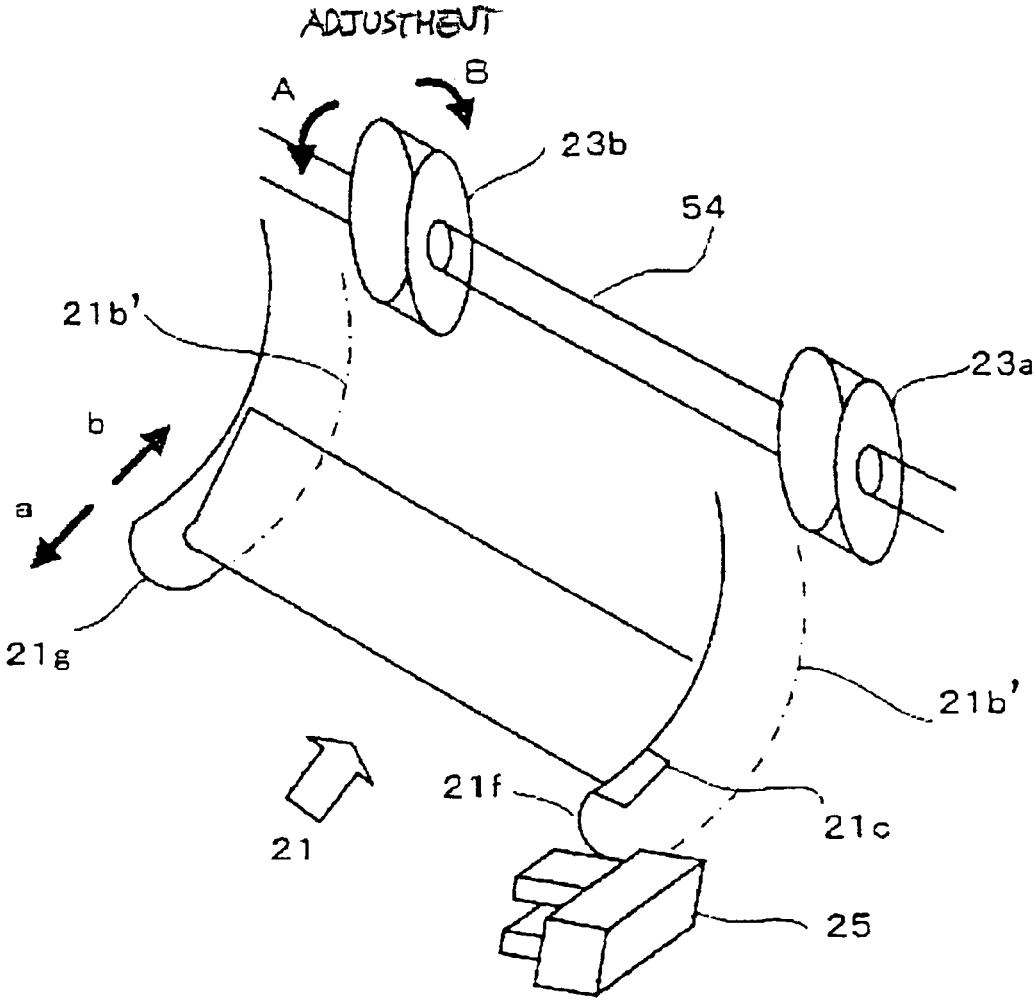
FIG. 31 is a diagram for describing an adjustment operation (when one shaft is fixed) of a biasing means of a paper folding device according to a third embodiment of the present invention.
Figure 32:
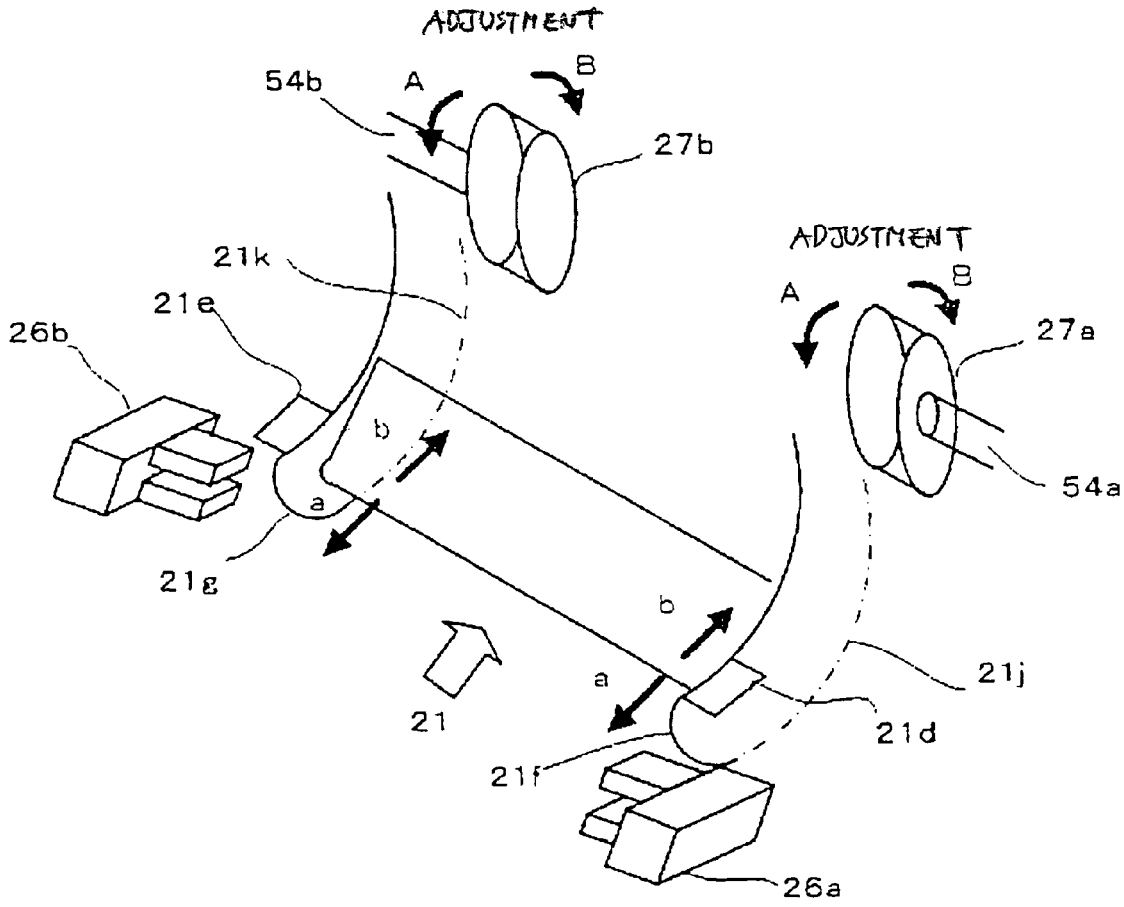
FIG. 32 is a diagram for describing an adjustment operation (when two shaft are fixed) of the biasing means of the paper folding device according to the third embodiment.

FIGS. 31 and 32 illustrate an adjustment operation of the biasing means of a paper folding device according to the third embodiment. Here, the left biasing means 21 is used here for description.

The drive gears 23*a* and 23*b* mesh with the gear portions 21*b*' at both ends of the left biasing means 21. The drive gears 23*a* and 23*b* are both driven fastened onto a single drive shaft 54, and therefore the left biasing means 21 moves parallel to the same drive shaft 54 by the amount by which the drive shaft 54 rotates. The drive shaft 54 is linked with a driven pulley 42*a*, a drive pulley 40, a drive belt 41, a shaft 39, a drive pulley 55, a drive belt 37, and a biasing means left motor 36 (see FIG. 8), and the left biasing means 21 is caused to move by the rotation of the biasing means left motor 36. Here, the drive gear 23*b* that meshes with one of the gear portions 21*b*' at the ends of the left biasing means 21 is capable of positional adjustment with the rotation direction of the other drive gear 23*a*, and when the drive gear 23*b* rotationally adjusts in the arrow A direction with respect to the drive gear 23*a*, a biasing means leading edge rear side 21*g* is adjusted in an arrow a direction. At this time, a biasing means leading edge front side 21*f* is not caused to move.

Similarly in FIG. 32, a drive gear 27*a* meshes with a front side gear portion 21*j* of the left biasing means 21, and a drive gear 27*b* meshes with a rear side gear portion 21*k*. The drive gears 27*a* and 27*b* are fastened to and driven by different drive shafts 54*a* and 54*b*, and therefore the left biasing means 21 moves by the amount of movement of the drive shafts 54*a* and 54*b*. Furthermore, the relative positions of the biasing means leading edge front side 21*f* and the biasing means leading edge rear side 21*g* changes according to their respective movements. The drive gears 27*a* and 27*b* of both ends are linked respectively to the drive pulleys 28*a* and 28*b*, the drive pulleys 40*a* and 40*b*, the drive belts 41*a* and 41*b*, the shafts 39*a* and 39*b*, the drive pulleys 55*a* and 55*b*, the drive belts 37*a* and 37*b*, and the biasing means left motors 36*a* and 36*b*, and the left biasing means 21 is caused to move by the rotation of the biasing means left motors 36*a* and 36*b*. Further still, light shielding plates 21*d* and 21*e* are provided at end portions of the biasing means 21, and biasing means left position sensors 26*a* and 26*b* block light at positions where the leading edge of the folding roller 21*a* makes contact with the lower folding roller 11*b* of the folding roller pair 11, thereby detecting the position of contact of the folding rollers. The amounts of rotation of the biasing means left motors 36*a* and 36*b* are controlled based on information from the biasing means left position sensors 26*a* and 26*b*, and adjustment is performed such that the relative positions of the biasing means leading edge front side 21*e* and the biasing means leading edge rear side 21*f* become equivalent.

Other portions not particular described are similarly structured and function similarly as the first embodiment.

With the present embodiment, the relative positions of both sides of the biasing means leading edges of the biasing means 20 and 21 can be adjusted, and therefore not only can the movement amounts of the biasing means end portions be made equivalent, but it is also possible to make parallel the relative positions of the lower folding rollers 11*b* and 12*b* of the folding roller pairs 11 and 12, which contact the leading edge portions of the biasing means, and the leading edges of the biasing means. Thus, it is possible to prevent skewing and paper misalignment due to one-sided contact to the paper of the biasing means leading edge portions. As a result, the roller pressure F is stable and very accurate folding can be achieved at the targeted positions.

Furthermore, the end drive portions of the biasing means 20 and 21 are driven by different drive sources, the relative positions of both sides of the leading edges of the biasing means are detected by the sensors 26*a* and 26*b*, and relative position adjustment can be carried out using the different drive sources, and therefore it becomes possible to perform adjustments in which the movement amounts of end portions of the biasing means during operation of a paper folding machine, relative position adjustments of both sides of the leading edge of the biasing means, and adjustments related to the relative positions of the lower side folding rollers of the folding roller pairs that are brought into contact with the leading edge portions of the biasing means, such that it is possible to continually prevent skewing and paper misalignment due to one-sided contact to the paper of the biasing means leading edge portions regardless of the paper type and number of times of folding. Thus, the roller pressure F is stable and very accurate folding can be achieved at the targeted positions.

Fourth Embodiment

The following is a description of this embodiment. It should be noted in regard to description of the aforementioned embodiments being substantially applied in the present embodiment that duplicate description thereof is omitted and only portions and characteristics of the present embodiment that are different are described below.

The following is a description of the fourth embodiment. It should be noted that same reference numerals are given to portions that are the same as in the first embodiment and duplicate description is omitted as appropriate.

Figure 33:
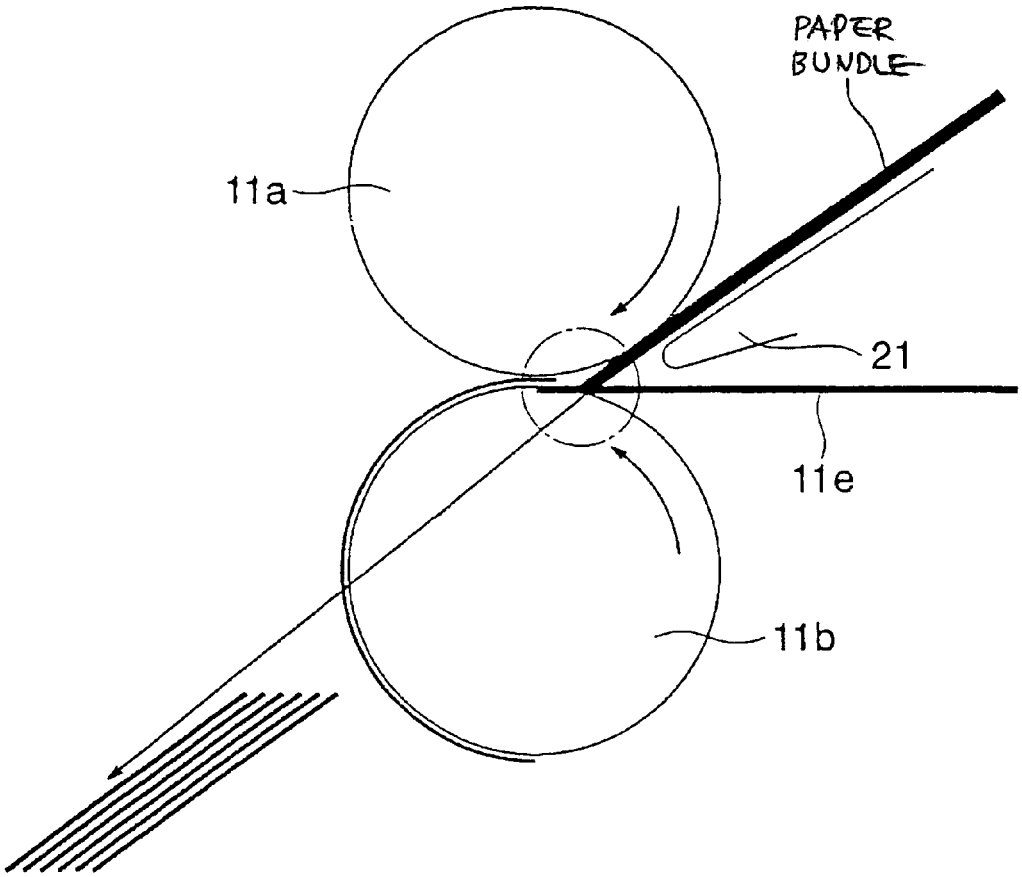
FIG. 33 is a diagram for describing a problematic point when accordion folded paper is cross folded.

The present embodiment relates to a finisher provided with a crossing portion that again further folds a paper that has been folded in an accordion shape by the paper folding portion 3 in an accordion shape in a direction orthogonal to the accordion fold. In a finisher provided with such a crossing portion, paper that has been folded in an accordion shape is again folded and therefore when the paper leading edge inserts into the nip of the folding roller pairs 11*a* and 11*b*, the paper may become misaligned in a wedge shape as shown in FIG. 33 (in particular the circled portion shows an enlarged view), and when such misalignment occurs, a disparity is created between the outer side length and the inner side length of the paper, and due to this disparity in length, the fold of the next fold cannot be folded neatly, which may result in folding a box shape or folding a Σ shape. The present embodiment is devised to handle such phenomena.

Figure 34:
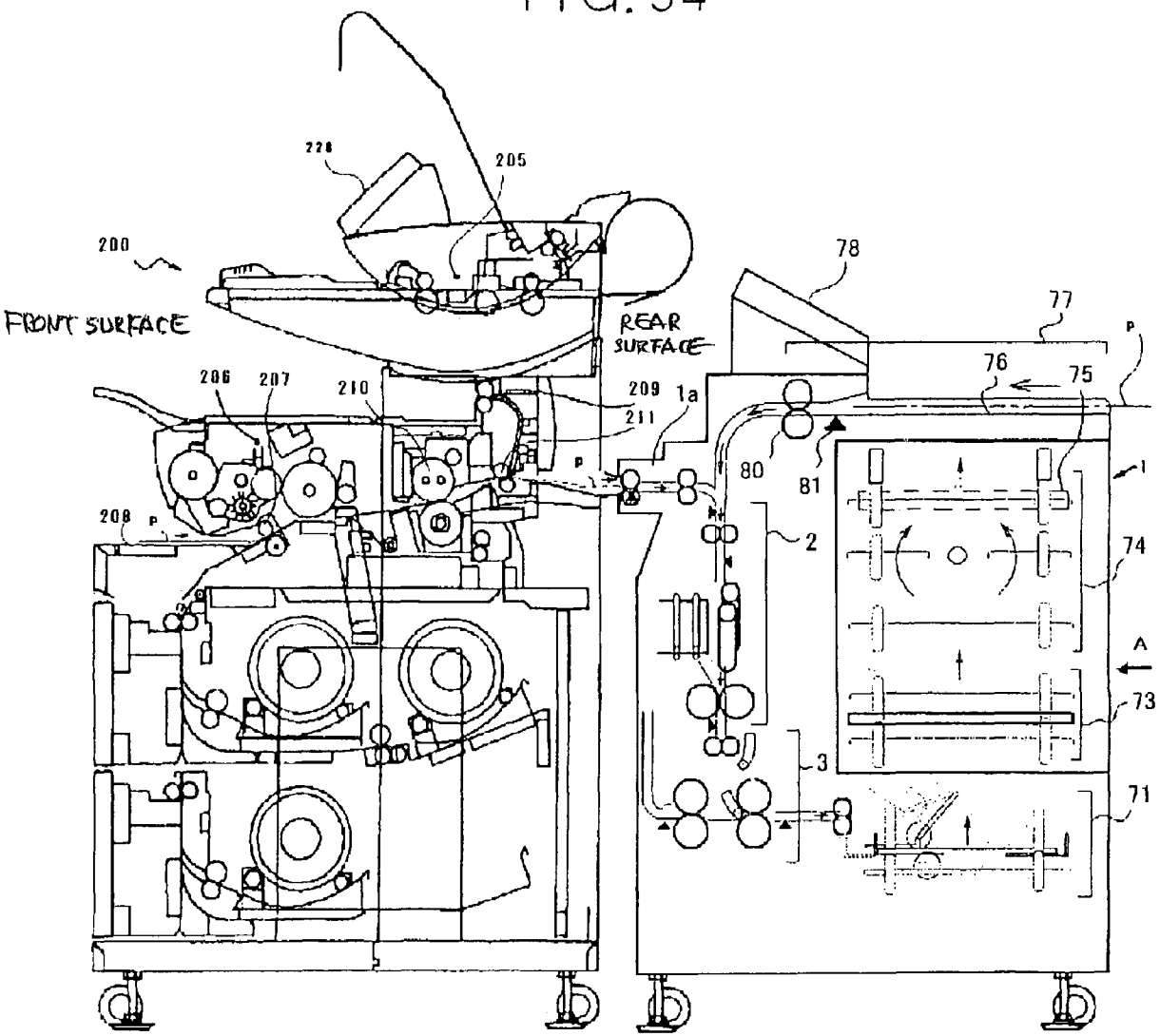
FIG. 34 is a lateral view showing a system configuration of a copying machine main unit and a paper folding device according to a fourth embodiment of the present invention.

A system according to the present embodiment includes a paper folding device 1 linked to a rear surface side of a copying machine main unit 200 in the same manner as the first embodiment. As shown in FIG. 34, the paper folding device 1 according to the present embodiment is mainly constituted by an end surface folding portion 2 that folds an end surface of a paper carried in by linking portion 1*a*, a paper folding portion 3 that is arranged in a down stream carrying direction side of the end surface folding portion 2 and folds paper in an accordion shape, a carry switching portion 71 that switches a direction in which the paper folded in an accordion shape is carried, a cross folding portion 72 for folding paper whose carry direction has been switched, an inversing portion 73 that inverts the back and front of sheets folded to an A4 size by the cross folding portion 72, a rotation portion 74 for rotating paper that has been inverted, and a tray 75. Furthermore, the paper folding device 1 is provided with a manual loading portion 77 constituted by a manual feed platform 76 as a second paper carry entrance so that paper can be inserted without passing through the copying machine main unit 200 (offline) and can also carry out folding processes. Furthermore, online operations for carrying out folding processes on paper carried in from the copying machine main unit 200 are carried out from an operation portion 220 provided at the copying machine main unit 200, and offline operations for carrying out folding processes on paper inserted from the manual loading portion 77 of the paper folding device 1 are carried out from an operation portion 78 provided at the paper folding device 1.

For online operations, paper size, folding type, and other settings are performed at the operation portion 220. Next, paper is loaded in the manual feed platform 208 arranged under the image reading apparatus 205. This paper is temporarily stopped by a register roller 207 then fed into an image forming unit 206 with an appropriate timing. The image forming unit 206 is a commonly known device that forms a latent image on an unshown photosensitive body corresponding to image data, then this latent image is developed using toner, the toner is transferred to the paper and fixed by a fixing apparatus 210. When a recorded sheet on which toner has been fixed by the fixing apparatus 210 is to undergo paper folding, the recorded sheet is discharged to the paper folding device 1 by a recorded sheet discharge roller 211. And when folding is not to be carried out, the paper is discharged to inside a main unit cylinder by an upper discharge roller 209 guided by an unshown switching claw.

When paper is to be folded, paper is sent by the recorded sheet discharge roller 211 to the paper folding device 1, then sent to the end surface folding portion 2 passing through the linking portion 1*a*. When folding an end surface of a paper, an end surface of a paper leading edge is folded by the end surface folding portion 2. At this time, the end surface folding portion 2 folds the paper end surface while being carried. Paper that has had the end surface of its leading edge folded by the end surface folding portion 2 is folded into an accordion shape in the carrying direction at the paper folding portion 3 and sent to the carry switching portion 71. Paper folded into an accordion shape that has been sent to the carry switching portion 71 undergoes skew correction by a skew correction portion 71*a* as shown in FIG. 35, which shows a view along the A direction in FIG. 34, and when perforation is required, the accordion folded paper is perforated by a punch 71*b* and the paper is sent to the cross folding portion 72.

Accordion folded paper that is sent to the cross folding portion 72 is again folded into an accordion shape in a direction orthogonal to the folding direction of the accordion folding, and folded into an A4 size. Except for the belt 72*c* provided at the lower side folding rollers 72*a* and 72*b*, this folding mechanism is fundamentally the same in the first embodiment. Accordingly, the lower side folding rollers 72*a* and 72*b* correspond to the lower side folding rollers 11*b* and 12*b*, and the upper side folding rollers 72*d* and 72*e* correspond to the upper side folding rollers 11*a* and 12*a*. That is, the folding rollers 72*a*, 72*b*, 72*d*, and 72*e* are equivalent to the folding roller pairs 11 and 12 in the first embodiment, and the belt 72*c* is wound around the pressure applying side folding rollers 72*a* and 72*b* in a tensioned state due to a tension roller 72*f*.

Paper that has been folded into an A4 size has its transfer side facing down when discharged to the tray 75 and, depending on the folding type, the paper is inverted by the inversing portion 73 then rotated 90° left or right by the rotation portion 74 so that its orientation as seen in the drawing matches up when discharged to the tray 75 and so that folding types of paper have the same orientation or the like so that orientation-aligned papers are discharged to the tray 9.

Figure 35:
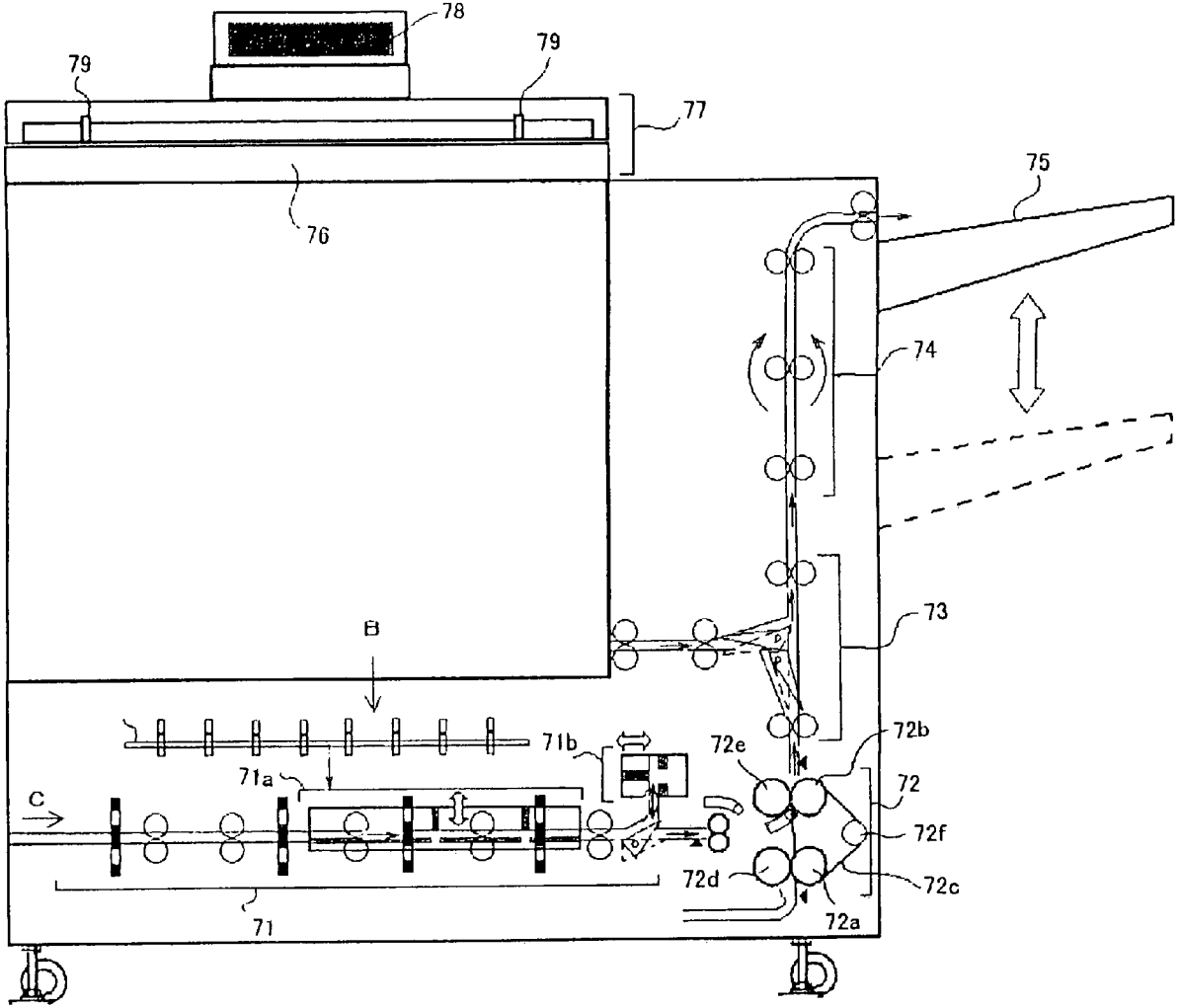
FIG. 35 is a view along an A direction arrow in FIG. 34.

In the offline operation, side fences 15 on the manual feeding platform 76 align side fences 79 shown in FIG. 35 to the width of the paper targeted for folding and paper that is loaded onto the manual feeding platform 76 is inserted in the arrow direction shown in FIG. 29. Then, the paper is detected by a paper size sensor 81, manual feeding carry roller pair 80 rotates with a predetermined timing, the paper P is gripped and temporarily stops. On the other hand, the user can perform settings such as paper size and folding type at the operation portion 78, then press a start button. Then, the manual feeding carry roller pair 80 again rotates, the paper P is carried in the arrow direction, and the paper P is sent to the end surface folding portion 2. After this, the operation is the same as online operation.

Other portions not particular described are similarly structured and function similarly as the first embodiment.

When the folding belt 72*c* is wound around the lower side folding rollers 72*a* and 72*b* in this way, resistance is reduced when the paper bundle leading edge makes contact with the folding belt 11*e* and wedge shaped misalignment can be prevented. Consequently, it is possible to keep to a minimum the leading edge of accordion folded paper becoming folded in a box shape or becoming folding in a Σ shape.

Fifth Embodiment

The following is a description of this embodiment. It should be noted in regard to description of the aforementioned embodiments being substantially applied in the present embodiment that duplicate description thereof is omitted and only portions and characteristics of the present embodiment that are different are described below.

Figure 36:
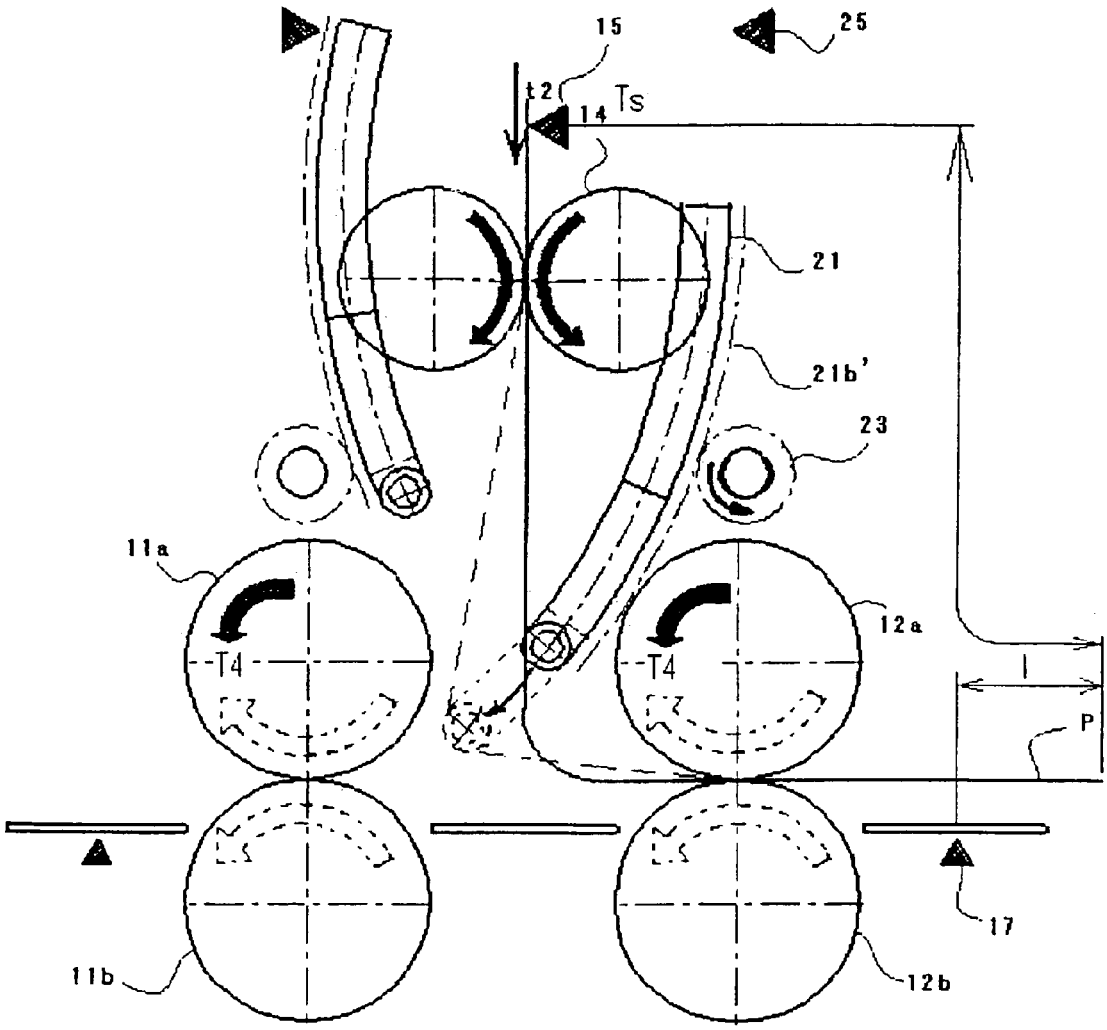
FIG. 36 shows unevenness in a stopping position of paper in the case of accordion folding and a state of correction control thereof according to a fifth embodiment of the present invention.
Figure 37A:
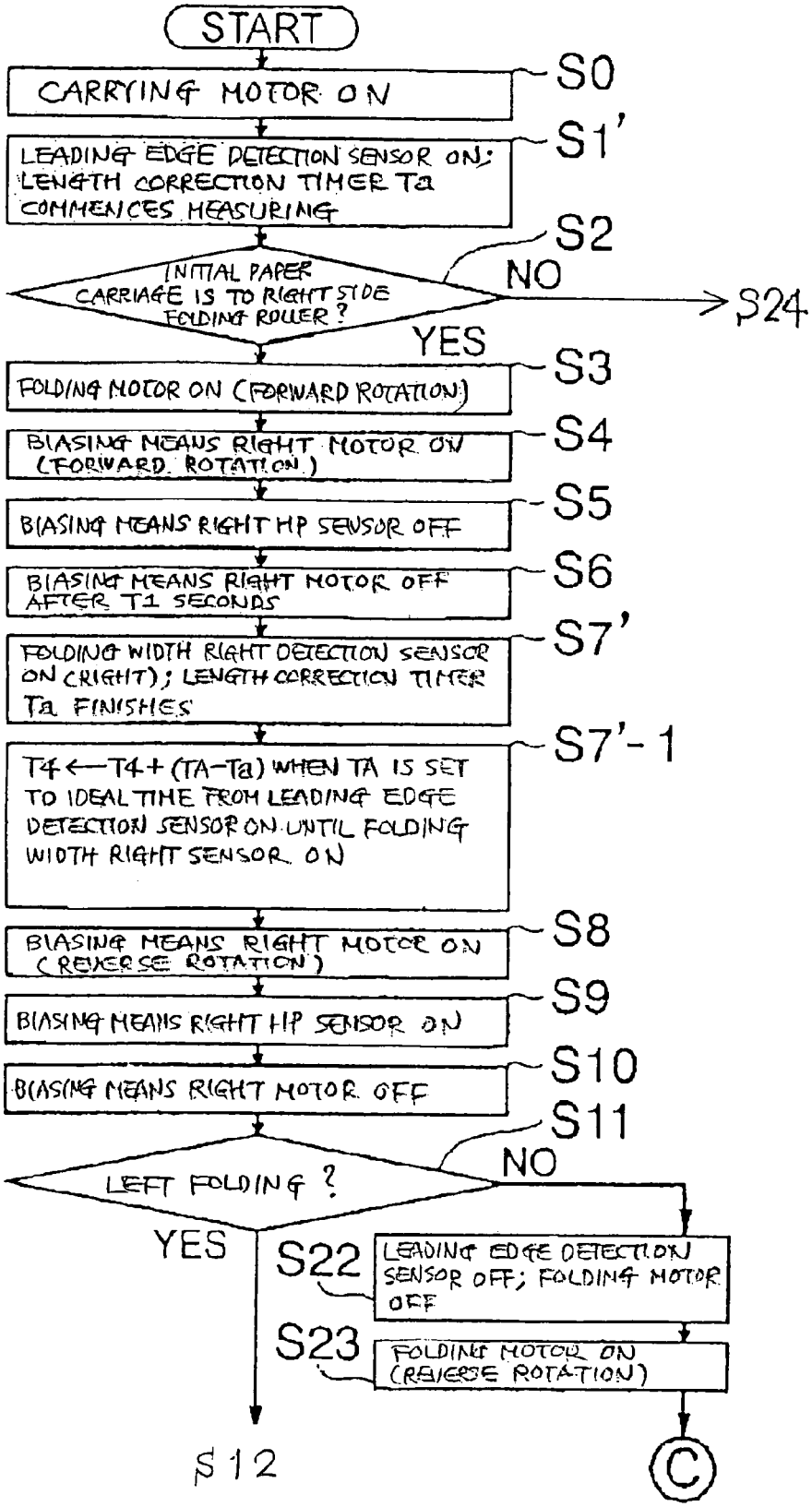
FIGS. 37A to 37D are flowcharts showing a processing procedure for correcting unevenness in the stopping position of paper in the case of accordion folding according to the fifth embodiment of the present invention.
Figure 37B:
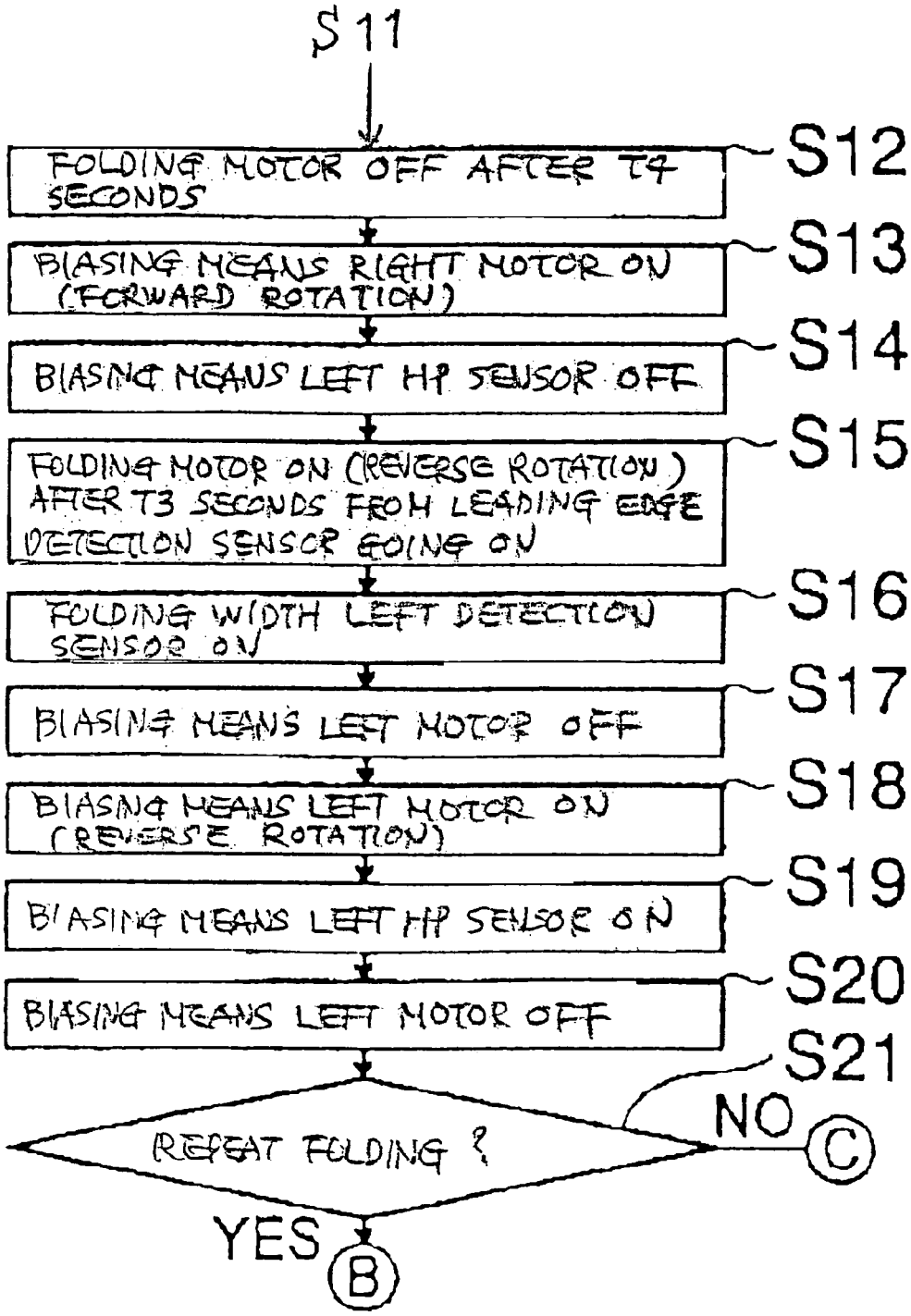
Figure 37C:
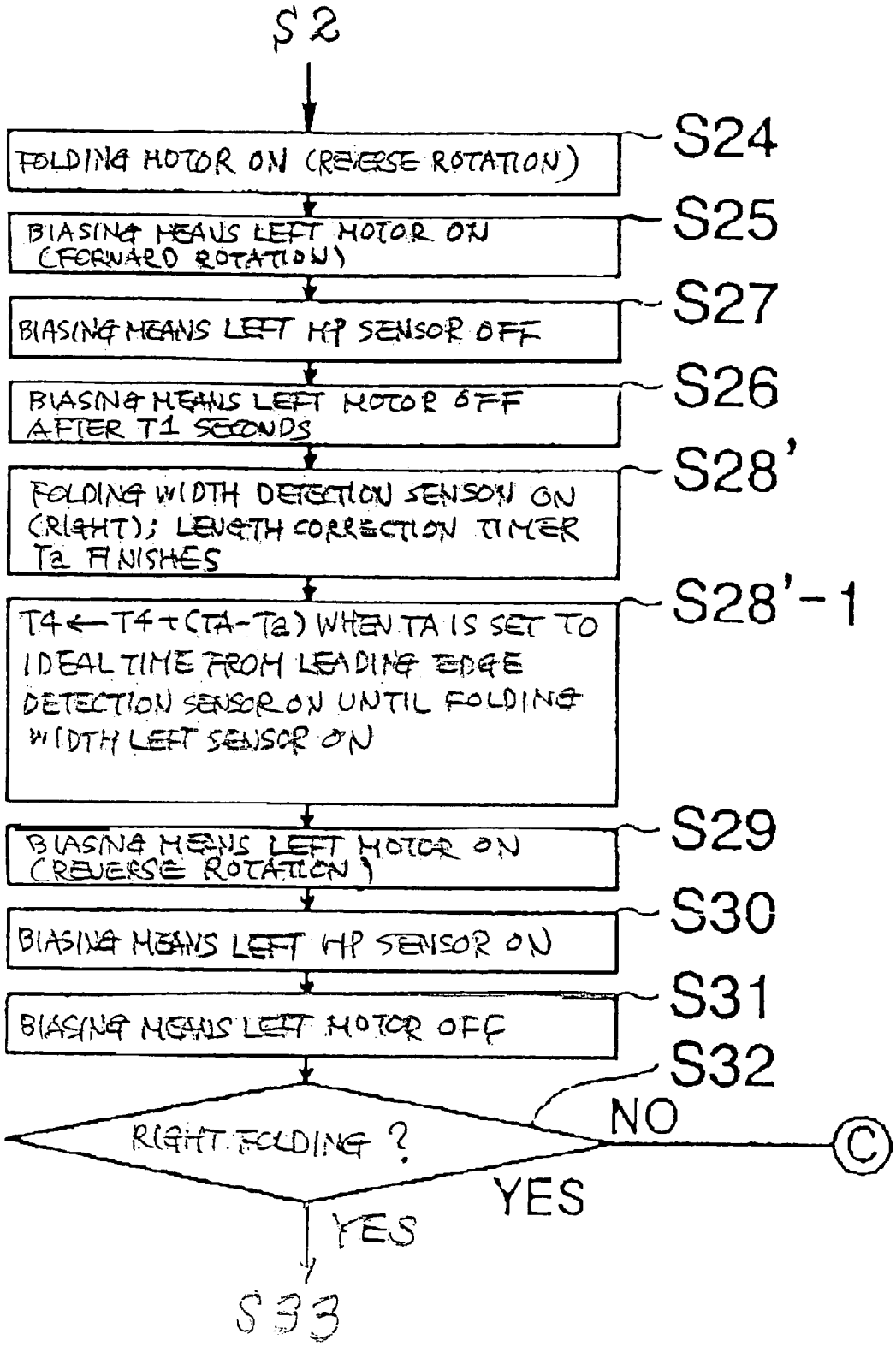
Figure 37D:
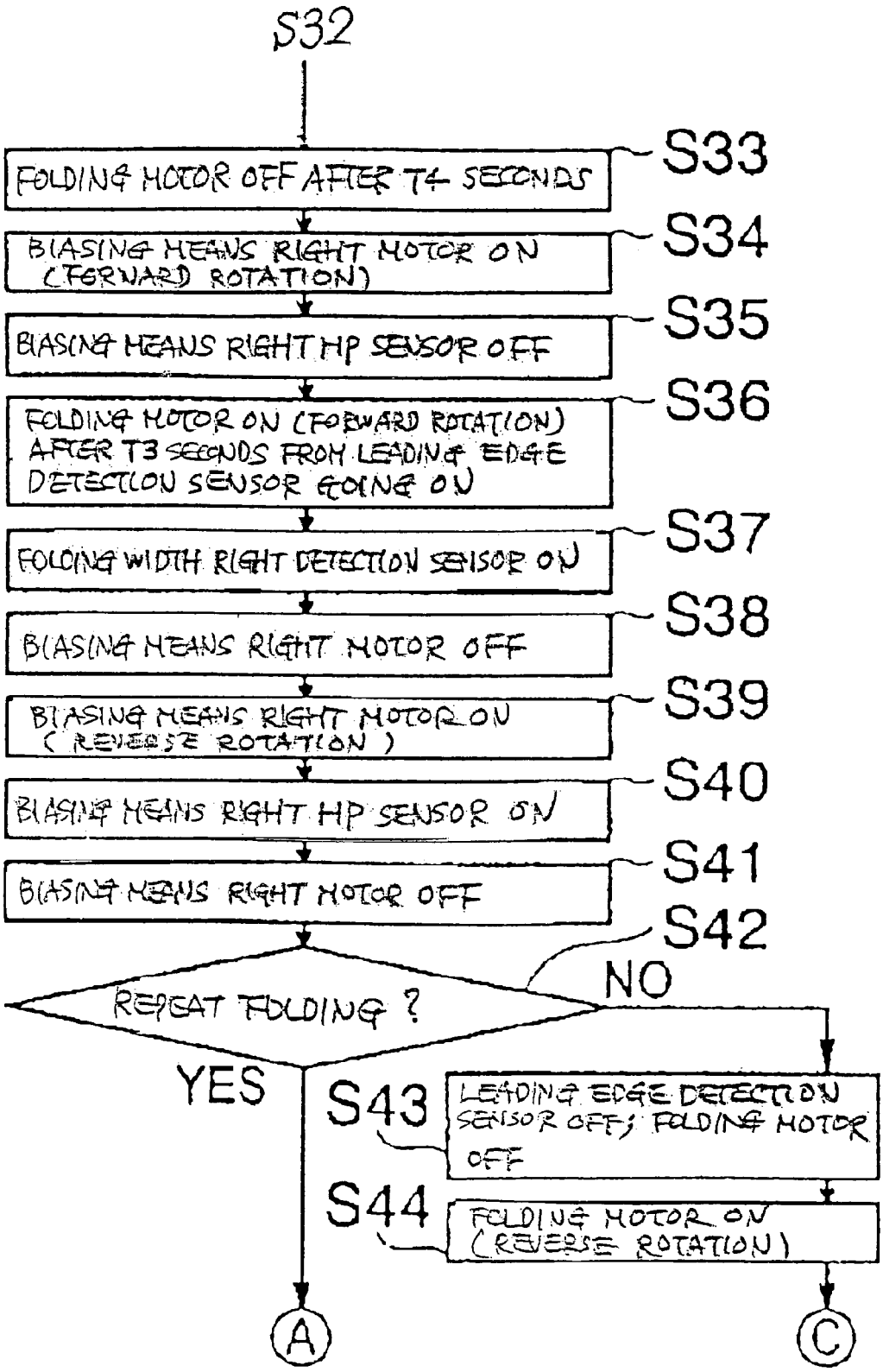

The present embodiment relates to a finisher that automatically adjusts a folding width of a first surface. As shown in FIG. 36, a time Ta, in which the paper leading edge enters the nip of the right folding rollers 12*a* and 12*b* and the leading edge detection sensor 17 goes ON, when performing accordion folding varies due to such factors as the curl direction of the paper and the thickness of the paper bundle. Accordingly, the length l from the folding width right detection sensor 17 to the stop position of the paper leading edge is uneven, and the unevenness of the length l affects the length of the immediately subsequent folding position. Thus, in the present embodiment, a time Ta is measured in which the paper leading edge enters the nip of the right folding rollers 12*a* and 12*b* and the folding width right detection sensor 17 goes ON, and a timing T4 for turning OFF and stopping the folding motor 30 is corrected based on the measured time Ta, and therefore the length from the folding width right detection sensor 17 to the stop position of the paper leading edge is kept constant.

The processing procedure of this time is shown in the flowchart of FIGS. 37A to 37D. In this flowchart, only steps S1, S7, and S28 are different from the first embodiment illustrated in FIGS. 13A to 13D, and therefore description predominantly concerns the points of difference and duplicate description is omitted as appropriate.

In FIGS. 37A to 37D, when a signal indicating paper folding is inputted from the main unit operation portion 201 shown in FIG. 12, the signal is sent to the paper folding controller 100 via the main unit control board 202. In this case, the flowchart of FIG. 37A starts at the paper folding device 1 side, the carrying motor 52 of FIG. 8 goes ON, and the carry roller pair 14 of FIG. 4 begins to rotate in the arrow direction (step S0). Next, paper is sent from the copying machine main unit 200, the leading edge of the paper passes the leading edge detection sensor 15, and an ON signal of the leading edge detection sensor 15 is inputted to the paper folding controller 100. At this time, the length correction timer Ta starts and measuring commences (step S1'). Next, a determination is made as to whether or not the initial paper carrying according to the paper folding type signal inputted from the main unit control portion 201 of FIG. 12 is a paper folding type in which the paper enters the right side folding rollers 12 (step S2). If the paper folding type is one that enters the right side folding rollers 12, the folding motor 30 of FIG. 8 turns ON and commences to rotate in the arrow direction of FIG. 4 (here this is forward rotation) (step S3), then the biasing means right motor 43 of FIG. 8 turns ON, and the right biasing means 20 of FIG. 4 commences to move from the solid line position toward the dashed line position (the rotation direction is forward at this time) (step S4).

At this time, the biasing means right HP sensor 24 goes OFF (step S5) and, after a drive time T1 in which the right biasing means 20 reaches the dashed line position from the solid line position, the biasing means right motor 43 goes OFF (step S6). At this time, as shown in FIG. 4, the roller 20*a* of the leading edge of the right biasing means 20 and the lower folding roller 12*b* do not contact and the right biasing means 20 is caused to stop in a state in which there is a slight gap. In this state, the leading edge of the paper P enters the nip of the right side folding roller pair 12 as shown in FIG. 4 and the folding width right detection sensor 17 goes on. At this time, the length correction timer Ta of step S1 stops (step S7'). Further still, if an ideal time from the leading edge detection sensor 14 going ON until the folding width right sensor 17 going ON is given as TA, the timing T4 for turning OFF and stopping the folding motor 30 is corrected as follows:

$$T4 \leftarrow T4+(TA-Ta)$$

After this, in order to return the right biasing means 20 to the standby position, the biasing means right motor 43 goes ON in the reverse rotation direction (step S8), the biasing means right HP sensor 24 goes ON (step S9), the biasing means right motor 43 goes OFF (step S10), and the right biasing means 20 returns to a standby state at the solid line position of FIG. 4. Then, the processes of step S11 onward are executed.

On the other hand, if the initial paper carry at step S2 is not a paper folding type in which the paper enters the right side folding rollers 12, then the procedure moves to step S24 and the same processes as in the aforementioned steps S7' and S7-1 are carried out for the left side biasing means 21 in steps S28' and 28'-1 to perform correction of T4, and the processes of step S29 onward are executed.

Other steps are carried out in the same manner as the processing procedure of FIG. 12.

When processing in this manner, the time Ta is measured in which the paper leading edge enters the nip of the right folding rollers 12*a* and 12*b* and the leading edge detection sensor 17 goes ON, and a timing T4 for turning OFF and stopping the folding motor 30 is corrected based on the measured time Ta, and therefore the length l from the leading edge detection sensor 17 to the stop position of the paper leading edge is kept constant. That is, unevenness in the first surface folding width can be reduced. It must be emphasized that this operation can also be carried out in the same manner for second surfaces other than the first surface fold in which folds do not overlap. It should be noted that the same is true for the left folding rollers 11*a* and 11*b*.

Sixth Embodiment

The following is a description of this embodiment. It should be noted in regard to description of the aforementioned embodiments being substantially applied in the present embodiment that duplicate description thereof is omitted and only portions and characteristics of the present embodiment that are different are described below.

Figure 38:
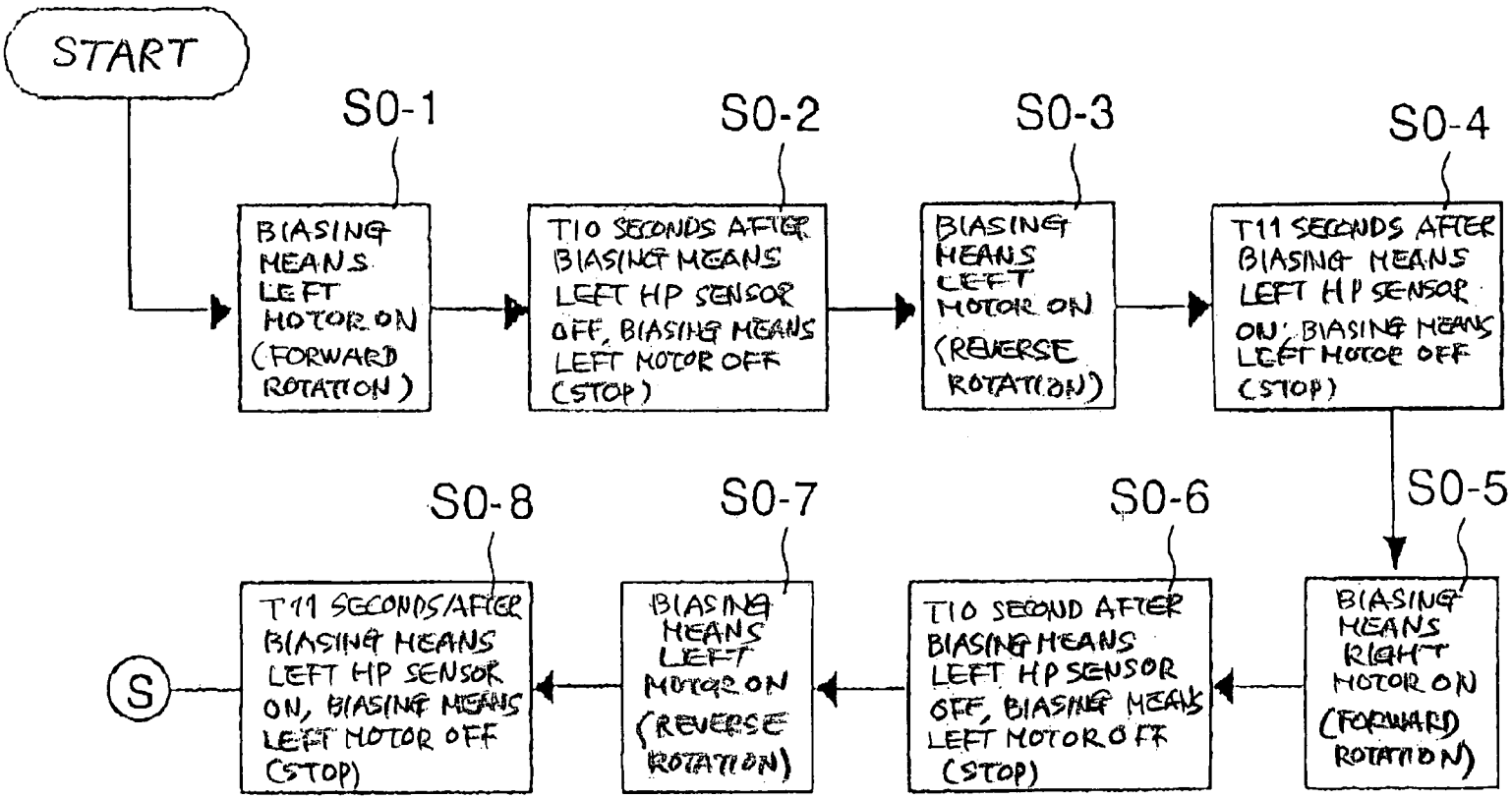
FIG. 38 is a flowchart showing a processing procedure according to a sixth embodiment of the present invention.

In the paper folding device 1 of the present embodiment, when a signal indicating paper folding is inputted from the main unit operation portion 201 shown in FIG. 12, necessary information such as paper type is appended and the signal is sent to the paper folding controller 10 via the main unit control board 202. In this case, the flowchart of FIG. 38 starts at the paper folding device 100 side, the biasing means left motor 36 of FIG. 8 goes ON in the forward rotation direction (step S0-1), then, after the biasing means left HP sensor 25 goes OFF, the biasing means left motor 36 goes OFF after T10 seconds (step S0-2), after which the biasing means left motor 36 goes on in the reverse rotation direction (step S0-3), then, after the biasing means left HP sensor 25 goes ON, the biasing means left motor 36 goes OFF after T11 seconds (step S0-4), thereby adjusting the standby position of the left biasing means 21.

Next, adjustment of the standby position of the right biasing means 20 is carried out in the same manner as the adjustment for the left biasing means 21 using the biasing means right motor 43 and the biasing means right HP sensor 24 via the flowchart steps S0-5 to S0-8. The standby positions of the biasing means 20 and 21 are determined according to various sensors and information by the paper folding controller 10 of FIG. 11 obtaining necessary information such as folding type, paper size, and paper type from the main unit control board 202. After this, a jump is made to S, and the carry motor 52 of FIG. 8 goes ON and the carrying roller pair 14 of FIG. 4 commences rotating in the arrow direction (step S0).

Following this, the operations of FIGS. 13A to 13D and 14A to 14D are carried out.

Figure 39:
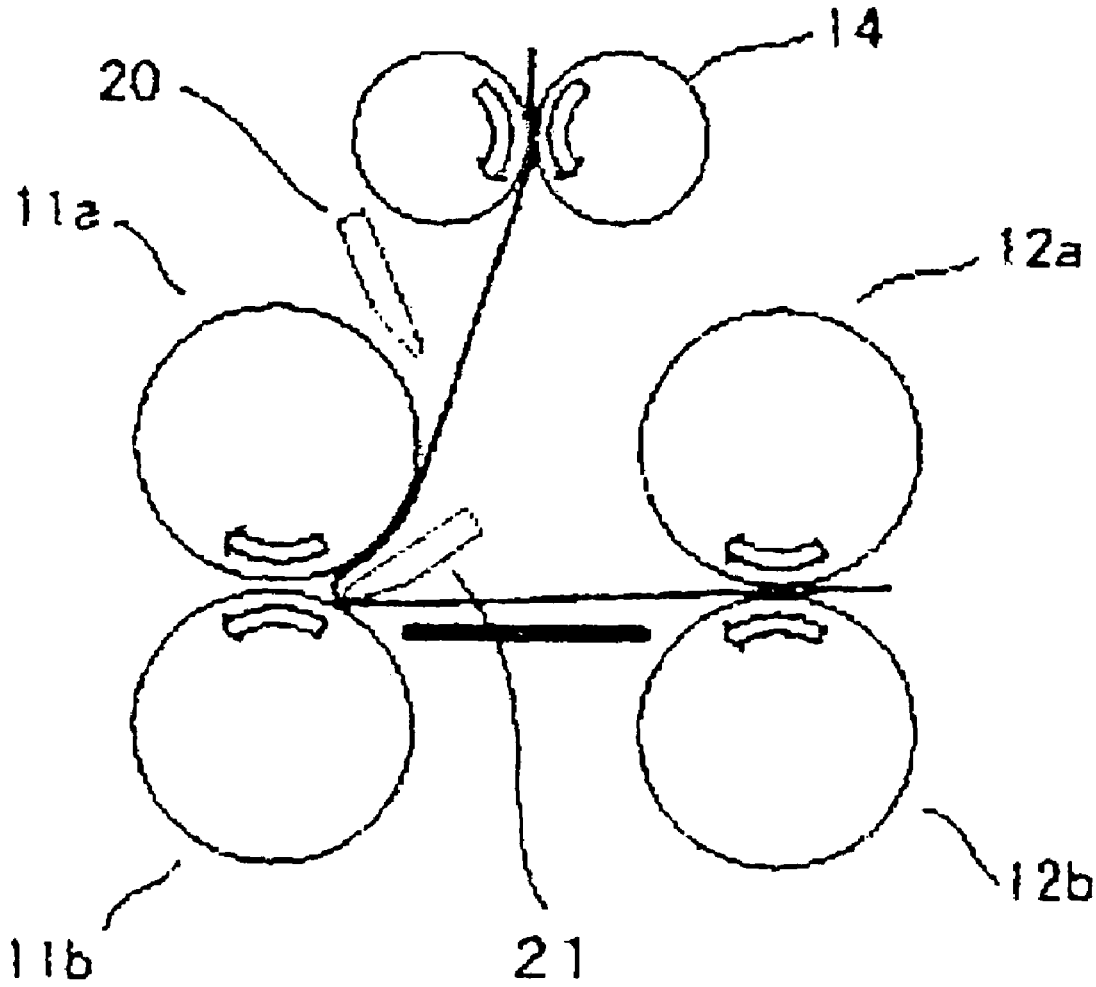
FIGS. 39 to 41 are diagrams for describing operations of a paper folding device according to this embodiment.
Figure 40:
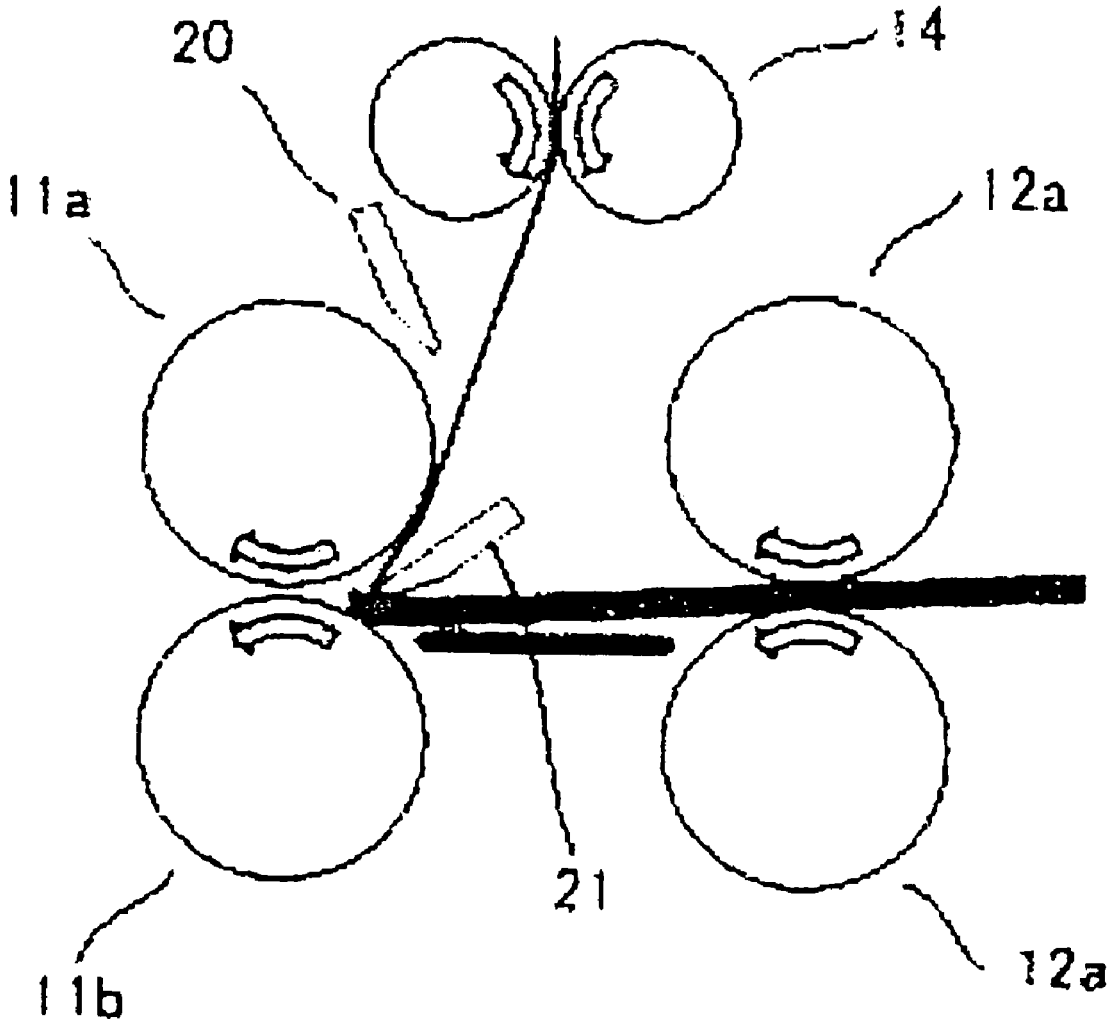
Figure 41:
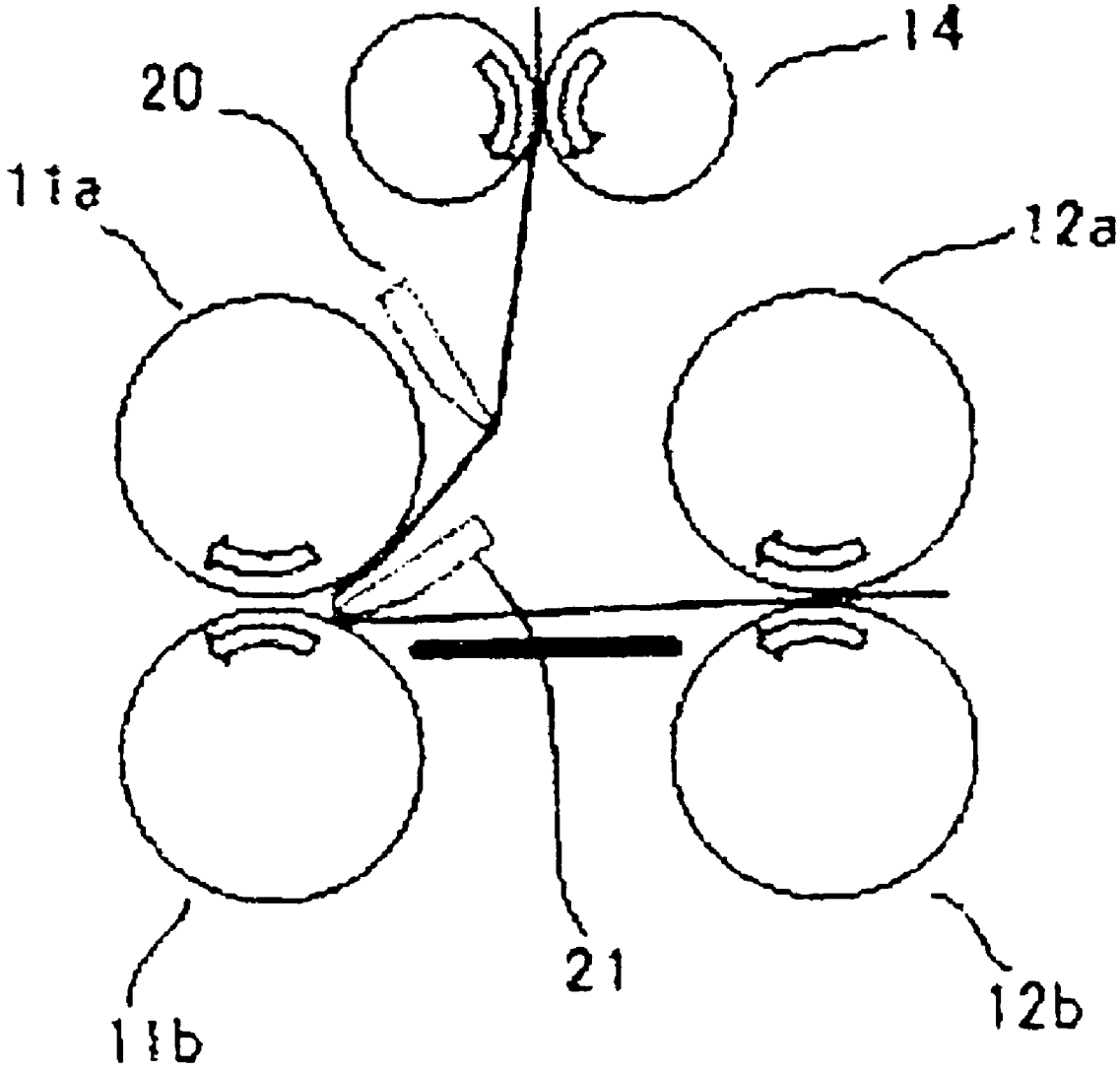

On the other hand, in the present embodiment, although the tension on the paper is also affected by the aforementioned pressure F, a biasing means is used on a reverse side to that of the biasing means used actively on the folding side. For example, when the paper P is caused to enter the nip of the left folding roller pair 11 (11*a* and 11*b*) by a left shifting means 21 as shown in FIG. 39, tension can also be applied to the paper P by a right shifting means 20 as shown in FIG. 41. This also enables the angle at which the paper P is wound onto the upper side folding rollers 11*a* to be adjusted. That is, the position of a paper guide 21 of the right shifting means 20 is set appropriately, and the standby position of the right shifting means 20 is set so as to achieve a desired tension. The reverse operation is used in the case of the left shifting means 21.

In regard to the winding angle, when a single sheet is folded multiple times for example, the feeding position of the paper P at the nip changes in response to increased numbers of times of folding, and therefore the aforementioned adjustment is necessary and this also changes due to the abrasive force of the paper P, and therefore adjustment is necessary. For this reason, in the present embodiment, when folding a single sheet multiple times, the tension applied to the paper P is reduced in accordance with increases in the number of times of folding, and the tension on the paper P is reduced for paper P having little abrasive force compared to paper having strong abrasive force. Tension adjustments can be made using the standby positions of the biasing means 20 and 21, and therefore when reducing the tension, the biasing means is moved to a position backward, that is to say, a direction away from the folding rollers compared to when increasing the tension. The amount of shifting is stored in advance as a table for example in an unshown RAM of the paper folding controller 10, and a CPU of the paper folding controller 10 makes judgments and carries out control according to information from the main unit control portion 201.

It should be noted and emphasized in regard to the present embodiment that a member that applies tension may be provided separate to the case of using the biasing means 20 and 21. Furthermore, the winding onto the folding rollers 11 and 12 is carried out by having the paper guides 20*a* and 21*a* of the biasing means 20 and 21 push the paper onto the upper side folding rollers 11*a* and 12*a*, and therefore the abrasive force is prescribed by the pressing force of the paper of the paper guides 20*a* and 21*a* on the upper side folding rollers 11*a* and 12*a*.

Accordingly, the positions of the paper guides 20*a* and 21*a* can be moved and slippage between the paper P and the upper folding rollers 11*a* and 12*a* due to differences in the abrasion coefficient, firmness, and thickness of the paper P can also be adjusted and thus unevenness in folding positions due to thick papers and thin papers as well as unevenness in the folding positions for single folds and muitiple folds can be reduced. As a result, folding functions can be achieved with very high folding accuracy and stability.

The following effects are provided by the present embodiment.

The biasing means applies a constant tension to the paper and with this tension, the paper contacts, is carried by, and folded into the upper side folding rollers on the folding roller pair on the side where the paper is folded, and therefore a loop of paper can be formed close to the folding rollers and the diameter of the thus-formed loop can be reduced, and therefore the resistance is reduced when the loop enters the folding roller nip, and not only is slippage between the paper and the lower side folding rollers greatly reduced, but slippage between the paper and the upper side rollers due to paper contacting the upper side rollers can be greatly reduced, such that accurate folding can be achieved at the targeted positions.

Furthermore, bulging of the paper bundle is reduced as much as possible even when repeated folding occurs and unevenness in the paper loop formation can be reduced when the number of times of folding increases, such that accurate folding can be achieved at the targeted positions. Moreover, a constant tension is applied to the paper to eliminate slackness of the paper, and therefore very accurate folding can be achieved at the targeted positions by accurately bringing the targeted positions into contact with the lower side folding rollers and the upper side folding rollers of the folding roller pairs.

Furthermore, although the tension applied to the paper is also affected by the pressure F as described above, a biasing means is used on a reverse side to that of the biasing means used actively on the folding side, and when the paper enters the nip of the left folding roller pair due to the left shifting means, tension is applied to the paper by the right shifting means such that the angle at which the paper is wound onto the upper side folding roller can be adjusted.

Furthermore, the carry rollers and the two pairs of folding rollers are set in a positional relation of where the paper is brought into contact with the upper side rollers of the folding roller pair on the side where paper is folded in an operation in which the biasing means contacts the lower side folding roller of the folding roller pair on the side where paper is folded, and therefore slippage between the paper and the upper side rollers can be reduced and accurate folding can be achieved at the targeted positions without adding new components.

Furthermore, by providing paper guides so that the paper makes contact with the upper side rollers of the folding roller pair on the side where paper is folded, it becomes possible to achieve contact with the upper side folding rollers and the lower side folding rollers with excellent timing regardless of the positions of the carry roller and the two pairs of folding rollers, and therefore slippage between the paper and the upper/lower rollers at the time of paper contact can be reduced and accurate folding can be achieved at the targeted positions.

Furthermore, since the standby positions of the opposing biasing means also act as paper guides so that the paper contacts upper side folding rollers of the folding roller pair on the side where paper is folded, the aforementioned effect can be achieved without adding new components.

Furthermore, the position of the paper guides, which are provided so that the paper contacts upper side folding rollers of the folding roller pair on the side where paper is folded, can be moved in order to adjust the angle at which the paper winds onto the upper side folding rollers, and therefore slippage between the paper and the upper folding rollers due to differences in the abrasion coefficient, firmness, and thickness of the paper can be adjusted, and the balance of slippage between the paper and the lower folding rollers can be aligned, and therefore accurate folding can be achieved at the targeted positions.

Furthermore, the standby positions of the opposing biasing means, which also act as paper guides so that the paper makes contact with the upper side folding rollers of the folding roller pair on the side where paper is folded, can be changed to enable adjustment of the angle at which the paper winds onto the upper side folding rollers, and therefore the aforementioned effect can be achieved without adding new components.

Furthermore, the position of the paper guides, which are provided so that the paper contacts upper side folding rollers of the folding roller pair on the side where paper is folded, can be changed to enable adjustment of the angle at which the paper winds onto the upper side folding rollers according to paper thickness and the number of times of folding, and therefore variation of the wind on angle to the upper folding roller due to such factors as the paper thickness and the number of times of folding can be eliminated, and slippage between the paper and the upper folding rollers due to such factors as the paper thickness and the number of times of folding can be reduced, thereby enabling accurate folding to be achieved at the targeted positions.

Furthermore, a freely rotatable roller is provided at the leading edge of the paper guides, which are provided so that the paper contacts upper side folding rollers of the folding roller pair on the side where paper is folded, and this roller guides the paper so that the paper makes contact with the upper side folding rollers of the folding roller pair on the side where paper is folded, and therefore carrying resistance is reduced, and the carrying precision can be improved, thereby enabling accurate folding to be achieved at the targeted positions. Furthermore, damage to the paper by the leading edge of the paper guide can be reduced by using the freely rotatable roller, thereby improving the quality of the paper fold finish.

Furthermore, by forming the freely rotatable roller at the leading edge of the paper guides as a single roller having a length greater guided paper width, the pressure on the paper when contact is made between the roller and the paper can be made uniform in the width direction, thereby eliminating rippling in the width direction of the paper and preventing occurrences of winkling. Thus, damage to the paper can be reduced and the quality of the paper fold finish can be improved.

Furthermore, when the freely rotatable roller at the leading edge of the paper guide is configured from a pipe shaped roller and the biasing means also acts as a paper guide, the weight of the biasing means can be reduced, thereby reducing the required torque of the drive motors and enabling reduced costs.

Furthermore, by having the freely rotatable roller at the leading edge of the paper guide support the biasing means in the width direction, warping of the roller is prevented when the roller and paper make contact, and the pressure on the paper can be made uniform in the width direction, thereby eliminating rippling in the width direction of the paper and preventing occurrences of winkling.

Furthermore, by supporting locations that bear the freely rotatable roller at the leading edge of the paper guide using a plurality of shaft bearing members, partial contact of the rollers and the shaft bearing portion with respect to the curvature of the biasing means is prevented, and warping of the roller over time due to uneven wear of the shaft bearing portion is prevented, thereby enabling accurate folding to be achieved at the targeted positions.

It should be noted that the paper folding devices described up until here are devices that fold sheets (recorded sheets) on which an image has been formed having been outputted from a copying machine main unit, but since the copying machine itself is an image forming apparatus provided with an image reading device, it is sufficient for there to be a function of printing and outputting a read image onto a recording sheet. Accordingly, an image forming apparatus of a commonly known system or structure such as an electrophotographic system image forming apparatus or an inkjet system image forming apparatus can be used as the image forming apparatus (image forming portion of a copying machine).

With the present invention, the biasing means contacts the paper at the lower side folding roller of the folding roller pair of the side on which the paper is folded and the paper to be folded is carried and folded, and therefore unevenness in folding positions due to thick papers and thin papers as well as unevenness in the folding positions for single folds and multiple folds are greatly reduced and folding functions with high folding accuracy and stability are achieved.

Furthermore, with the present invention, a tension applying means is provided that applies tension to the paper folded between the folding roller pair and the carry roller pair, and therefore unevenness in folding positions due to thick papers and thin papers as well as unevenness in the folding positions for single folds and multiple folds are greatly reduced and folding functions with high folding accuracy and stability are achieved.

Various modifications will become possible for those skilled in the art after receiving the teachings of the present disclosure without departing from the scope thereof.

What is claimed is:

1. A paper folding device, comprising:

a folding roller pair that folds a paper;

a carry roller pair that feeds the paper to the folding roller pair;

a first and second biasing device configured to switch a direction in which the paper is bent by the folding roller pair and folding in the paper; and a tension applying device that applies tension to the paper folded between the folding roller pair and the carry roller pair, wherein the biasing device applies a fixed tension to the paper, for carrying the paper the tension is used to bring the paper into contact with an upper side folding roller of the folding roller pair on a side where paper is folded, and the paper is folded in a nip of the folding rollers, wherein standby positions of opposing biasing devices function as paper guides so that the paper makes contact with the upper side folding rollers of the folding roller pair on the side where paper is folded, wherein the standby positions of the paper guides are configured to be shifted by a shifting device, and wherein the device for shifting shifts the positions in response to a paper thickness and/or a number of times of folding.

2. A paper folding device, comprising:

a folding roller pair that folds a paper;

a carry roller pair that feeds the paper to the folding roller pair;

a first and second biasing device configured to switch a direction in which the paper is bent by the folding roller pair and folding in the paper; and a tension applying device that applies tension to the paper folded between the folding roller pair and the carry roller pair, wherein the biasing device applies a fixed tension to the paper, for carrying the paper the tension is used to bring the paper into contact with an upper side folding roller of the folding roller pair on a side where paper is folded, and the paper is folded in a nip of the folding rollers, wherein standby positions of opposing biasing devices function as paper guides so that the paper makes contact with the upper side folding rollers of the folding roller pair on the side where paper is folded, wherein the standby positions of the paper guides are configured to be shifted by a shifting device, and wherein the device for shifting shifts the standby positions in a direction to decrease tension on the paper in accordance with an increase in a number of times of folding.

3. A paper folding device, comprising:

a folding roller pair that folds a paper;

a carry roller pair that feeds the paper to the folding roller pair;

a first and second biasing device configured to switch a direction in which the paper is bent by the folding roller pair and folding in the paper; and a tension applying device that applies tension to the paper folded between the folding roller pair and the carry roller pair, wherein the biasing device applies a fixed tension to the paper, for carrying the paper the tension is used to bring the paper into contact with an upper side folding roller of the folding roller pair on a side where paper is folded, and the paper is folded in a nip of the folding rollers, wherein standby positions of opposing biasing devices function as paper guides so that the paper makes contact with the upper side folding rollers of the folding roller pair on the side where paper is folded, wherein the standby positions of the paper guides are configured to be shifted by a shifting device, and wherein the device for shifting shifts the standby positions in a direction to decrease tension on the paper more for paper having a small abrasive force compared to paper having a large abrasive force.

* * * * *